United States Patent [19]

Marshall et al.

[11] Patent Number: 5,035,622

[45] Date of Patent: Jul. 30, 1991

[54] MACHINE GUN AND MINOR CALIBER WEAPONS TRAINER

[75] Inventors: Albert H. Marshall, Orlando; Ronald S. Wolff, Cocoa; Robert T. McCormack, Orlando; Edward J. Purvis, Winter Park, all of Fla.

[73] Assignee: The United States of America as represented by the Secretary of the Navy, Washington, D.C.

[21] Appl. No.: 445,803

[22] Filed: Nov. 29, 1989

[51] Int. Cl.[5] ..... F41G 3/26

[52] U.S. Cl. ..... 434/23; 434/16; 434/20; 273/313; 358/104; 73/167; 446/405; 340/706

[58] Field of Search ..... 434/16–24, 434/307; 358/104; 273/310–316; 73/167; 446/401, 405, 473; 340/706–708

[56] References Cited

U.S. PATENT DOCUMENTS

| | | | |
|---|---|---|---|
| 4,218,834 | 8/1980 | Robertson | 434/21 |
| 4,302,190 | 11/1981 | Shaw et al. | 434/18 |
| 4,439,156 | 3/1984 | Marshall et al. | 434/20 X |
| 4,538,991 | 9/1985 | Simpson et al. | 434/20 X |
| 4,606,724 | 8/1986 | Chanforan et al. | 434/20 |
| 4,639,222 | 1/1987 | Vishlizky | 434/20 |
| 4,789,339 | 12/1988 | Bagnall-Wild et al. | 434/20 |
| 4,813,682 | 3/1989 | Okada | 434/20 X |
| 4,820,161 | 4/1989 | Wescott | 434/16 |
| 4,824,374 | 4/1989 | Hendry et al. | 434/22 |

FOREIGN PATENT DOCUMENTS

| | | | |
|---|---|---|---|
| 3211711 | 10/1983 | Fed. Rep. of Germany | 434/20 |

*Primary Examiner*—Richard J. Apley
*Assistant Examiner*—Joe H. Cheng
*Attorney, Agent, or Firm*—Robert W. Adams

[57] ABSTRACT

A trainer for manually aimed weapons, having a projection screen video system, a video disk player for providing pre-recorded scenes of a target image, a simulated weapon having actuable trigger, and a microprocessor having a file that identifies target location and range within each frame of the scenes and programmed to superimpose upon actuation of the trigger a graphic in-flight and impact image of a shot computed from a fourth order ballistics equation. Recoil of the simulated weapon is provided by pneumatics, as well as sound affects of the shot and its distant impact. Hit and miss explosions are provided in graphics selected from a set of stored image data by comparing the computed location of impact to the pre-identified target location. For shots that impact beyond the target, blanking of the graphics image is provided for that part of the explosion hidden by the target.

7 Claims, 4 Drawing Sheets

MACHINE GUN AND MINOR CALIBER WEAPONS TRAINER

BACKGROUND OF THE INVENTION

1. Field Of The Invention

The invention relates generally to the field of training devices, an more particularly to devices on which trainees practice firing manually aimed weapons in simulation by "firing" a demilitarized or simulated weapon at a target imaged on a video projection screen.

2. Description Of The Prior Art

Minor caliber weapons that lack a fire control system are installed on-board naval ships for close-in ship defense against high speed boats and aircraft that are used with hostile intent. The gunner must be practiced in the difficult art of manually aiming the weapon in lead angle and elevation that is closely related to being an experienced and accurate estimator of range, in order to be effective at eliminating the threat. Previously, the training that is necessary to achieve and maintain proficiency at range and lead estimation has been conducted in the classroom without the aid of a training device, and in the field at great expense with live rounds against dummy targets. Such training lacks an accurate threat simulation and fails to provide marksmanship training against an elusive target, variable daylight and sea state conditions, and training in target identification, as well as accepts a trade-off of safety for realism.

Art that is relevant to the field includes U.S. Pat. No. 4,824,374 that discloses a target trainer having a screen on which is depicted a scene, a target projector for projecting the image of a moving target on the screen, and a combination of an infra-red target beam projector and infra-red sensitive television camera, associated with a simulated weapon and the target to determine the accuracy of simulated shooting at the target. U.S. Pat. No. 4,820,161 discloses a device for simulating indirect field of fire gunnery for training artillery gunnery observers, that includes a screen for showing a photographic image of terrain overlaid with computer generated images of shell bursts at locations corresponding to commands given by a trainee. U.S. Pat. No. 4,813,682 discloses a television game using a photosensitive gun and a technique to avoid mistaking light from an outside source for the light from the target, wherein actuation of the gun's trigger causes black picture data to be displayed followed immediately by white picture data in the position of the target, which white picture data is detected and processed for use as a detection signal from the target. U.S. Pat. No. 4,789,339 discloses an attachment to a gun having a fire control system, that provides simulated scenic images to the gun's visual display and overwrites the scene with simulated target images, then computes the gunner's accuracy by computing the difference between his aim point and the location of the simulated target. U.S. Pat. No. 4,639,222 discloses a gunnery trainer having a library of video records of actual projectile trajectories and impacts for various orientations, wherein the video record is selected and displayed in a time relationship to trigger actuation. U.S. Pat. No. 4,606,724 discloses a simulator of small-bore guns that provides images of target, tracers and aim point in the gunsight.

SUMMARY OF THE INVENTION

The present invention overcomes the disadvantages of the prior art by providing a device that will train a gunner with a simulated or demilitarized weapon on a projection video system wherein a library of prerecorded video target scenarios are preselectively available to randomly present various sequences by type, and wherein each shot launched by the gunner from the weapon is graphically displayed through its trajectory to impact. Hits and misses are determined by comparing the computed point of impact with the target's location on the relevant frame of video, wherein the target's location has been previously identified frame by frame for use in the comparison, and scoring is accomplished by accumulating points that relate to proximity of impact to target. Hits are depicted by graphically burning the target; and, recoil is provided pneumatically through the weapon's handles. A sound generator having a first section for simulating the discharge of the weapon is provided, as well as a second section for simulating the sound of hits and misses delayed to simulate the lag between seeing the impact and hearing it.

Accordingly, an object of the present invention is to achieve realism for a gunner operating a simulator that represents a weapon that must be manually aimed. Another object is to provide a simulator having a projection system of prerecorded video showing scenes in which a moving target represents the threat to be removed and the trainees effectiveness is scored by comparing a digital representation of the target's location with digital computations of the trainee's shots. Another object is to provide such a simulator wherein the flight and impact of the shots are graphically superimposed on the video scenes. And, another object is for a device wherein sound, recoil and hits/misses are depicted realistically to the trainee.

DESCRIPTION OF A PREFERRED EMBODIMENT

Figure 1:
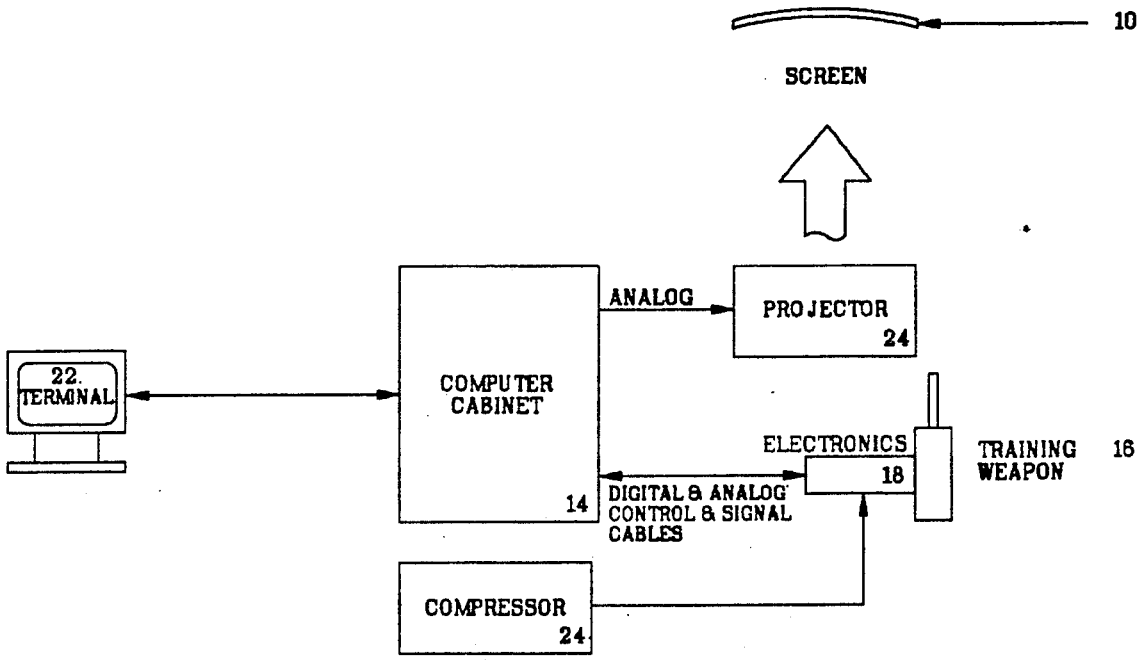
FIG. 1 is a block diagram of a preferred embodiment of the invention.

An embodiment of the present invention is shown in FIG. 1 to include projection screen 10 and video color video projector 12, computer cabinet 14 coupled to and driving projector 12, simulated or demilitarized weapon 16 and associated electronic package 18 coupled to and communicating with microcomputer 14, and compressor 20 used to pneumatically active recoil simulation in weapon 16. Instructor's terminal 22 may be included. Electronics package 18 may be enclosed in the ammo box that would accompany the weapon simulated by training weapon 16, to retain a realistic appearance to the trainee.

Figure 2:
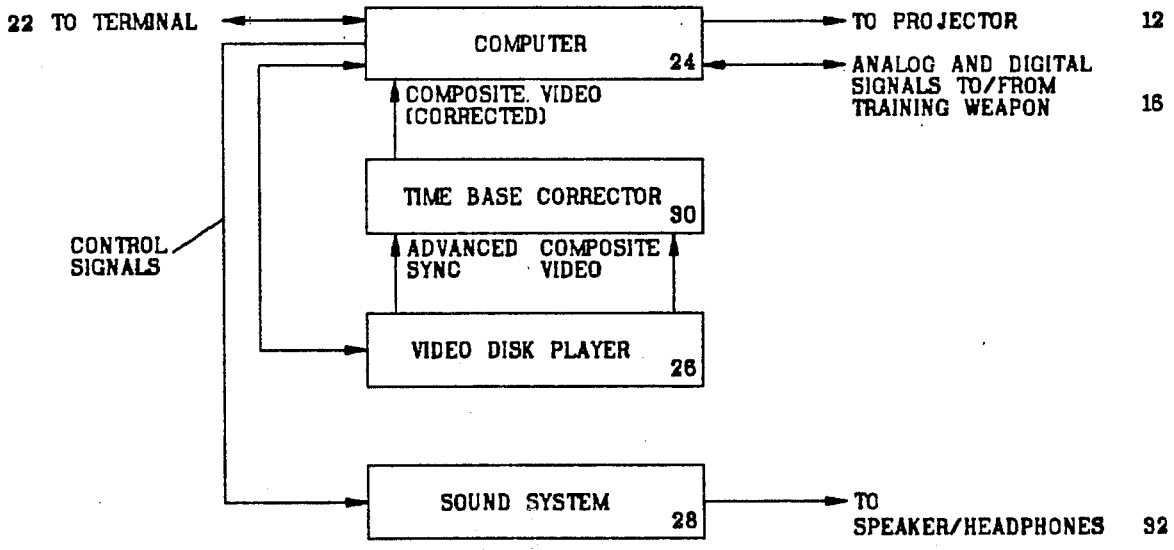
FIG. 2 is a block diagram of the microprocessor of the preferred embodiment.

FIG. 2 shows the contents of computer cabinet 14 to include microcomputer 24 coupled to training weapon 16 and providing image data to projector 12, video disk player 26 responsive to computer 24 for providing frames of prerecorded video, sound system 28 responsive by way of computer 24 to trigger actuation of training weapon 16 and to computed hits/misses. Included is time base corrector 30 that is necessary for purposes of synchronization to overcome the mechanical deviations inherent in video disk players that would cause jitter. It corrects the video data coming from video disk player 26. Also, included in FIG. 2 are speaker or headphones 32 for use to audibilize the output of sound system 28 for the gunner-trainee.

For purposes of the embodiment a training device for the military's MK-19 minor caliber weapon will be used as an example. The MK-19 is a 40 mm machine gun that fires grenades at the rate of 375 rounds per minute. The weapon can saturate an area with lethal fragments so a scoring system that accumulates points as a measure of proximity is most suitable. The effective range of the weapon is 1500 meters, with the round being visible to the gunner during at least part of its trajectory. At a maximum range the time of flight of the round can be 10 seconds, with the round achieving a maximum elevation of 100 meters. The gunner must manually aim the weapon without the assistance of a fire control system. Accordingly, the gunner derives the fire control solutions mentally by taken into account what he sees to be the location of where the fired rounds are falling as well as the portion of their trajectory that is visible to him.

Figure 3:
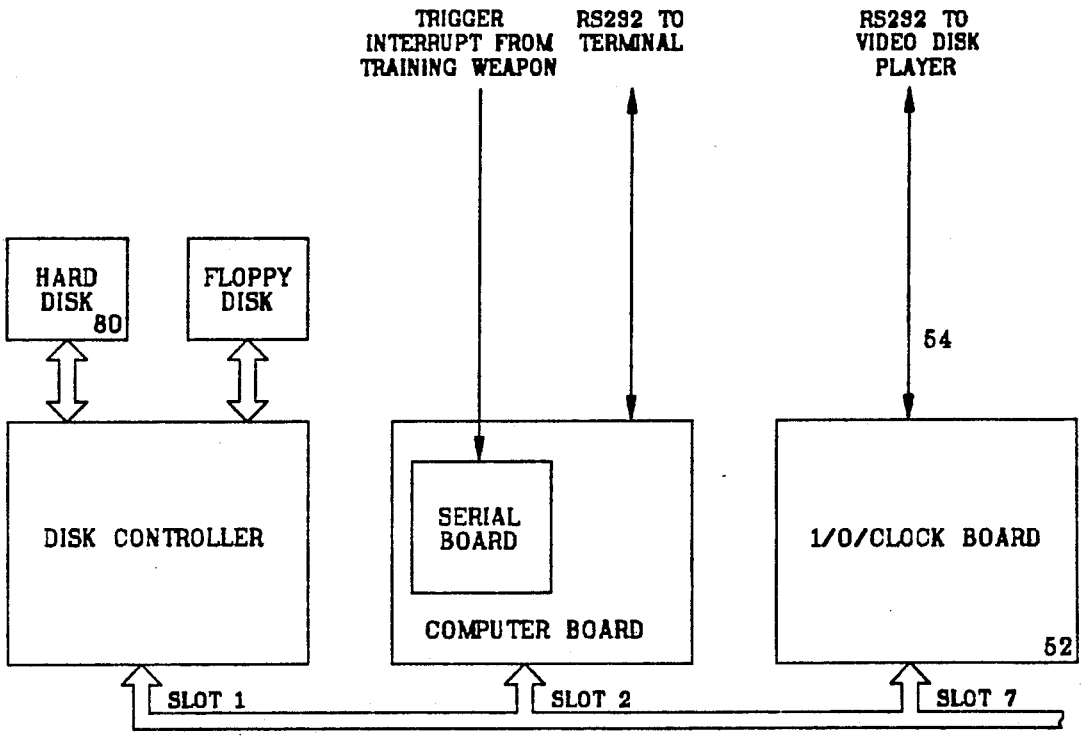
FIGS. 3 and 4 are a block diagram of the computer sub-assemblies.
Figure 4:
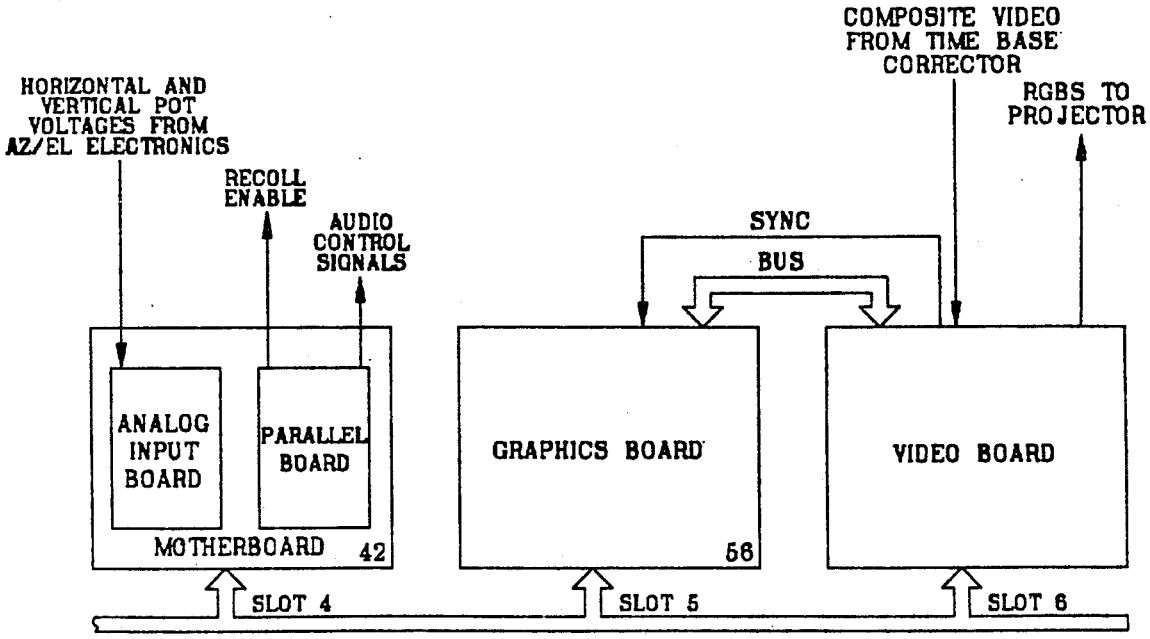

The present invention shows the rounds in flight as they are fired by the gunner's actuation of the weapon's trigger, as well as the impact of the rounds on the water or target. The display is shown on large screen 10 which may be the 72 inch screen used by projection television systems, such as are available from SONY, for example. The system uses computer graphics and video disk technology to simulate the rounds in flight as well as the explosions of rounds hitting the water or target. Target areas are stored on the video disk and can represent various sea states as well as lighting conditions, etc. Explosions and rounds in flight are inserted by a frame buffer on the video scene. Computer 24 may be an INTEL 386 single board computer with a 387 math coprocessor, for example. FIG. 3 and FIG. 4 show sub-assemblies of computer 24 wherein the components are listed by source for a configuration that uses the INTEL computer as the example in an operational embodiment for the MK-19 trainer.

Figure 5:
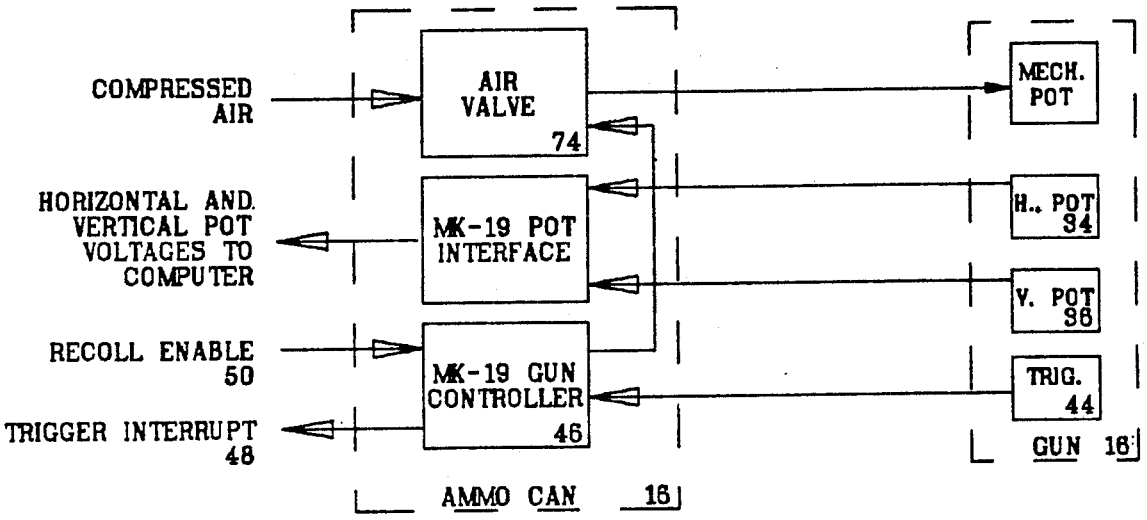
FIG. 5 is a block diagram of the simulated or demilitarized weapon.
Figure 6:
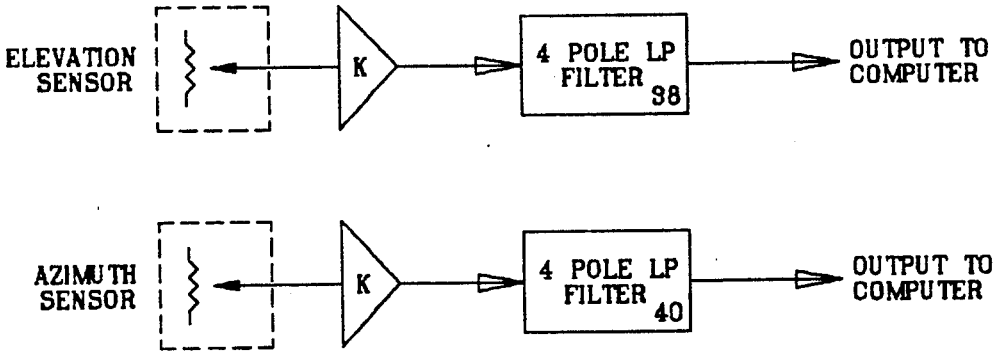
FIG. 6 is a block diagram of the elevation and azimuth sensors attached to the weapon for use in measuring the gunner's aim to compute trajectory.

Training weapon 16 is a simulated or demilitarized weapon and is located for training in front of screen 10. When the gunner fires weapon 16 by actuating its trigger, he feels a recoil enabled by computer 24 and energized by compressor 20. Also, the gunner hears the weapon's report, provided by sound system 28. The elevation and azimuth of the weapon are measured to calculate the trajectory of the round and determine its point of impact. Horizontal and vertical potentiometers 34 and 36, respectively, on the cradle of gun 16 as shown in FIG. 5 provide the values for measuring the position of weapon 16 by elevation and azimuth. Voltages from pots 34 and 36 are filtered as shown in FIG. 6 by four-pole low pass filters 38 and 40, respectively, implemented on the horizontal/vertical potentiometer driver circuit included in electronics package 18. After filtering, the horizontal and vertical position signals are converted to digital values by data translation analog input board 42 on FIG. 4. The horizontal and vertical potentiometer circuit supplies two independent analog signals to computer 24 that correspond to the horizontal position and vertical position of weapon 16. The two channels may be identical. Each channel places the potentiometer between a bipolar dc voltage supply in a voltage divider arrangement. The voltage at the wiper of the potentiometer is coupled to a buffer and voltage scaler to limit the output to a preselected maximum, and filtered. Filters 38 and 40 may be Butterworth filters with a center frequency of 600 Hz. The cut-off frequency is selected to minimize phase delay before the signal is coupled to computer 24.

The computation to describe the flight of the round is performed by computer 24 using a fourth order equation that defines the trajectory associated with the weapon that is being simulated. Likewise, other weapons will have equations that define the trajectory of rounds fired from them. The equation associated with the MK-19 is included in Annex A, which is a source code of the programs prepared for the operational embodiment used in the example. As shown in Annex A at line 371 of the source code, the fourth order equation appropriate for the application of the invention to the MK-19 weapon system is, fprange=(6.987623E-07 times the elevation in mils to the fourth power) minus (3.080162E-04 times the elevation in mils to the third power) plus (3.422262E-02 times the elevation in mils to the second power) plus (5.386276 times the elevation in mils) plus 215.3749. The elevation in mils is translated in lines 364 et seq from the elevation in pixels between y values 150 and 410, with y value 210 denoting that the gun is level. A second fourth order equation that computes the time of flight, is listed at line 373. And, the round is displayed initially at the y value computed at line 376, with a velocity of drop at the value computed at line 377.

Switch 44 in FIG. 5 is operated by actuation of the trigger and is used to control recoil/pulse generator circuit 46 located in ammo canister 18. The circuit both provides an interrupt signal to computer 24 over trigger interrupt connector 48, and allows control of the weapon's recoil mechanism over recoil enable connector 50.

Video disk player 26 is interconnected with computer sub-assembly board 52 and provides target scenarios recorded previously with a video camera, preferably from the same level that the weapon occupies in the operational environment in order to provide a realistic perspective of the target image on replay. Disk player 26 is controlled over interface 54, which for the example is a serial port of computer 24. Each frame of the video is individually digitized for target size, location and range. Computer 24 computes the trajectory of the round fired from weapon 16 by reading the settings on potentiometers 34 and 36 on the gun cradle, and graphics board 56 on FIG. 4 generates the graphics for the round in-flight and the impact explosions. The graphics data is superimposed on the video disk target scene, and the result is displayed by video projector 12.

Figure 7:
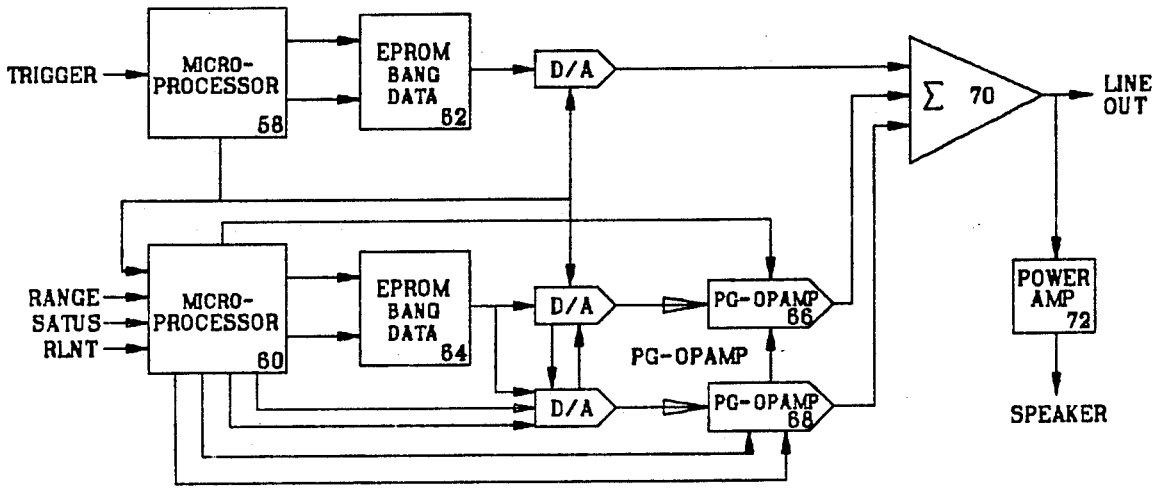
FIG. 7 is a block diagram of the sound system.

FIG. 7 shows sound system 28 that is used to generate sound effects by playing back a digitized recording of the weapons actual muzzle blast, and actual hit and miss explosions. First and second microcontrollers 58 and 60, respectively, reproduce sounds by transferring data stored in eproms 62 and 64, respectively, to converters whereat the data is converted from digital to analog form. First microcontroller 58 generates the sound of the muzzle blast, while microcontroller 60 generates the miss and the hit explosions through program controlled operational amplifiers 66 and 68, respectively. Range and sound delay of the explosions are accounted for in the program. These sound effects may be mixed in summer 70 to create simultaneous sound effects. Power amplifier 72 provides the output to audibilizer 32, such as a speaker or headphones.

The section of sound system 28 that has microcontroller 58 can work independently of the section that has microcontroller 60, but not vice versa. Accordingly, there can be a muzzle blast without an impact, but not an impact explosion without a muzzle blast. The first section, i.e., having microcontroller 58, supplies both an interrupt signal and the digital-to-analog transfer pulse required by the second section. Sound delay is determined by matching the shot's range to predetermined segments, wherein the maximum range for the weapon is divided into multiple segments with each progressively more distant segment having a greater delay.

Figure 8:
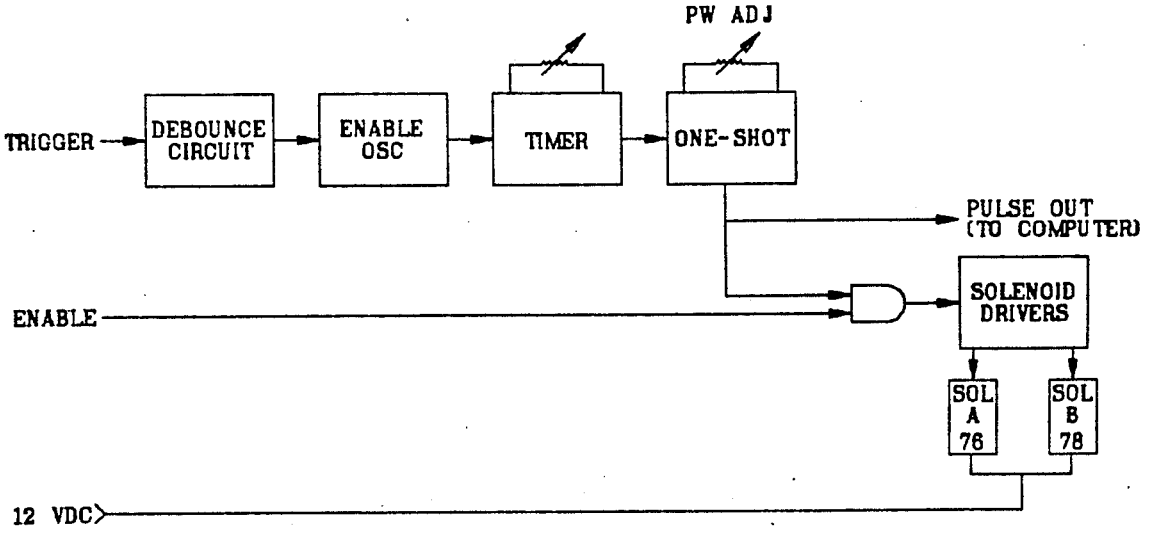
FIG. 8 is a block diagram of the recoil circuit for use in pneumatically simulating recoil in the handles of the simulated weapon.

FIG. 8 shows the recoil circuit. Recoil is caused by moving the handles of weapon 16 with a pneumatic cylinder. Compressed air is provided by compressor 20 and controlled by air valve 74 on FIG. 5. Valve 76 is shown as high speed solenoid valves 76 and 78 on FIG. 8. When trigger 44 is held down in an actuation position the recoil circuit generates a continuous pulse train for both recoil drivers 76 and 78, and computer 24. Trigger switch is debounced and used to control the enable oscillator that may be configured as a monostable multivibrator designed to oscillate at 262 Hz. Its output is coupled to a first one-shot that adjustably divides it to produce the rate required by computer 24. A second one-shot adjustably controls the pulse width of the signal that is being applied to the solenoid drivers. In return an enable signal is generated by computer 24 to disable the recoil signal, although the interrupt signal will continue to be received as trigger 44 is held down. Also, the enable signal is applied to sound system 28 to indicate status.

The software of Annex A was written using INTEL's PLM-286 compiler under the iRMX 286 operating system. The high level language and real-time capabilities of the operating system permits expeditious development of the application software. The ballistic characteristics of the round are used to determine the ballistic model for the weapon. The model is used to calculate a solution for the projection of the round in flight. Using this information graphical rounds and explosions are superimposed over the video disk image giving the gunner a visually correct perspective. Graphical sequences of hit and miss explosions are stored in the display buffer of computer 24 for block transfer during program execution. These images are loaded from hard disk 80 during initialization of the program. The graphics are updated at the frame rate of video disk player 26 using a double buffer technique.

The data on the video disk may be separated into numerous sequences, which in the case of the operational example was 35 scenarios. Each scenario shows a different range, speed attitude of direction of the target. The target was a boat. Ranges varied between 75 meters and 700 meters with boat speeds from stop to 35 miles per hour. Different training sessions are available from the scenarios, such as a session of lateral moving targets displayed in a random order. Files that describe the outline and range of the target for each frame of the scenario are stored on hard disk 80. Before a scenario is played the description file is loaded into memory for fast access by the program. Target hits are determined by comparing current impact location with target location for the current frame.

At the end of the training session a complete gunner assessment may be printed on screen 10. Gunner performance is determined by averaging the number of rounds the gunner takes to destroy the target over the scenario. A target is destroyed or disabled if a preselected point total is exceeded. Points are accumulated by proximity to the target. Each impact within 60 meters is given a value, an impact within 15 meters is given a greater value, and so on. For example, according to the program of Annex A the operator's menu provides flexibility to the scoring system and performance rating by offering several setup parameters. The instructor can selectively activate from the menu each scoring distance through a skill level parameter. A skill level 1 activates only the 5 meter impact distance, a skill level 2 activates both 5 meter and 15 meter impact distances, and a skill level 3 activates the greatest number of impact distances. The manner of measuring performance by tallying the average number of rounds per target destroyed, also can be varied for each rating classification. Once the parameters are selected they may be saved as system startup parameters, which permits the instructor to configure the system as desired.

From the foregoing description, it may readily be seen that the present invention comprises a new, unique, and exceedingly useful weapons trainer that constitutes a considerable improvement over the prior art. Obviously, many modifications and variations of the present invention are possible in light of the above teachings. Therefore, it is to be understood that within the scope of the appended claims the present invention may be practiced otherwise than as specifically described.

PROCESSOR 1: BANG CONTROL AND TIMING CONTROL FOR PROCESSOR 2

07/445803

SYNCHRONIZED TO THE TRIGGER ON THE MK-19. WHEN THE TRIGGER IS DEPRESSED A PULSE TRAIN IS GENERATED BY THE RECOIL BOARD. THIS PULSE HAS A WIDTH OF APPROXIMATELY 25MS AND A FREQUENCY OF 6HZ (167MS). THE PULSE TRAIN INTERRUPTS THE PROCESSOR ON THE LEADING EDGE OF THE PULSE VIA PIN 12 (INT0). ONCE AN INTERRUPT REQUEST IS MADE THE PROCESSOR BEGINS TO READ OUT THE DIGITAL DATA FROM THE EPROM AT ADDRESS 0000H AND CONTROLS THE TIMING SIGNALS ON THE D/A CONVERTER. THE ANALOG SIGNAL IS SENT TO A SUMMING NETWORK TO BE SUMED WITH THE HIT AND MISS SOUND AFFECTS. THE HIT AND MISS SOUND AFFECTS AS WELL AS PROPAGATION DELAY ARE CONTROLLED BY PROCESSOR 2.

PROCESSOR 2: HIT AND MISS SOUND AFFECTS WITH DIGITALLY CONTROLLED VOLUME AND PROPOGATION DELAY

SYNCHRONIZED TO PROCESSOR 1 VIA THE XFER PULSE (T0). THE XFER PULSE CONTROLS BOTH THE COUNTER USED FOR PROPOGATION DELAY CALCULATIONS AND THE SYNCHRONOUS TRANSFER OF DATA TO THE D/A CONVERTERS AND THUS THE SUMMING NETWORK. INPUTS TO PROCCESOR 2 INCLUDE 3 BITS FOR RANGE/VOLUME, 1 BIT FOR HIT-MISS STATUS, AND 1 BIT FOR A RANGE INTERRUPT REQUEST. UPON RECEIVING A RANGE INTERRUPT REQUEST, PROCESSOR 2 WILL READ THE APPROPRIATE 3 BITS FOR RANGE AND VOLUME. THE PROCESSOR WILL NEXT READ THE HIT/MISS STATUS AND DETERMINE WHICH DATA IS TO BE READ OUT OF THE EPROM AND SUBSEQUENTLY CONVERTED TO AN ANALOG SIGNAL FOR THE SUMMING NETWORK. DUE TO THE OVERLAPPING OF SOUND AFFECTS THE PROCESSOR WILL ALWAYS SUBSTITUTE THE CURRENT HIT/MISS SOUND AFFECT WITH THE LOUDEST HIT/MISS SOUND AFFECT REGARDLESS OF ITS DURATION. IN THE FOLLOWING EXAMPLE ASSUME THE VOLUME SCALE GOES FROM 0 TO 7 AND THAT THE TIME LEFT ON THE SOUND AFFECT GOES FROM 1 TO 500 MSEC.

| | | | |
|---|---|---|---|
| SOUND A | HIT | VOLUME 7 | TIME LEFT = CURRENT |
| SOUND B | HIT | VOLUME 4 | TIME LEFT = 380 MSEC |
| SOUND C | MISS | VOLUME 4 | TIME LEFT = CURRENT |
| SOUND D | MISS | VOLUME 7 | TIME LEFT = 5 MSEC |

HIT:

IF SOUND B IS CURRENTLY BEING CONVERTED AND THEN SOUND A IS PROCESSED SOUND A WILL OVERRIDE SOUND B DUE TO THE VOLUME LEVEL EVEN THOUGH SOUND B HAS NOT YET TIMED OUT.

MISS:

IF SOUND D IS CURRENTLY BEING CONVERTED AND THEN SOUND C IS PROCESSED SOUND D WILL CONTINUE TO CONVERT SINCE ITS VOLUME LEVEL IS HIGHER EVEN THOUGH IT IS JUST ABOUT TO TIME OUT.

THE HIT AND MISS SOUND AFFECTS ARE CONVERTED SEPERATELY YET SYNCHRONOUSLY. THEREFORE THE SUMMING NETWORK CAN SEE UP TO THREE SIGNAL OCCURING SIMULTANEOUSLY.

I hereby certify that this correspondence is being deposited with the U.S. Postal Service as first class mail in an envelope addressed to: Commissioner of Patents and Trademarks, Washington, D.C. 20231 on 11/29/89.

11/29/89

Signature of Attorney of Record Date

#B10541156W

INPUT VARIABLES:

| | | |
|---|---|---|
| RINTG - RECOIL PULSE (UP1 INT0) | | RECOIL GENERATOR BOARD |
| RINT - RANGE INTERRUPT (UP2 AND INT1) | | SYSTEM COMPUTER |
| R0 - | | |
| R1 - 3 BIT CODE TO DEFINE RANGE OF | | SYSTEM COMPUTER |
| R2 - PROJECTILE AS IT HITS THE EARTH | | |
| ST - ROUND STATUS (UP2) HIT(1), MISS(0) | | SYSTEM COMPUTER |

OUTPUT VARIALBLES:

| | |
|---|---|
| XFER - LATCH FOR D/A CONVERTER | (UP1) |
| AND STROBE FOR T0 (UP2) | (UP1) |
| WR2 - 2ND BUFFER D/A CONVERTER | (UP1 AND UP2) |
| WR1 - 1ST BUFFER D/A CONVERTER | (UP1 AND UP2) |
| OE - OUTPUT ENABLE OF EPROM | (UP1 AND UP2) |
| HDAC - CHIP SELECT FOR HIT D/A CONVERTER | (UP2) |
| MDAC - CHIP SELECT FOR MISS D/A CONVERTER | (UP2) |
| VOL1 - | |
| VOL2 - 3 BIT DATA TO CONTROL VOLUME ON | (UP2) |
| VOL3 - PROGRAMMABLE OPA'S | (PGOPA 1 AND PGOPA 2) |
| HVOL - LATCH FOR HIT VOLUME | (UP2) |
| MVOL - LATCH FOR MISS VOLUME | (UP2) |

```
RTCS/UDI V5.1 - MCS-51 MACRO ASSEMBLER, V2.2
OBJECT MODULE PLACED IN JOBS\SOUND.OBJ
ASSEMBLER INVOKED BY:  ASM51 JOBS\SOUND.001

LOC  OBJ          LINE    SOURCE

                    1     ;##################################################################
                    2     ;* This program will generate both the hit and miss sound affects
                    3     ;* with digitally controlled volume and propagation delay. The hit and
                    4     ;* and miss data is stored in one EPROM (IC4). The data will be converted
                    5     ;* to an analog signal using two D/A converters and then summed with the
                    6     ;* bang from the gun shot sound to generate three simultaneous sounds.
                    7     ;* The sampling rate gen%rated by uP1 and thus uP2 is 6khz.
                    8     ;##################################################################
                    9
                   10
                   11
                   12
                   13
                   14     ; Output pin declarations
                   15
 0080              16     wr1          bit          p0.0     ;dac write 1 (low)
 0081              17     wr2          bit          p0.1     ;dac write 2 (low)
 0082              18     mdac         bit          p0.2     ;cs for miss data
 0083              19     hdac         bit          p0.3     ;cs for hit data
                   20
 00B1              21     mvol         bit          p3.1     ;clk for miss pgopa
 00A7              22     hvol         bit          p2.7     ;clk for hit pgopa
 00B0              23     oe           bit          p3.0     ;output enable for eprom
                   24
                   25     ;##################################################################
                   26
 ----              27                  bs%g at 24h
                   28
 0024              29     hit:         dbit         1        ;current hit
 025               30     miss:        dbit         1        ;current miss
                   31
                   32     ;##################################################################
                   33
 ----              34                  dseg at 26h
                   35
 0026              36     ran_st:      ds           16       ;res 16 bytes for range/status
                   37                                        ; [ st-r2-r1-r0-x-x-x-x ]
 0036              38     en:          ds           16       ;res 16 bytes for ro%nd enable
 0046              39     cll:         ds           16       ;res 16 bytes for cll clk (th0)
 0056              40     delay:       ds           16       ;res 16 bytes for mod delay data
                   41                                        ;mod delay = cll(i) + delay
 0066              42     vol:         ds           16       ;res 16 bytes for vol data
                   43                                        ;  [ 0-0-0-0-0-r"-r1-r0 ]
 0076              44     curh:        ds           1        ;res 1 byte for current hit volume
 0077              45     curm:        ds           1        ;res 1 byte for current miss volume
 0078              46     loop_count:  ds           1        ;res 1 byte for loop counter
 0079              47     h hi:        ds           1        ;res 1 byte for upper hit pointer
```

```
LOC  OB
          LINE   SOURCE

007A              h_low:        ds          1        ;res 1 byte for lower hit pointer
007B              m_hi:         ds          1        ;res 1 byte for upper miss pointer
007C              m_low:        ds          1        ;res 1 byte for lower miss pointer

                  ;*****************************************************************

                          cseg at 0000h

0000 020030               jmp init

                  ;*****************************************************************
                  ;                    INTERRUPT ROUTINES
                  ;*****************************************************************

0003                      org 3h          ;interrupt vector for external request 0
                                          ;interrupt occurs as a result of up1
                                          ;generating a data xfer signal to the
                                          ;d/a converters
                                          ;highest priority

0003  20122               jmp xfer_int    ;service routine

                  ;*****************************************************************

                  ;*****************************************************************

0013                      org 13h         ;interrupt vector for external request 1
                                          ;interrupt occurs as a result of the system
                                          ;signaling uP2 that it is ready to supply
                                          ;range and status information

0013 0200EA               jmp ran_int     ;service routine
                  ;*****************************************************************

0030                      org 30h

0030 C224         init:   clr hit                   ;hit status bit
0032 C225                 clr miss                  ;miss status bit
0034 757600               mov curh,#0h              ;current hit volume level
0037 757700               mov curm,#0h              ;current miss volume level
003A 757900               mov h_hi,#0h              ;inital value of hit data
003D 757A00               mov h_low,#0h             ;0000h
0040 757B30               mov m_hi,#30h             ;initial value of miss data
0043 757C00               mov m_low,#0h             ;3000h
0046 757B00               mov loop_count,#0h        ;clear loop counter

0049 C280                 clr wr1                   ;enable d/a latch 1
004B C281                 clr wr2                   ;enable d/a latch 2
004D D282                 setb mdac                 ;cs - disable d/a converter IC6
004F D283                 setb hdac                 ;cs - disable d/a converter IC7
0051 D2B1                 setb mvol                 ;disable clk bit on PGOPA IC10
0053 D2A7                 setb hvol                 ;disable clk bit on PGOPA IC11

0055 758905               mov tmod,#05h             ;16 bit counter - T0
0058 758805               mov tcon,#05h             ;interrupt 0 and 1, falling edge
                                                    ;counter off
005B 75A885               mov ie,#85h               ;global enable / interrupt 0 and 1 /
005E 75B801               mov ip,#01h               ;external interrupt 0 high priority

0061 53B01F               anl p3,#00011111b         ;set up pgopa with a gain of 1
0064 C2A7                 clr hvol
0066 00                   nop
0067 D2A7                 setb hvol

0069 43B01F               orl p3,#00011111b         ;set up input pins

006C C2B1                 clr mvol
006E 00                   nop
006F D2B1                 setb mvol

0071 7826                 mov r0,#ran_st            ;fill buffer with 0h data
0073 7600         fill:   mov @r0,#0h
0075 08                   inc r0
0076 B877FA               cjne r0,#77h,fill

0079 D28C                 setb tr0                  ;enable counter 0
007B 7F00                 mov r7,#0h                ;set up r7 as a loop counter
```

```
LOC  OBJ          LINE  SOURCE

                  133
                  134
                  135   ;******************** BEGIN MAIN LOOP ********************************
                  136
007D BF1002       137   main:     cjne r7,#10h,loop        ;test loop for end of buffer
0080 7F00         138             mov r7,#0h               ;if end of loop reset to zero
0082 7436         139   loop:     mov a,#en
0084 2F           140             add a,r7
0085 F8           141             mov r0,a
0086 FE           142             mov r6,a                 ;save address of en(i)
                  143
0087 E6           144             mov a,@r0                ;data at en(i)
0088 B4FF5C       145             cjne a,#0ffh,next        ;test if en(i) is set
                  146
008B 7456         147             mov a,#delay             ;get mod delay
008D 2F           148             add a,r7
008E F8           149             mov r0,a
008F E6           150             mov a,@r0                ;a = mod delay
                  151
0090 B58C54       152             cjne a,th0,next          ;compare current counter value to
                  153                                      ;modified delay
                  154
0093 EE           155             mov a,r6                 ;r6 holds address of en(i)
0094 F8           156             mov r0,a
0095 A600         157             mov @r0,0h               ;clear en(i) if timer has timed out.
                  158
0097 7426         159             mov a,#ran_st
0099 2F           160             add a,r7
009A F8           161             mov r0,a
009B E6           162             mov a,@r0
009C C4           163             swap a
009D 20E326       164             jb acc.3,hit_st          ;check status bit, if set then hit
                  165
                  166   ;*****************************************************************
                  167   ;*              hit status bit is cleared                        *
                  168   ;*****************************************************************
                  169
00A0 5407         170             anl a,#00000111b         ;vol information (mask off status bit)
00A2 C3           171             clr c
00A3 FE           172             mov r6,a                 ;save vol data
00A4 9577         173             subb a,curm              ;test if current vol is > curm
00A6 EE           174             mov a,r6
00A7 403E         175             jc next
00A9 603C         176             jz next
00AB 757B30       177             mov m_hi,#30h            ;if yes reset pointer and curm
00AE 757C00       178             mov m_low,#00h
00B1 F577         179             mov curm,a
                  180
00B3 C4           181             swap a
00B4 23           182             rl a
00B5 54E0         183             anl a,#11100000b         ;acc contains 3-bit code
00B7 53B01F       184             anl p3,#00011111b        ;clear lower 5 bits of acc
                  185                                      ;set data bits to 0
00BA 42B0         186             orl p3,a                 ;output data
                  187
00BC C2B1         188             clr mvol
00BE 00           189             nop
00BF D2B1         190             setb mvol
00C1 D225         191             setb miss
00C3 0200E7       192             jmp next
                  193
                  194
                  195   ;*****************************************************************
                  196   ;*              hit status bit is set                            *
                  197   ;*****************************************************************
                  198   hit_st:
00C6 5407         199             anl a,#00000111b         ;vol information
00C8 C3           200             clr c
00C9 FE           201             mov r6,a                 ;save vol data in reg r6
00CA 9576         202             subb a,curh              ;test if current vol in a is > curh
00CC EE           203             mov a,r6                 ;r6 holds current vol
00CD 4018         204             jc next                  ;carry is set iff curh > vol
                  205                                      ;if c set then continue with current
                  206                                      ;sound otherwise get new sound
                  207                                      ;if yes reset pointer and curh
00CF 757900       208             mov h_hi,#00h
00D2 757A00       209             mov h_low,#00h
00D5 F576         210             mov curh,a
                  211
00D7 C4           212             swap a
00D8 23           213             rl a
00D9 54E0         214             anl a,#11100000b         ;acc contains 3-bit code
00DB 53B01F       215             anl p3,#00011111b        ;clear lower 5 bits of acc.
```

```
LOC  OBJ          LINE  SOURCE

                   216                                  ;set data bits to 0
00DE 42B0          217          orl p3,a                ;output data
                   218
00E0 C2A7          219          clr hvol
00E2 00            220          nop
00E3 D2A7          221          setb hvol
00E5 D224          222          setb hit
                   223
                   224
00E7 0F            225  next:   inc r7
00E8 8093          226          jmp main                ;loop through main again
                   227
                   228
                   229  ;*****************************************************************
                   230  ;                    SUBROUTINES
                   231  ;*****************************************************************
                   232
                   233
                   234
                   235  ;*****************************************************************
                   236  ; THIS INTERRUPT ROUTINE WILL CORRUPT REGISTERS R1 AND R2 AND THE DPTR
                   237  ; THE ACC IS SAVED ON THE STACK
                   238  ; LOOP COUNT IS USED AS THE LOOP COUNTER
                   239  ; RUN TIME IS APPROXIMATELY 60usec
                   240  ;*****************************************************************
                   241
00EA C0E0          242  ran_int: push acc
                   243
00EC 7426          244          mov a,#ran_st           ;acc holds the address of ran_st
00EE 2578          245          add a,loop_count        ;create offset
00F0 F9            246          mov r1,a
00F1 4380F0        247          orl p0,#11110000b       ;set upper 4 bits as inputs
00F4 A780          248          mov @r1,p0              ;read ran_st(i)
                   249
00F6 2410          250          add a,#16d              ;create offset for buffer
00FB F9            251          mov r1,a
00F9 77FF          252          mov @r1,#0ffh           ;set en(i)
                   253
00FB 2410          254          add a,#16d              ;create offset for buffer
00FD F9            255          mov r1,a
00FE A78C          256          mov @r1,th0             ;read cll(i)
                   257
                   258
0100 4380F0        259          orl p0,#11110000b       ;set upper 4 bits as inputs
0103 E580          260          mov a,p0                ;read ran_st from port 0
0105 C4            261          swap a
0106 5407          262          anl a,#00000111b        ;acc holds offset into table
0108 90019F        263          mov dptr,#del_table     ;dptr points to del_table
010B 93            264          movc a,@a+dptr          ;acc now holds adjusted delay
010C 27            265          add a,@r1               ;adjusted delay cll(i) + delay
010D FA            266          mov r2,a                ;r2(i) = cll(i) + delay(i)
010E 7456          267          mov a,#delay
0110 2578          268          add a,loop_count
0112 F9            269          mov r1,a                ;a holds address of delay(i)
0113 EA            270          mov a,r2                ;r2 holds delay

) is now stored as delay(i)                    ***************************************************

ement loop_count                               t                   ;test for active hit
                                                                   ;incr dptr to work
 loop_count for end of buff                                        ;on hit data

t loop_count

                                                                   ;save hit pointer

                                               hit_dac             ;check if hit data is over
                                               hit_dac

*************************                                          ;reset current hit volume
                                                                   ;reset upper hit pointer
                                               h                   ;reset lower hit pointer
 BEFORE                                                            ;reset hit bit

 *************************
                                                                   ;lower pointer for hit data

                                                                   ;guarantee hvol is set
                                                                   ;upper pointer for hit data

 for active miss
 dptr to work                                                      ;setup and latch hit data
 ss data                                                           ;in hit d/a converter
                                                                   ;and wait for next xfer pulse
```

```
LOC  OBJ          LINE  SOURCE

miss pointer

 if miss data is over

 current miss volume
 upper miss pointer
 lower miss pointer

 miss bit                                          ##################################################
                                                   r sound delay based on range
                                                   ##################################################

 pointer for miss data                             speed of sound and the sampling rate used to clock
 ntee hvol is set                                  ng rate is 6khz or 167usec between counter events.
 pointer for miss data                             the furthest range and thus the lowest volume.
                                                   the closest range and thus the loudest volume.
 and latch miss data
 is d/a converter                                  the 16bit counter will be evaluated for delay.
 ait for next xfer pulse                           aximum error of 40msec.
                                                   counts. Maximum delay: 65536*167usec = 10.94 sec
                                                   4970 or 3a7ah --> (3ah - 1) = 2fh for upper byte

                 381
                 382     del_table:   db   42h     ;range 896-1023m    2.89s
019F 42          383                  db   39h     ;range 768-895m     2.50s
01A0 39          384                  db   30h     ;range 640-767m     2.12s
01A1 30          385                  db   27h     ;range 512-639m     1.73s
01A2 27          386                  db   1dh     ;range 384-511m     1.35s
01A3 1D          387                  db   15h     ;range 256-383m     962mesc
01A4 15          388                  db   0ch     ;range 128-255m     577msec
01A5 0C          389                  db   03h     ;range 0-127m       191msec
01A6 03          390
                 391     end
```

SYMBOL TABLE LISTING

| NAME | TYPE | VALUE | ATTRIBUTES |
|---|---|---|---|
| ACC. . . . | D ADDR | 00E0H | A |
| CLL. . . . | D ADDR | 0046H | A |
| CURH . . . | D ADDR | 0076H | A |
| CURM . . . | D ADDR | 0077H | A |
| DEL_TABLE. | C ADDR | 019FH | A |
| DELAY. . . | D ADDR | 0056H | A |
| DPH. . . . | D ADDR | 0083H | A |
| DPL. . . . | D ADDR | 0082H | A |
| EN . . . . | D ADDR | 0036H | A |
| FILL . . . | C ADDR | 0073H | A |
| H_HI . . . | D ADDR | 0079H | A |
| H_LOW. . . | D ADDR | 007AH | A |
| HDAC . . . | B ADDR | 0080H.3 | A |
| HIT_DAC. . | C ADDR | 0185H | A |
| HIT_ST . . | C ADDR | 00C6H | A |
| HIT. . . . | B ADDR | 0024H.4 | A |
| HVOL . . . | B ADDR | 00A0H.7 | A |
| IE . . . . | D ADDR | 00A8H | A |
| INIT . . . | C ADDR | 0030H | A |
| IP . . . . | D ADDR | 00B8H | A |
| LOOP_COUNT | D ADDR | 0078H | A |
| LOOP . . . | C ADDR | 0082H | A |
| M_HI . . . | D ADDR | 007BH | A |
| M_LOW. . . | D ADDR | 007CH | A |
| MAIN . . . | C ADDR | 007DH | A |
| MDAC . . . | B ADDR | 0080H.2 | A |
| MISS_DAC . | C ADDR | 014DH | A |
| MISS . . . | B ADDR | 0024H.5 | A |
| MVOL . . . | B ADDR | 00B0H.1 | A |
| NEXT . . . | C ADDR | 00E7H | A |
| NO_HIT . . | C ADDR | 0198H | A |
| NO_MISS. . | C ADDR | 0160H | A |
| OE . . . . | B ADDR | 00B0H.0 | A |
| OUT1 . . . | C ADDR | 011CH | A |
| OUT2 . . . | C ADDR | 011FH | A |
| P0 . . . . | D ADDR | 0080H | A |
| P1 . . . . | D ADDR | 0090H | A |

```
NAME     TYPE  VALUE     ATTRIBUTES

P2 . . . .  D ADDR   00A0H   A
P3 . . . .  D ADDR   00B0H   A
RAN_INT. .  C ADDR   00EAH   A
RAN_ST . .  D ADDR   0026H   A
TCON . . .  D ADDR   0088H   A
TH0. . . .  D ADDR   008CH   A
TMOD . . .  D ADDR   0089H   A
TR0. . . .  B ADDR   0088H.4 A
VOL. . . .  D ADDR   0066H   A
WR1. . . .  B ADDR   0080H.0 A
WR2. . . .  B ADDR   0080H.1 A
XFER_INT .  C ADDR   0122H   A

REGISTER BANK(S) USED: 0

ASSEMBLY COMPLETE, NO ERRORS FOUND


iRMX 286 R2.0 PL/M-286 V2.5 COMPILATION OF MODULE MK19
NO OBJECT MODULE REQUESTED
COMPILER INVOKED BY:  :LANG:PLM286 MCAT.002 NOOBJECT PAGELENGTH(86)


                $debug optimize(3)

  1             mk19: do;

                $include (:LIB:literal.inc)
            =   $nolist
                $include (:LIB:sys_calls.inc)
            =   $nolist
                $include (:LIB:serialio.inc)
            =   $nolist
                $include (:LIB:parallax.inc)
            =   $nolist
                $include (:LIB:vdisk.inc)
            =   $nolist
                $include (:LIB:sbx351.inc)
234   1     =   setup_sbx351_clock: procedure external;
235   2     =   end setup_sbx351_clock;

236   1     =   read_sbx351_clock: procedure word external;
237   2     =   end read_sbx351_clock;

238   1     =   read_sbx351_clk1: procedure word external;
239   2     =   end read_sbx351_clk1;
                $include (gunalign.inc)


            =   /* global variable used for reading and boresighting mk19 */
240   1     =   declare          xval     word   external,
            =                    yval     word   external,
            =                    xrel     real   external,
            =                    yrel     real   external,
            =                    xout     word   external,
            =                    yout     word   external,
            =                    xscale   real   external,
            =                    yscale   real   external,
            =                    xoff     real   external,
            =                    yoff     real   external;

            =   $nolist

                /**********EXTERNAL SUBROUTINES ***********************************************/
251   1         start: procedure external;
252   2         end;

253   1         explosion_blocks: procedure external;
254   2         end;

255   1         restore_explosions: procedure external;
256   2         end;

257   1         hit_blocks: procedure external;
258   2         end;

259   1         restore_hits: procedure external;
260   2         end;

261   1         n*sc_logo: procedure external;
262   2         e ;

263   1         menu_select: procedure word external;
264   2         end;

                /*****************************************************************************/
                /******PUBLIC VARIABLE DECLARATIONS ***************************************/
```

```
265  1    declare  rnd(48)  structure ( flag      byte,
                                        cnt       byte,
                                        exptype   word,
                                        range     word,
                                        t_start   word,
                                        x         integer,
                                        y_start   integer,
                                        v_fall    real,
                                        y_strike  integer,
                                        age       word)    public;

266  1    declare  count       word public,
                  ammoflag    byte public,
                  autoreload  byte public,
                  pause       byte public,
                  ping_flag   byte public,
                  porta       byte public,
                  w200flag    byte public,
                  w75flag     byte public,
                  w75cnt      word public,
                  dead        byte public;

267  1    declare  seqbuff(20) byte public,
                  seqstop     byte public,
                  hit_level   byte public,
                  total_kills word public,
                  total_hurts word public,
                  total_rnds  word public,
                  within5m    word public,
                  within15m   word public,
                  within60m   word public,
                  w60mpnts    word public,
                  w15mpnts    word public,
                  w5mpnts     word public,
                  exp_gun     word public,
                  gun_agun    word public,
                  agun_bgun   word public;

          /****************** local declarations ********************************/
268  1    declare  table(500) structure ( range     word,
                                          exptype   word,
                                          y_start   integer,
                                          v_fall    real,
                                          y_strike  integer,
                                          clktime   word);

269  1    declare    status      word,
                    done        byte,
                    key_on      word data (116H),
                    key_off     word data (16H),
                    preset      word data (2DH);

          /********** SBX350 PORT CONTROL (RECOIL ENABLE SIGNAL) **********************/

270  1    declare    sbx350_control      lit   '5046H',
                    sbx350_porta        lit   '5040H';

271  1    setup_sbx350: procedure;
272  2         output(sbx350_control) = 80H;
273  2         porta = 10000001b;                /* disable recoil / all other i/o high */
274  2         output(sbx350_porta) = porta;
275  2    end setup_sbx350;

276  1    recoil_on: procedure public;
277  2         porta = porta and 01111110b;
278  2         output(sbx350_porta) = porta;
279  2    end recoil_on;

280  1    recoil_off: procedure public;
281  2         porta = porta or 10000001b;
282  2         output(sbx350_porta) = porta;
283       end recoil_off;

          /**********TRIGGER INTERRUPT ROUTINE ********************************/

284  1    declare    trig_int_level    word   data  (0000000001110010B);

285  1    trig_task: procedure;

286  2               declare   dataptr     pointer,
                               ds         token,
                               xyscrn     dword,
                               xscrn      word,
                               yscrn      word,
                               xdesp      word,
                               ydesp      word;

287  2               dataptr = @dataptr;
288  2               ds = selector$of(dataptr);
289  2               call write_ln(@('set interrupt',cr,lf),15);
290  2               call rq$set$interrupt (trig_int_level, 255,
                                            @trig_int_service, ds, @status);

29_  2               do forever;
```

```
292  3                call rq$wait$interrupt(trig_int_level, @status);
293  3                call rq$disable(trig_int_level, @status);
294  3                if not ammoflag then call recoil_off;
296  3                else do;
297  4                  rnd(count).t_start = read_sbx351_clock;
298  4                  xyscrn = xy_screen;
299  4                  xscrn = high(xyscrn);
300  4                  yscrn = low(xyscrn);
301  4                  xdesp = unsign(fix(2.0 * random));
302  4                  ydesp = unsign(fix(3.0 * random));
303  4                  if xdesp = 0 then xscrn = xscrn - 1;
305  4                  else if xdesp = 2 then xscrn = xscrn + 1;
307  4                  if ydesp = 0 then yscrn = yscrn - 2;
309  4                  else if ydesp = 1 then yscrn = yscrn - 1;
311  4                  else if ydesp = 3 then yscrn = yscrn + 1;
313  4                  if yscrn < 153 then do;
315  5                    w75flag = true;
316  5                    w75cnt = w75cnt + 1;
317  5                    if w75cnt > 2 then dead = true;
319  5                    end;
320  4                  else if yscrn < 204 then w200flag = true;

322  4                  if yscrn < 153 then yscrn = 153;
324  4                  if yscrn > 410 then yscrn = 410;
326  4                  rnd(count).flag = 2;
327  4                  rnd(count).range = table(yscrn).range;
328  4                  rnd(count).exptype  = table(yscrn).exptype;
329  4                  rnd(count).y_start = table(yscrn).y_start;
330  4                  rnd(count).age = table(yscrn).clktime;
331  4                  rnd(count).v_fall = table(yscrn).v_fall;
332  4                  rnd(count).y_strike = table(yscrn).y_strike;
333  4                  rnd(count).x = signed(xscrn);
334  4                  count = count + 1;
335  4                  if count > 47 then do;
337  5                    ammoflag = false;
338  5                    end;
339  4                  end;
340  3                call rq$enable(trig_int_level, @status);
341  3                end;
342  2      end trig_task;

343  1      trig_int_service: procedure interrupt public;
344  2             call rq$signal$interrupt(trig_int_level, @status);
345  2      end trig_int_service;

346  1      setup_trig_int: procedure;

347  2             declare    t_task      token,
                              priority    byte,
                              startaddr   pointer,
                              dataseg     token,
                              garbpointer pointer,
                              stackptr    pointer,
                              stack_size  word,
                              taskflags   word,
                              status      word,
                              stat        byte;

348  2             call dtx311_reset;
349  2             call dtx311_reset;
350  2             call dtx311_reset;
351  2             priority = 122;
352  2             startaddr = @trig_task;
353  2             garbpointer = @garbpointer;
354  2             dataseg = selector$of(garbpointer);
355  2             taskflags = 1;
356  2             stackptr = nil;
357  2             stack_size = 512;
358  2             t_task = rq$create$task     (priority,
                                                startaddr,
                                                dataseg,
                                                stackptr,
                                                stack_size,
                                                taskflags,
                                                @status);
359  2             call time(10000);
360  2             count = 0;
361  2      end setup_trig_int;

       /*****************************************************************************/

362  1      set_table: procedure;
363  2                 declare  ypixel          integer,
                                elev_pixels     integer,
                                elev_mils       real,
                                elev_mils_p2    real,
                                elev_mils_p3    real,
                                elev_mils_p4    real,
                                fprange         real,
                                wrange          word,
                                fptime          real,
                                y_hit           real,
                                y_init          real,
                                v_drop          real,
                                clktime         word;
```

```
364  2          call clear_screen;
365  2          do ypixel = 150 TO 410;
366  3            elev_pixels = ypixel - 210;
367  3            elev_mils = float(elev_pixels) * 0.7073;
368  3            elev_mils_p2 = elev_mils * elev_mils;
369  3            elev_mils_p3 = elev_mils_p2 * elev_mils;
370  3            elev_mils_p4 = elev_mils_p3 * elev_mils;

371  3            fprange =  6.987623E-07 * elev_mils_p4
                           -3.080162E-04 * elev_mils_p3
                           +3.422262E-02 * elev_mils_p2
                           +5.386276 * elev_mils
                           +215.3749;
372  3            wrange = unsign(fix(fprange));

373  3            fptime =  2.517161E-09 * elev_mils_p4
                          -1.26342E-06 * elev_mils_p3
                          +2.046123E-04 * elev_mils_p2
                          +0.0259157 * elev_mils
                          +0.93911422;

374  3            clktime = unsign(fix(fptime * 60.0));
375  3            y_hit = float(signed(y_range(wrange)));
376  3            y_init = 1400.00 * TAN(elev_mils * 0.0009816) + y_hit;
377  3            v_drop = (y_init - y_hit) / ( fptime * 60.0);
378  3            if wrange < 110 then table(ypixel).exptype = 0;
380  3            else if wrange < 130 then table(ypixel).exptype = 1;
382  3            else if wrange < 160 then table(ypixel).exptype = 2;
384  3            else if wrange < 190 then table(ypixel).exptype = 3;
386  3            else if wrange < 220 then table(ypixel).exptype = 4;
388  3            else if wrange < 270 then table(ypixel).exptype = 5;
390  3            else if wrange < 310 then table(ypixel).exptype = 6;
392  3            else if wrange < 360 then table(ypixel).exptype = 7;
394  3            else if wrange < 440 then table(ypixel).exptype = 8;
396  3            else if wrange < 550 then table(ypixel).exptype = 9;
398  3            else if wrange < 670 then table(ypixel).exptype = 10;
400  3            else if wrange < 870 then table(ypixel).exptype = 11;
402  3            else table(ypixel).exptype = 12;
403  3            table(ypixel).clktime = clktime;
404  3            table(ypixel).range = wrange;
405  3            table(ypixel).y_strike = fix(y_hit);
406  3            table(ypixel).y_start = fix(y_init);
407  3            table(ypixel).v_fall = v_drop;
408  3            end;
409  2      end set_table;

            /****************** y pixel level based on range *********************/
410  1      y_range: procedure(range) word;

411  2            declare    range       word,
                            fprange     real,
                            depression  real,
                            yfprange    real,
                            temp        integer,
                            yrange      word;

412  2            fprange = float(signed(range));
413  2            depression = 5705.86/ fprange;
414  2            yfprange = 238.0 - depression;
415  2            temp = rndeven(yfprange);
416  2            yrange = unsign(temp);
417  2            return yrange;
418  2      end y_range;

            /************ GENERATES RANDOM NUMBER ( 0.00 TO 1.00 ) *********************/
419  1      random: procedure real;

420  2            declare   clk   word,
                           fprnd real;
421  2            clk = read_sbx351_clk1 and 01FH;
422  2            call time(clk);
423  2            clk = read_sbx351_clk1 and 07FH;
424  2            fprnd = float(signed(clk))/ 128.0;
425  2            return fprnd;
426  2      end random;

            /************ GENERATES SEQUENCE OF NUMBERS IN RANDOM ORDER ****************/
427  1      random_seq: procedure(length);

428  2          declare    length   word,
                            fplength real,
                            i        word,
                            j        word,
                            num      word,
                            flag     byte,
                            eqflag   byte;

429  2          length = length - 1;
430  2          fplength = float(signed(length));
431  2          do i = 0 to length;
432  3            seqbuff(i) = 50;
433  3            end;
434  2          do i = 0 to length;
435  3            flag = false;
```

```
436  3          do while not flag;
437  4            num = unsignfix(random * fplength));
438  4            eqflag = false;
439  4            do j = 0 to length;
440  5              if num = seqbuff(j) then eqflag = true;
442  5              end;
443  4            if not eqflag then flag = true;
445  4            end;
446  3          seqbuff(i) = low(num);
447  3          end;
448  2      end random_seq;

        /***************string/number combined for display **********************/

449  1      declare     line(43)    byte,
                         db1(3)      byte,
                         db2(3)      byte;

450  1      two_num_line: procedure(bpntr,length,number1,number2);
451  2              declare  bpntr    pointer,
                              length   word,
                              number1  word,
                              number2  word,
                              (bf based bpntr) (1) byte,
                              j     integer;

452  2              do j = 0 to 42;
453  3                line(j) = ' ';
454  3                end;
455  2              if number1 > 999 then number1 = 999;
457  2              if number2 > 999 then number2 = 999;
459  2              do j = 2 to 0 by -1;
460  3                db1(j) = ( number1 mod 10) + 30H;
461  3                db2(j) = ( number2 mod 10) + 30H;
462  3                number1 = number1/10;
463  3                number2 = number2/10;
464  3                end;
465  2              do j = 0 to length-1;
466  3                line(j) = bf(j);
467  3                end;
468  2              line(length) = db1(0);
469  2              line(length+1) = db1(1);
470  2              line(length+2) = db1(2);
471  2              line(length+3) = ',';
472  2              line(length+4) = db2(0);
473  2              line(length+5) = db2(1);
474  2              line(length+6) = db2(2);
475  2      end two_num_line;

476  1      one_num_line: procedure(bpntr,length,number1);
477  2              declare  bpntr    pointer,
                              (bf based bpntr) (1) byte,
                              length   word,
                              number1  word,
                              j     integer;

478  2              do j = 0 to 42;
479  3                line(j) = ' ';
480  3                end;
481  2              if number1 > 999 then do;
483  3                 db1(0) = '*';
484  3                 db1(1) = '*';
485  3                 db1(2) = '*';
486  3                 end;
487  2              else do;
488  3                do j = 2 to 0 by -1;
489  4                  db1(j) = ( number1 mod 10) + 30H;
490  4                  number1 = number1/10;
491  4                  end;
492  3                do j = 0 to length-1;
493  4                  line(j) = bf(j);
494  4                  end;
495  3                end;

496  2              line(length) = db1(0);
497  2              line(length+1) = db1(1);
498  2              line(length+2) = db1(2);
499  2      end one_num_line;

        /*****************************************************************************/

500  1      declare     ii      integer,
                         pct     word;

501  1      declare     level1(8)     byte    data ('EHKYSZ51'),
                         level2(8)     byte    data ('ILDQST42'),
                         level3(8)     byte    data ('KONVRX38');


502  1      scenerio_1: procedure;                          /* GENERATE TARGET SEQUENCE */
503  2           call random_seq(11);
504  2           seqstop = 10;
505  2           call clear_screen;
506  2           do ii = 0 to 10;
```

```
507  3          seqbuff(ii) = seqbuff(ii) + 042H;
508  3          call co(seqbuff(ii));
509  3          call co(cr);
510  3          call co(lf);
511  3          end;

512  2        call box(100,0,300,220,480);
513  2        call screen_ln(@('SCENERIO 1              '),23,2,0,100);
514  2        call screen_ln(@('11 stationary           '),23,3,0,100);
515  2        call screen_ln(@('ammo can is full        '),23,6,0,14);
516  2        do ii = 5 to 1 by -1;
517  3          call one_num_line(@('seconds to start   '),19,unsign(ii));
518  3          call screen_ln(@line, 23, 7, 0,14);
519  3          call time(20000);
520  3          end;

521  2        call start;

522  2        call box(100,0,300,220,480);
523  2        call screen_ln(@('Scenerio 1 (11 targets)'),22,0,0,100);
524  2        call one_num_line(@('destroyed          '),19,total_kills);
525  2        call screen_ln(@line, 23, 1, 0,100);
526  2        call one_num_line(@('damaged            '),19,total_hurts);
527  2        call screen_ln(@line, 23, 2, 0,100);
528  2        call one_num_line(@('# rounds           '),19,total_rnds);
529  2        call screen_ln(@line, 23, 4, 0,100);
530  2        call one_num_line(@('# within 5m        '),19,within5m);
531  2        call screen_ln(@line,23,5,0,100);
532  2        call one_num_line(@('# within 15m       '),19,within15m);
533  2        call screen_ln(@line,23,6,0,100);
534  2        call one_num_line(@('# within 60m       '),19,within60m);
535  2        call screen_ln(@line,23,7,0,100);
536  2        do while not csts;
537  3          end;
538  2      end scenerio_1;

539  1      scenerio_2: procedure;
540  2        call random_seq(5);                    /* GENERATE TARGET SEQUENCE */
541  2        seqstop = 4;
542  2        call clear_screen;
543  2        do ii = 0 to 4;
544  3          seqbuff(ii) = seqbuff(ii) + 031H;
545  3          call co(seqbuff(ii));
546  3          call co(cr);
547  3          call co(lf);
548  3          end;

549  2        call box(100,0,300,220,480);
550  2        call screen_ln(@('SCENERIO 2              '),23,2,0,100);
551  2        call screen_ln(@('5 inward moving         '),23,3,0,100);
552  2        call screen_ln(@('ammo can is full        '),23,6,0,14);
553  2        do ii = 5 to 1 by -1;
554  3          call one_num_line(@('seconds to start   '),19,unsign(ii));
555  3          call screen_ln(@line, 23, 7, 0,14);
556  3          call time(20000);
557  3          end;

558  2        call start;

559  2        call box(100,0,300,220,480);
560  2        call screen_ln(@('Scenerio 2 (5 targets)'),22,0,0,100);
561  2        call one_num_line(@('destroyed          '),19,total_kills);
562  2        call screen_ln(@line, 23, 1, 0,100);
563  2        call one_num_line(@('damaged            '),19,total_hurts);
564  2        call screen_ln(@line, 23, 2, 0,100);
565  2        call one_num_line(@('# rounds           '),19,total_rnds);
566  2        call screen_ln(@line, 23, 4, 0,100);
567  2        call one_num_line(@('# within 5m        '),19,within5m);
568  2        call screen_ln(@line,23,5,0,100);
569  2        call one_num_line(@('# within 15m       '),19,within15m);
570  2        call screen_ln(@line,23,6,0,100);
571  2        call one_num_line(@('# within 60m       '),19,within60m);
572  2        call screen_ln(@line,23,7,0,100);
573  2        do while not csts;
574  3          end;
575  2      end scenerio_2;

576  1      scenerio_3: procedure;                   /* GENERATE TARGET SEQUENCE */
577  2        call random_seq(10);
578  2        seqstop = 9;
579  2        call clear_screen;
580  2        do ii = 0 to 9;
581  3          seqbuff(ii) = seqbuff(ii) + 051H;
582  3          call co(seqbuff(ii));
583  3          call co(cr);
584  3          call co(lf);
585  3          end;

586  2        call box(100,0,300,220,480);
587  2        call screen_ln(@('SCENERIO 3              '),23,2,0,100);
588  2        call screen_ln(@('10 lateral moving       '),23,3,0,100);
589  2        call screen_ln(@('ammo can is full        '),23,6,0,14);
```

```
590  2        do ii = 5 to 1 by -1;
591  3          call one_num_line(@('seconds to start   '),19,unsign(ii));
592  3          call screen_ln(@line, 23, 7, 0,14);
593  3          call time(20000);
594  3          end;

595  2        call start;

596  2        call box(100,0,240,320,480);
597  2        call screen_ln(@('Scenerio 3 (10 targets)'),23,0,0,100);
598  2        call one_num_line(@('destroyed          '),19,total_kills);
599  2        call screen_ln(@line, 23, 1, 0,100);
600  2        call one_num_line(@('damaged            '),19,total_hurts);
601  2        call screen_ln(@line, 23, 2, 0,100);
602  2        call one_num_line(@('# rounds           '),19,total_rnds);
603  2        call screen_ln(@line, 23, 4, 0,100);
604  2        call one_num_line(@('# within 5m        '),19,within5m);
605  2        call screen_ln(@line,23,5,0,100);
606  2        call one_num_line(@('# within 15m       '),19,within15m);
607  2        call screen_ln(@line,23,6,0,100);
608  2        call one_num_line(@('# within 60m       '),19,within60m);
609  2        call screen_ln(@line,23,7,0,100);
610  2        do while not csts;
611  3          end;
612  2      end scenerio_3;

613  1      scenerio_4: procedure;
614  2        call random_seq(8);                    /* GENERATE TARGET SEQUENCE */
615  2        seqstop = 7;
616  2        call clear_screen;
617  2        do ii = 0 to 7;
618  3          seqbuff(ii) = level1(seqbuff(ii));
619  3          end;

620  2        call box(100,0,300,220,480);
621  2        call screen_ln(@('SCENERIO 4             '),23,2,0,100);
622  2        call screen_ln(@('level 1, 8 targets     '),23,3,0,100);
623  2        call screen_ln(@('ammo can is full       '),23,6,0,14);
624  2        do ii = 5 to 1 by -1;
625  3          call one_num_line(@('seconds to start   '),19,unsign(ii));
626  3          call screen_ln(@line, 23, 7, 0,14);
627  3          call time(20000);
628  3          end;

629  2        call start;

630  2        call zoom(2,2);
631  2        call box(100,0,240,320,480);
632  2        call screen_ln(@('Scenerio 6 (8 targets)'),22,0,0,100);
633  2        call one_num_line(@('# targets destroyed        '),28,total_kills);
634  2        call screen_ln(@line, 43, 1, 0, 100);
635  2        call one_num_line(@('# targets damaged          '),28,total_hurts);
636  2        call screen_ln(@line, 43, 2, 0, 100);
637  2        call one_num_line(@('# rounds                   '),28,total_rnds);
638  2        call screen_ln(@line, 43, 4, 0,100);
639  2        pct = (within5m * 100)/total_rnds;
640  2        call two_num_line(@('#,% within 5m              '),28,within5m,pct);
641  2        call screen_ln(@line,43,5,0,100);
642  2        pct = (within15m * 100)/total_rnds;
643  2        call two_num_line(@('#,% within 15m             '),28,within15m,pct);
644  2        call screen_ln(@line,43,6,0,100);
645  2        pct = (within60m * 100)/total_rnds;
646  2        call two_num_line(@('#,% within 60m             '),28,within60m,pct);
647  2        call screen_ln(@line,43,7,0,100);

648  2        if total_kills > 0 then pct = total_rnds/total_kills;
650  2        else pct = 1000;
651  2        call one_num_line(@('avg. rounds / kill         '),28,pct);
652  2        call screen_ln(@line,43,9,0,100);

653  2        if pct <= exp_gun then
654  2           call screen_ln(@('RATING - EXPERT                    '),36,11,111,180);
655  2        else if pct <= gun_agun then
656  2           call screen_ln(@('RATING - GUNNER                    '),36,11,111,180);
657  2        else if pct <= agun_bgun then
658  2           call screen_ln(@('RATING - ASSISTANT GUNNER          '),36,11,111,180);
659  2        else
             call screen_ln(@('RATING - BEGINNER                    '),36,11,111,180);

660  2        do while not csts;
661  3          end;
662  2      end scenerio_4;

663  1      scenerio_5: procedure;
664  2        call random_seq(8);                    /* GENERATE TARGET SEQUENCE */
665  2        seqstop = 7;
666  2        call clear_screen;
667  2        do ii = 0 to 7;
668  3          seqbuff(ii) = level2(seqbuff(ii));
669  3          end;

670  2        call box(100,0,300,220,480);
671  2        call screen_ln(@('SCENERIO 5             '),23,2,0,100);
672  2        call screen_ln(@('level 2, 8 targets     '),23,3,0,100);
```

```
673  2          call screen_ln(@('ammo can is full       '),23,6,0,14);
674  2          do ii = 5 to 1 by -1;
675  3            call one_num_line(@('seconds to start   '),19,unsign(ii));
676  3            call screen_ln(@line, 23, 7, 0,14);
677  3            call time(20000);
678  3            end;

679  2          call start;

680  2          call zoom(2,2);
681  2          call box(100,0,240,320,480);
682  2          call screen_ln(@('Scenerio 5 (8 targets)'),22,0,0,100);
683  2          call one_num_line(@('# targets destroyed          '),28,total_kills);
684  2          call screen_ln(@line, 43, 1, 0, 100);
685  2          call one_num_line(@('# targets damaged            '),28,total_hurts);
686  2          call screen_ln(@line, 43, 2, 0, 100);
687  2          call one_num_line(@('# rounds                     '),28,total_rnds);
688  2          call screen_ln(@line, 43, 4, 0,100);
689  2          pct = (within5m * 100)/total_rnds;
690  2          call two_num_line(@('#,% within 5m                '),28,within5m,pct);
691  2          call screen_ln(@line,43,5,0,100);
692  2          pct = (within15m * 100)/total_rnds;
693  2          call two_num_line(@('#,% within 15m               '),28,within15m,pct);
694  2          call screen_ln(@line,43,6,0,100);
695  2          pct = (within60m * 100)/total_rnds;
696  2          call two_num_line(@('#,% within 60m               '),28,within60m,pct);
697  2          call screen_ln(@line,43,7,0,100);
698  2          if total_kills > 0 then pct = total_rnds/total_kills;
700  2          else pct = 1000;
701  2          call one_num_line(@('avg. rounds / kill           '),28,pct);
702  2          call screen_ln(@line,43,9,0,100);

703  2          if pct <= exp_gun then
704  2             call screen_ln(@('RATING - EXPERT                    '),36,11,111,180);
705  2          else if pct <= gun_agun then
706  2             call screen_ln(@('RATING - GUNNER                    '),36,11,111,180);
707  2          else if pct <= agun_bgun then
708  2             call screen_ln(@('RATING - ASSISTANT GUNNER          '),36,11,111,180);
709  2          else
                   call screen_ln(@('RATING - BEGINNER                  '),36,11,111,180);

710  2          do while not csts;
711  3            end;
712  2       end scenerio_5;

713  1       scenerio_6: procedure;
714  2          call random_seq(8);                    /* GENERATE TARGET SEQUENCE */
715  2          seqstop = 7;
716  2          call clear_screen;
717  2          do ii = 0 to 7;
718  3            seqbuff(ii) = level3(seqbuff(ii));
719  3            end;

720  2          call box(100,0,300,220,480);
721  2          call screen_ln(@('SCENERIO 6              '),23,2,0,100);
722  2          call screen_ln(@('level 3, 8 targets      '),23,3,0,100);
723  2          call screen_ln(@('ammo can is full        '),23,6,0,14);
724  2          do ii = 5 to 1 by -1;
725  3            call one_num_line(@('seconds to start   '),19,unsign(ii));
726  3            call screen_ln(@line, 23, 7, 0,14);
727  3            call time(20000);
728  3            end;

729  2          call start;

730  2          call zoom(2,2);
731  2          call box(100,0,240,320,480);
732  2          call screen_ln(@('Scenerio 6 (8 targets)'),22,0,0,100);
733  2          call one_num_line(@('# targets destroyed          '),28,total_kills);
734  2          call screen_ln(@line, 43, 1, 0, 100);
735  2          call one_num_line(@('# targets damaged            '),28,total_hurts);
736  2          call screen_ln(@line, 43, 2, 0, 100);
737  2          call one_num_line(@('# rounds                     '),28,total_rnds);
738  2          call screen_ln(@line, 43, 4, 0,100);
739  2          pct = (within5m * 100)/total_rnds;
740  2          call two_num_line(@('#,% within 5m                '),28,within5m,pct);
741  2          call screen_ln(@line,43,5,0,100);
742  2          pct = (within15m * 100)/total_rnds;
743  2          call two_num_line(@('#,% within 15m               '),28,within15m,pct);
744  2          call screen_ln(@line,43,6,0,100);
745  2          pct = (within60m * 100)/total_rnds;
746  2          call two_num_line(@('#,% within 60m               '),28,within60m,pct);
747  2          call screen_ln(@line,43,7,0,100);

748  2          if total_kills > 0 then pct = total_rnds/total_kills;
750  2          else pct = 1000;
751  2          call one_num_line(@('avg. rounds / kill           '),28,pct);
752  2          call screen_ln(@line,43,9,0,100);

753  2          if pct <= exp_gun then
754  2             call screen_ln(@('RATING - EXPERT                    '),36,11,111,180);
755  2          else if pct <= gun_agun then
756  2             call screen_ln(@('RATING - GUNNER                    '),36,11,111,180);
```

```
757  2          else if pct <= agun_bgun then
758  2             call screen_ln(@('RATING - ASSISTANT GUNNER          '),36,11,111,180);
759  2          else
                   call screen_ln(@('RATING - BEGINNER                  '),36,11,111,180);

760  3          do while not csts;
761  3            end;
762  2       end scenerio_6;

             /******************** main program startup ******************************/

763  1       prompt: procedure;
764  2               call rq$set$priority(selector$of(nil), 150, @status);
765  2               call setup_sbx351_clock;
766  2               call open_port0;
767  2               call open_port1;
768  2               call send_data(preset);
769  2               call time(10000);
770  2               call vdisk_online;
771  2               call time(1000);
772  2               call vdisk_online;
773  2               call time(1000);
774  2               call vdisk_online;
775  2               call set_color_table;
776  2               call explosion_blocks;
777  2               call restore_explosions;
778  2               call hit_blocks;
779  2               call restore_hits;
780  2               call setup_sbx350;
781  2               call send_data(key_on);
782  2               call box(255,0,0,1280,479);
783  2               call clear_screen;
784  2               call set_table;
785  2               call boresight;
786  2               call setup_trig_int;
787  2               call ntsc_logo;

             /* initialize system parameters */

788  2               hit_level = 2;
789  2               w60mpnts = 2;
790  2               w15mpnts = 8;
791  2               w5mpnts = 20;
792  2               exp_gun = 20;
793  2               gun_agun = 40;
794  2               agun_bgun = 60;
795  2               autoreload = false;
796  2               pause = false;

             /*********************************/

797  2               done = false;
798  2               do while not done;
799  3                 call recoil_off;
800  3                 ammoflag = true;
801  3                 status = menu_select;
802  3                 do case status;
803  4                   call scenerio_1;
804  4                   call scenerio_2;
805  4                   call scenerio_3;
806  4                   call scenerio_4;
807  4                   call scenerio_5;
808  4                   call scenerio_6;
809  4                   done = true;
810  4                   end;
811  3                 end;
812  2               call close_port0;
813  2               call close_port1;
814  2               call rq$reset$interrupt(trig_int_level, @status);
815  2       end prompt;

             /*
             Main Program Start
             */

816  1       call init$real$math$unit;
817  1       call setup;
818  1       call prompt;
819  1       call dq$exit(0);

820  1       end mk19;

MODULE INFORMATION:

     CODE AREA SIZE     = 15A2H   5538D
     CONSTANT AREA SIZE = 0863H   2147D
     VARIABLE AREA SIZE = 2008H   8200D
     MAXIMUM STACK SIZE = 0050H     80D
     1242 LINES READ
     1 PROGRAM WARNING
     0 PROGRAM ERRORS
```

```
DICTIONARY SUMMARY:

    288KB MEMORY AVAILABLE
    28KB MEMORY USED   (9%)
    0KB DISK SPACE USED

END OF PL/M-286 COMPILATION

            $debug optimize(3)

  1         scenerio: do;

            $include(:LIB:literal.inc)
        =   $nolist
            $include(:LIB:sys_calls.inc)
        =   $nolist
            $include(:LIB:serialio.inc)
        =   $nolist
            $include(:LIB:parallax.inc)
        =   $nolist
            $include(:LIB:vdisk.inc)
        =   $nolist
            $include(:LIB:sbx351.inc)
234   1 =   setup_sbx351_clock: procedure external;
235   2 =   end setup_sbx351_clock;

236   1 =   read_sbx351_clock: procedure word external;
237   2 =   end read_sbx351_clock;

238   1 =   read_sbx351_clk1: procedure word external;
239   2 =   end read_sbx351_clk1;

            /************************EXTERNAL SUBROUTINES***************************/

240   1     hit: procedure ( r , x, yh, c) external;
241   2          declare        r     word,
                                yh    integer,
                                x     integer,
                                c     byte;
242   2     end hit;

243   1     miss: procedure ( exptype , x, yh, c) external;
244   2           declare        exptype    word,
                                 yh         integer,
                                 x          integer,
                                 c          byte;
245   2     end miss;

246   1     round: procedure (y, x, age) external;
247   2            declare   y      integer,
                             x      integer,
                             age    word;
248   2     end round;

249   1     recoil_on: procedure external;
250   2     end recoil_on;

251   1     recoil_off: procedure external;
252   2     end recoil_off;

            /******external  declarations*************************************/

253   1     declare       count      word    external,
                          ammoflag   byte    external,
                          autoreload byte    external,
                          pause      byte    external,
                          ping_flag  byte    external,
                          porta      byte    external,
                          w200flag   byte    external,
                          w75flag    byte    external,
                          w75cnt     word    external,
                          dead       byte    external;

254   1     declare  rnd(48)  structure ( flag      byte,
                                          cnt       byte,
                                          exptype   word,
                                          range     word,
                                          t_start   word,
                                          x         integer,
                                          y_start   integer,
                                          v_fall    real,
                                          y_strike  integer,
                                          age       word)    external;

255   1     declare  seqbuff(20) byte external,
                     seqstop     byte external,
                     hit_level   byte external,
                     total_kills word external,
                     total_hurts word external,
                     total_rnds  word external,
                     within5m    word external,
                     within15m   word external,
```

```
                within60m   word external,
                w5mpnts     word external,
                w15mpnts    word external,
                w60mpnts    word external;

        /**************** global (module) declarations ******************************/

256  1  declare   target (1500) structure ( range   integer,
                                            xleft   integer,
                                            xright  integer,
                                            otype   word);

257  1  declare   boat (1500) structure (x1  word,  y1 word,
                                         x2  word,  y2 word,
                                         x3  word,  y3 word,
                                         x4  word,  y4 word,
                                         x5  word,  y5 word);

258  1  declare  done          byte,
                file(10)       byte,
                clipfile       token,
                bytesread      word,
                error          word,
                fbuffer(28)    byte;

259  1  declare  index      word,
                frames     word,
                sframe     word,
                eframe     word;

260  1  declare  i              word,
                age            word,
                fpage          real,
                y_now          integer;

261  1  declare  hits       word,
                trnds      word,
                wounds     word,
                kills      word,
                clips      word,
                hit_count  word;

262  1  declare  pingobj (100) structure (type word, x integer, y integer),
                pongobj (100) structure (type word, x integer, y integer),
                pingend      word,
                pongend      word;

263  1  declare   caution(*) byte data (
                        !! CAUTION !!  ROUND WITHIN 100M
                          !! CAUTION !! ROUND WITHIN 200M
                 );
264  1  declare   danger(*) byte data (
                        !! DANGER !! ROUND WITHIN 75M
                          !! DANGER !! ROUND WITHIN 7[illegible]
                 );

        /********** SBX350 PORT CONTROL (SOUND CONTROL SIGNAL) **********************/
265  1  declare    sbx350_control      lit   '5046H',
                  sbx350_porta        lit   '5040H';

        /***************string/number combined for display **********************/

266  1  declare     line(23)    byte,
                   db(3)       byte;

267  1  numline: procedure(bpntr,length,number);
268  2           declare  bpntr    pointer,
                          length   word,
                          number   word,
                          (bf based bpntr) (1) byte,
                          j     integer;

269  2           do j = 0 to 22;
270  3             line(j) = ' ';
271  3             end;
272  2           if number > 999 then number = 999;
274  2           do j = 2 to 0 by -1;
275  3             db(j) = ( number mod 10) + 30H;
276  3             number = number/10;
277  3             end;
278  2           do j = 0 to length-1;
279  3             line(j) = bf(j);
280  3             end;
281  2           line(length) = db(0);
282  2           line(length+1) = db(1);
283  2           line(length+2) = db(2);
284  2     end numline;

        /*****************************************************************************/
        /*************get scenerio data from hard disk*****************************/
285  1  get_data: procedure;
286  2          clipfile = dq$attach (@file, @error);
287  2          call dq$open(clipfile, 1, 0, @error);
```

```
288  2          bytesread = dq$read (clipfile, @sframe, 2, @error);
289  2          bytesread = dq$read (clipfile, @frames, 2, @error);
290  2          eframe = sframe + frames;
291  2          do i = 0 to frames;
292  3            bytesread = dq$read (clipfile, @target(i), 8, @error);
293  3            bytesread = dq$read (clipfile, @boat(i), 20, @error);
294  3            end;
295  2          call dq$close(clipfile, @error);
296  2     end get_data;

           /*********************************************************************/
297  1     random: procedure real;

298  2          declare   clk   word,
                         fprnd real;

299  2          clk = read_sbx351_clk1 and 01FH;
300  2          call time(clk);
301  2          clk = read_sbx351_clk1 and 07FH;
302  2          fprnd = float(signed(clk))/ 128.0;
303  2          return fprnd;
304  2     end random;

           /*************clear active round buffer*****************************/
305  1     clear_rnd_buffer: procedure;
306  2          do i = 0 to 47;
307  3            rnd(i).flag = 0;
308  3            end;
309  2     end clear_rnd_buffer;

           /*************draw boat outline polygon*****************************/
310  1     ppoly5: procedure;
311  2          do while not shr(inword(csr), 7);
312  3            end;
313  2          outword(cdr) = 1;
314  2          outword(cdr) = 255;
315  2          outword(cdr) = 5;
316  2          outword(cdr) = boat(index).x1;
317  2          outword(cdr) = boat(index).y1;
318  2          outword(cdr) = boat(index).x2;
319  2          outword(cdr) = boat(index).y2;
320  2          outword(cdr) = boat(index).x3;
321  2          outword(cdr) = boat(index).y3;
322  2          outword(cdr) = boat(index).x4;
323  2          outword(cdr) = boat(index).y4;
324  2          outword(cdr) = boat(index).x5;
325  2          outword(cdr) = boat(index).y5;
326  2     end ppoly5;

           /*************draw boat outline circle******************************/
327  1     ccirc: procedure;
328  2          do while not shr(inword(csr), 7);
329  3            end;
330  2          outword(cdr) = 02h;
331  2          outword(cdr) = 255;
332  2          outword(cdr) = boat(index).x2;
333  2          outword(cdr) = boat(index).x1;
334  2          outword(cdr) = boat(index).y1;
335  2     end ccirc;

           /************ erase display objects in one buffer **********************/
336  1     erase_objects: procedure;

337  2          declare   pntr   word,
                         xp     word,
                         yp     word;
338  2          if ping_flag then do;
340  3            if pingend <> 0 then do;
342  4              do pntr = 0 to pingend - 1;
343  5                if pingobj(pntr).type < 12 then do;
345  6                  xp = unsign(pingobj(pntr).x);
346  6                  yp = unsign(pingobj(pntr).y);
347  6                  do case pingobj(pntr).type;
348  7                     call box(255,xp-20,yp-2,xp+20,yp+80);
349  7                     call box(255,xp-17,yp-2,xp+17,yp+68);
350  7                     call box(255,xp-15,yp-2,xp+15,yp+56);
351  7                     call box(255,xp-12,yp-2,xp+12,yp+48);
352  7                     call box(255,xp-10,yp-2,xp+10,yp+40);
353  7                     call box(255,xp-9,yp-2,xp+9,yp+32);
354  7                     call box(255,xp-8,yp-2,xp+8,yp+28);
355  7                     call box(255,xp-7,yp-2,xp+7,yp+24);
356  7                     call box(255,xp-6,yp-2,xp+6,yp+20);
357  7                     call box(255,xp-5,yp-2,xp+5,yp+16);
358  7                     call box(255,xp-4,yp-2,xp+4,yp+13);
359  7                     call box(255,xp-3,yp-2,xp+3,yp+10);
360  7                     end;
361  6                  end;
362  5                else if pingobj(pntr).type = 20 then do;
364  6                  xp = unsign(pingobj(pntr).x);
365  6                  yp = unsign(pingobj(pntr).y);
366  6                  call box(255,xp-4,yp-4,xp+4,yp+4);
367  6                  end;
368  5                else if pingobj(pntr).type = 30 then do;
```

```
370  6                xp = unsign(pingobj(pntr).x);
371  6                yp = unsign(pingobj(pntr).y);
372  6                call box(255,xp-20,yp-16,xp+20,yp+35);
373  6                end;
374  5              end;
375  4            pingend = 0;
376  4            end;
377  3          end;
378  2        else do;
379  3          if pongend <> 0 then do;
381  4            do pntr = 0 to pongend - 1;
382  5              if pongobj(pntr).type < 12 then do;
384  6                xp = unsign(pongobj(pntr).x);
385  6                yp = unsign(pongobj(pntr).y);
386  6                do case pongobj(pntr).type
387  7                  call box(255,xp-20,yp-2,xp+20,yp+80);
388  7                  call box(255,xp-17,yp-2,xp+17,yp+68);
389  7                  call box(255,xp-15,yp-2,xp+15,yp+56);
390  7                  call box(255,xp-12,yp-2,xp+12,yp+48);
391  7                  call box(255,xp-10,yp-2,xp+10,yp+40);
392  7                  call box(255,xp-9,yp-2,xp+9,yp+32);
393  7                  call box(255,xp-8,yp-2,xp+8,yp+28);
394  7                  call box(255,xp-7,yp-2,xp+7,yp+24);
395  7                  call box(255,xp-6,yp-2,xp+6,yp+20);
396  7                  call box(255,xp-5,yp-2,xp+5,yp+16);
397  7                  call box(255,xp-4,yp-2,xp+4,yp+13);
398  7                  call box(255,xp-3,yp-2,xp+3,yp+10);
399  7                  end;
400  6                end;
401  5              else if pongobj(pntr).type = 20 then do;
403  6                xp = unsign(pongobj(pntr).x);
404  6                yp = unsign(pongobj(pntr).y);
405  6                call box(255,xp-2,yp-2,xp+2,yp+2);
406  6                end;
407  5              else if pongobj(pntr).type = 30 then do;
409  6                xp = unsign(pongobj(pntr).x);
410  6                yp = unsign(pongobj(pntr).y);
411  6                call box(255,xp-18,yp-14,xp+18,yp+20);
412  6                end;
413  5              end;
414  4            pongend = 0;
415  4            end;
416  3          end;
417  2    end erase_objects;

     /****************** y pixel level based on range ********************/
418  1    y_range: procedure(range) word;

419  2          declare    range        word,
                            fprange      real,
                            depression   real,
                            yfprange     real,
                            temp         integer,
                            yrange       word;

420  2          fprange = float(signed(range));
421  2          depression = 5705.86/ fprange;
422  2          yfprange = 238.0 - depression;
423  2          temp = rndeven(yfprange);
424  2          yrange = unsign(temp);
425  2          return yrange;
426  2    end y_range;

     /****************  check for hit ***********************************/

427  1    hit_check: procedure;

428  2        declare xtarg   integer,
                     rtarg   integer,
                     xrnd    integer,
                     rrnd    integer,
                     xdiff   integer,
                     rdiff   integer,
                     xdf     real,
                     rdf     real,
                     sqradi  real;

             /* LOCATION OF BOAT */
429  2       rnd(i).cnt = 0;
430  2       xtarg = (target(index).xleft + target(index).xright) / 2;
431  2       rtarg = target(index).range;

             /* LOCATION OF ROUND */
432  2       xrnd = rnd(i).x;
433  2       rrnd = signed(rnd(i).range);

             /* FIND DISTANCE FROM BOAT IN METERS */
434  2       xdiff = xtarg - xrnd;
435  2       xdiff = (xdiff * rrnd)/1500;    /* CONVERT TO METERS */
436  2       rdiff = rtarg - rrnd;
437  2       xdf = float(xdiff);
438  2       rdf = float(rdiff);
439  2       sqradi = xdf * xdf + rdf * rdf;
```

```
440  2          if rdiff > 0 then rnd(i).flag = 4;
442  2          else rnd(i).flag = 5;

443  2          if sqradi < 3600. then do;
445  3             if sqradi < 25. then do;
447  4                w5m = w5m + 1;
448  4                rnd(i).flag = 3;
449  4                rnd(i).x = xdiff;
450  4                end;
451  3             else if sqradi < 225. then do;
453  4                w15m = w15m + 1;
454  4                if hit_level < 3 then hit_count = hit_count + w15mpnts;
456  4                end;
457  3             else do;
458  4                w60m = w60m + 1;
459  4                if hit_level < 2 then hit_count = hit_count + w60mpnts;
461  4                end;
462  3             end;

463  2      end hit_check;

464  1          declare      ii            integer,
                              jj            integer,
                              hitpos        integer,
                              rsound        word,
                              scale         byte,
                              endcnt        word,
                              ammoleft      word,
                              temp          word,
                              wflag1        byte,
                              wflag2        byte,
                              woundflag     byte,
                              woundcnt      byte,
                              w5m           word,
                              w15m          word,
                              w60m          word,
                              key           byte;

         /**************** scenerio entry ****************************************/
465  1      start: procedure public;

466  2          file(0) = 9;
467  2          file(1) = 'c';
468  2          file(2) = 'l';
638  4              if not(woundflag) then do;
640  5                if hit_count > 19 then woundflag = true;
642  5                end;

643  4              do i = 0 to 47;
644  5                if rnd(i).flag > 2 then do;
646  6                  age = read_sbx351_clock - rnd(i).t_start;
647  6                  if age >= rnd(i).age then do;
649  7                    porta = porta and 11111011b;
650  7                    output(sbx350_porta) = porta;
651  7                    call hit_check;
652  7                    rsound = shr(rnd(i).range,7);    /* range / 16 */
653  7                    if rsound > 7 then rsound = 7;
655  7                    scale = low(rsound);
656  7                    scale = shl(scale,4);
657  7                    scale = scale or 00000100b;
658  7                    if rnd(i).flag = 3 then do;
660  8                      porta = porta and 10000111b;
661  8                      porta = porta or scale;
662  8                      output(sbx350_porta) = porta;
663  8                      end;
664  7                    else do;
665  8                      porta = porta and 10000111b;
666  8                      porta = porta or 00001000b;
667  8                      porta = porta or scale;
668  8                      output(sbx350_porta) = porta;
669  8                      end;
670  7                    end;
671  6                  else do;
672  7                    fpage = float(signed(age));
673  7                    y_now = rnd(i).y_start - fix(fpage * rnd(i).v_fall);
674  7                    age = shr(age,2);
675  7                    if age < 16 then do;
677  8                      call round(y_now, rnd(i).x, age);
678  8                      if ping_flag then do;
680  9                        pingobj(pingend).type = 20;
681  9                        pingobj(pingend).x = rnd(i).x;
682  9                        pingobj(pingend).y = y_now;
683  9                        pingend = pingend + 1;
684  9                        end;
685  8                      else do;
686  9                        pongobj(pongend).type = 20;
687  9                        pongobj(pongend).x = rnd(i).x;
688  9                        pongobj(pongend).y = y_now;
689  9                        pongend = pongend + 1;
690  9                        end;
691  8                      end;
692  7                    end;
693  6                  end;
694  5                end;
```

```
695  4          if ping_flag then do:
697  5            ping_flag = false;
698  5            call send_data(2aH);
699  5            call pan(0,479);
700  5            call tranw(639,0),
701  5            end;
702  4          else do;
703  5            ping_flag = true;
704  5            call send_data(2aH);
705  5            call pan(639,479);
706  5            call tranw(0,0);
707  5            if not(wflag1) then do;
709  6              if w200flag then do;
711  7                wflag1 = true;
712  7                call screen_ln(@CAUTION,LENGTH(CAUTION),1,0,111);
713  7                end;
714  6              end;
715  5            if not(wflag2) then do;
717  6              if w75flag then do;
719  7                wflag2 = true;
720  7                call screen_ln(@DANGER,LENGTH(DANGER),2,111,180);
721  7                end;
722  6              end;
723  5            if dead then do;
725  6              call box(180,0,0,1280,479);
726  6              done = true;
727  6              call vdisk_allclear;
728  6              do while not csts;
729  7                end;
730  6              end;
731  5            end;
732  4          end;
733  3        call vdisk_cancel;
734  3        call send_data(02aH);
735  3        call zoom(3,3);
736  3        call pan(0,479);
737  3        call tranw(0,0);
738  3        call box(100,0,300,220,480);
739  3        call time(2000);
740  3        if hit_count > 39 then call screen_ln(@('TARGET DESTROYED'),16,1,180,100);
742  3        else if hit_count > 19 then call screen_ln(@('TARGET DAMAGED  '),16,1,0,100);
744  3        else call screen_ln(@('TARGET NOT DAMAGED '),19,1,30,100);

745  3        if not autoreload then do;
747  4          if count > 47 then count = 48;
749  4          ammoleft = 48 - count;
750  4          call numline(@('ammunition count   '),19,ammoleft);
751  4          call screen_ln(@line,22,8,0,100);
752  4          end;

753  3        if pause then do;
755  4          call clear_screen;
756  4          call numline(@('# rounds           '),19,count-temp);
757  4          call screen_ln(@line, 23, 3, 0,100);
758  4          call numline(@('# within 5m        '),19,w5m);
759  4          call screen_ln(@line,23,4,0,100);
760  4          call numline(@('# within 15m       '),19,w15m);
761  4          call screen_ln(@line,23,5,0,100);
762  4          call numline(@('# within 60m       '),19,w60m);
763  4          call screen_ln(@line,23,6,0,100);
764  4          call write_ln(@('hit any key or pull trigger',cr,lf,
                          'to continue scenerio',cr,lf),51);

765  4          call recoil_off;
766  4          key = ammoflag;
767  4          ammoflag = true;
768  4          do i = 0 to 10;
769  5            call time(4000);
770  5            end;
771  4          rnd(0).flag = 0;
772  4          i = count;
773  4          count = 0;
774  4          ammoflag = key;
775  4          done = false;
776  4          do while not done;
777  5            if csts then done = true;
779  5            if rnd(0).flag <> 0 then done = true;
781  5            end;
782  4          count = i;
783  4          rnd(0).flag = 0;
784  4          call recoil_on;
785  4          end;
786  3        else do;
787  4          do i = 0 to 25;
788  5            call time(2500);
789  5            end;
790  4          end;

791  3        call clear_screen;
792  3        if woundflag then wounds = wounds + 1;
794  3        end;
/********* end of main scene..o loop *******-        ************************/
```

```
795   2          wounds = wounds - kills;
796   2          if ammoflag = false then trnds = trnds + [illegible];
798   2                                 else trnds = trnds + [illegible];
799   2          ammoflag = false;
800   2          total_rnds = trnds;
801   2          total_kills = kills;
802   2          total_hurts = wounds;
803   2      end start;

804   1      end scenerio;
```

MODULE INFORMATION:

```
    CODE AREA SIZE      = 13A4H   5028D
    CONSTANT AREA SIZE  = 0290H    656D
    VARIABLE AREA SIZE  = A97BH  43387D
    MAXIMUM STACK SIZE  = 0018H     24D
    1139 LINES READ
    0 PROGRAM WARNINGS
    0 PROGRAM ERRORS
```

DICTIONARY SUMMARY:

```
    288KB MEMORY AVAILABLE
    24KB MEMORY USED    ([illegible])
    0KB DISK SPACE USED
```

END OF PL/M-286 COMPILATION

```
            $debug optimize(3)

  1         video_disk: do;

            $include (literal.inc)
        *   $nolist
            $include (sys_calls.inc)
        *   $nolist
            $include (serialio.inc)
        *   $nolist

            /*****************************************************************************/

121   1     declare    stx       lit   '02d',
                       etx       lit   '03d',
                       ack       lit   '06d',
                       ackcmd          byte,
                       online11 (*)    byte  data(stx,'ON11:',etx),
                       offline  (*)    byte  data(stx,'OF',etx),
                       allclear (*)    byte  data(stx,'AC',etx),
                       cancel   (*)    byte  data(stx,'CS',etx),
                       trackno  (*)    byte  data(stx,'NO',etx),
                       stepfwd  (*)    byte  data(stx,'TF',etx),
                       steprev  (*)    byte  data(stx,'TR',etx),
                       plstatus (*)    byte  data(stx,'PS',etx),
                       bytesread       word,
                       status          word;

            /*****************************************************************************/
122   1     vdisk_online: procedure public;
123   2         call dq$write( port1, @online11, length(online11), @status);
124   2         bytesread = dq$read( port1, @ackcmd, 1, @status);
125   2         if ackcmd <> ack then call write_ln(@('vdisk communication error'),25);
127   2     end vdisk_online;

            /*****************************************************************************/
128   1     vdisk_allclear: procedure public;
129   2         call dq$write( port1, @allclear, length(allclear), @status);
130   2         bytesread = dq$read( port1, @ackcmd, 1, @status);
131   2         if ackcmd <> ack then call write_ln(@('vdisk communication error'),25);
133   2     end vdisk_allclear;

            /*****************************************************************************/
134   1     vdisk_cancel: procedure public;
135   2         call dq$write( port1, @cancel, length(cancel), @status);
136   2         bytesread = dq$read( port1, @ackcmd, 1, @status);
137   2         if ackcmd <> ack then call write_ln(@('vdisk communication error'),25);
139   2     end vdisk_cancel;

            /*****************************************************************************/
140   1     vdisk_offline: procedure public;
141   2         call dq$write( port1, @offline, length(offline), @status);
142   2         bytesread = dq$read( port1, @ackcmd, 1, @status);
143   2         if ackcmd <> ack then call write_ln(@('vdisk communication error'),25);
145   2     end vdisk_offline;

            /*****************************************************************************/
146   1     vdisk_status: procedure byte public;
147   2       declare    i          byte,
                         status     byte,
                         buff(6)    byte;
```

```
148  2        call dq$write( port1, @plstatus, length(plstatus), @status);
149  2        bytesread = dq$read( port1, @buff, 6, @status);
150  2        if buff(3) = 'P' then do:
152  3           if buff(4) = 'F' then status = 1;
154  3           else status = 2;
155  3           end;
156  2        else if buff(3) = 'T' then do:
158  3           if buff(4) = 'F' then status = 3;
160  3           else status = 4;
161  3           end;
162  2        else if buff(3) = 'L' then do:
164  3           if buff(4) = 'F' then status = 5;
166  3           else if buff(4) = 'R' then status = 6;
168  3           else status = 10;
169  3           end;
170  2        else if buff(3) = 'F' then do:
172  3           if buff(4) = 'F' then status = 7;
174  3           else status = 8;
175  3           end;
176  2        else if buff(3) = 'S' then do:
178  3           if buff(4) = 'R' then status = 9;
180  3           else status = 13;
181  3           end;
182  2        else if buff(3) = 'E' then status = 11;
184  2        else if buff(3) = 'H' then status = 12;
186  2        else status = 13;
187  2        return status;
188  2     end vdisk_status;

         /*****************************************************************************/
189  1     vdisk_track: procedure word public;
190  2        declare   track    word,
                       buff(10) byte,
                       i        byte;

191  2        call dq$write( port1, @trackno, length(trackno), @status);
192  2        bytesread = dq$read( port1, @buff, 10, @status);
193  2        track = ( buff(4) - 30H ) * 10000 +
                     ( buff(5) - 30H ) * 1000 +
                     ( buff(6) - 30H ) * 100 +
                     ( buff(7) - 30H ) * 10 +
                     ( buff(8) - 30H );
194  2         return track;
195  2     end vdisk_track;

         /*****************************************************************************/
196  1     vdisk_playfwd: procedure (stopframe) public;
197  2        declare    stopframe                    word,
                        sframe(5)                    byte,
                        i                            integer;

198  2        do i = 4 to 0 by -1;
199  3          sframe(i) = (stopframe mod 10) + 30H;
200  3          stopframe = stopframe / 10;
201  3          end;
202  2        call dq$write( port1, @(stx,'PF'), 3, @status);
203  2        call dq$write( port1, @sframe, 5, @status);
204  2        call dq$write( port1, @(':',etx), 2, @status);
205  2        bytesread = dq$read( port1, @ackcmd, 1, @status);
206  2        if ackcmd <> ack then call write_ln(@('vdisk communication error'),25);
208  2     end vdisk_playfwd;

         /*****************************************************************************/
209  1     vdisk_play: procedure public;
210  2        call dq$write( port1, @(stx,'PF:',etx), 5, @status);
211  2        bytesread = dq$read( port1, @ackcmd, 1, @status);
212  2        if ackcmd <> ack then call write_ln(@('vdisk communication error'),25);
214  2     end vdisk_play;

         /*****************************************************************************/
215  1     vdisk_search: procedure (frame) public;
216  2        declare    frame                        word,
                        sframe(5)                    byte,
                        i                            integer;

217  2        do i = 4 to 0 by -1;
218  3          sframe(i) = (frame mod 10) + 30H;
219  3          frame = frame / 10;
220  3          end;
221  2        call dq$write( port1, @(stx, 'SR'), 3, @status);
222  2        call dq$write( port1, @sframe, 5, @status);
223  2        call dq$write( port1, @(':',etx), 2, @status);
224  2        bytesread = dq$read( port1, @ackcmd, 1, @status);
225  2        if ackcmd <> ack then call write_ln(@('vdisk communication error'),25);
227  2     end vdisk_search;

         /*****************************************************************************/
228  1     vdisk_stepfwd: procedure public;
229  2        call dq$write( port1, @stepfwd, length(stepfwd), @status);
230  2        bytesread = dq$read( port1, @ackcmd, 1, @status);
231  2        if ackcmd <> ack then call write_ln(@('vdisk communication error'),25);
233  2     end vdisk_stepfwd;

         /*****************************************************************************/
```

```
234   1      vdisk_steprev: procedure public:
235   2          call dq$write( port1, @steprev, length(steprev), @status);
236   2          bytesread = dq$read( port1, @ackcmd, 1, @status);
237   2          if ackcmd <> ack then call write_ln(@('vdisk communication error'),25);
239   2      end vdisk_steprev;

240   1      end video_disk;
```

```
MODULE INFORMATION:

     CODE AREA SIZE     = 0536H   1334D
     CONSTANT AREA SIZE = 0117H    279D
     VARIABLE AREA SIZE = 0028H     40D
     MAXIMUM STACK SIZE = 0016H     22D
     405 LINES READ
     0 PROGRAM WARNINGS
     0 PROGRAM ERRORS

DICTIONARY SUMMARY:

     288KB MEMORY AVAILABLE
     12KB MEMORY USED   (4%)
     0KB DISK SPACE USED

END OF PL/M-286 COMPILATION
```

```
                $debug optimize(3)

    1           parallax_subs: do;

                $include (literal.inc)
            =   $nolist
                $include (sys_calls.inc)
            =   $nolist
                $include (serialio.inc)
            =   $nolist

                /**********parallax board io address*****************************************/

  121   1       declare  csr  lit  '020h',
                         cdr  lit  '022h';

                /*********** SETUP COLOR TABLE ON PARRALLAX BOARD *************************/
                /*                                                                         */
                /*       COLORS 0 - 215 ARE DEFINED SYMETRICALLY                           */
                /*       COLORS 216 - 254 ARE UNDEFINED                                    */
                /*       OPAQUE TABLE 2 IS SET UP AS FOLLOWS:                              */
                /*          NON INVERTING MODE - COLORS 0 - 239 AND 255 ARE OPAQUE         */
                /*                               COLORS 240 - 254 ARE TRANSPARENT          */
                /*          INVERTING MODE     - INVERSE OF ABOVE                           */
                /*                                                                         */
                /*     LEAVES USER IN OPAQUE TABLE 2 NON-INVERTED                          */
                /*****************************************************************************/

  122   1       set_color_table: procedure public;

  123   2               declare    (i,j,k)          byte,
                                   color            word,
                                   red_value        word,
                                   green_value      word,
                                   blue_value       word,
                                   red_color        word,
                                   blue_green       word;

                        /* FIRST DEFINE COLORS 0 - 215 IN OPAQUE TABLE 0 (DEFAULT) */
  124   2               color = 0;
  125   2               red_value = 0;
  126   2               blue_value = 0;
  127   2               green_value = 0;
  128   2               do i = 0 to 5;
  129   3                 do j = 0 to 5;
  130   4                    do k = 0 to 5;
  131   5                      call send_data(13H);
  132   5                      red_color = ( shl(red_value,8) or color );
  133   5                      call send_data(red_color);
  134   5                      blue_green = ( shl(blue_value, 8) or green_value );
  135   5                      call send_data(blue_green);
  136   5                      green_value = green_value + 51;
  137   5                      if k = 5 then green_value = 0;
  139   5                      if color = 183 then do;
  141   6                        red_color = (shl(red_value,8) or 247);
  142   6                        call send_data(13H);
  143   6                        call send_data(red_color);
  144   6                        call send_data(blue_green);
  145   6                        end;
  146   5                      color = color + 1;
  147   5                      end;
  148   4                    blue_value = blue_value + 51;
  149   4                    if j = 5 then blue_value = 0;
  151   4                    end;
  152   3                 red_value = red_value + 51;
  153   3                 end;
```

```
                /* INITIALIZE COLORS 0 to 15 BLACK TO GREY- 6 AS GREY TO WHITE */
154  2                red_value = 0;
155  2                green_value = 0;
156  2                blue_value = 0;
157  2                do color = 0 to 15;
158  3                  red_color = ( shl(red_value,8) or color );
159  3                  blue_green = ( shl(blue_value, 8) or green_value );
160  3                  call send_data(13H);
161  3                  call send_data(red_color);
162  3                  call send_data(blue green);
163  3                  red_value = red_value + 15;
164  3                  blue_value = blue_value + 15;
165  3                  green_value = green_value + 15;
166  3                  end;

                /* INITIALIZE TRANSPARENT COLORS TO WHITE (240 - 247) BLACK (248 - 254) */

167  2                do i = 240 to 246;
168  3                   red_color = 0FF00H or double(i);
169  3                   blue_green = 0FFFFH;
170  3                   call send_data(13H);
171  3                   call send_data(red_color);
172  3                   call send_data(blue_green);
173  3                   end;

174  2                do i = 248 to 254;
175  3                   red_color = 0000H or double(i);
176  3                   blue_green = 0000H;
177  3                   call send_data(13H);
178  3                   call send_data(red_color);
179  3                   call send_data(blue_green);
180  3                   end;

                /* MAKE COLOR 179 RED */
181  2                call send_data(13H);
182  2                call send_data(0FFB3H);
183  2                call send_data(0);
184  2                call send_data(13H);
185  2                call send_data(0FF6fh);
186  2                call send_data(00FFH);

                /* SWITCH TO OPAQUE 2 AND SPECIFY OPAQUE OR TRANSPARENT */
187  2                call send_data(25);
188  2                call send_data(4);
189  2                call send_data(11dH);
190  2                call send_data(0ff00h);
191  2                call send_data(0ffffh);      /* colors 0   -  15     opaque */
192  2                call send_data(0ffffh);      /* colors 16  -  31     opaque */
193  2                call send_data(0ffffh);      /* colors 32  -  47     opaque */
194  2                call send_data(0ffffh);      /* colors 48  -  63     opaque */
195  2                call send_data(0ffffh);      /* colors 64  -  79     opaque */
196  2                call send_data(0ffffh);      /* colors 80  -  95     opaque */
197  2                call send_data(0ffffh);      /* colors 96  -  111    opaque */
198  2                call send_data(0ffffh);      /* colors 112 -  127    opaque */
199  2                call send_data(0ffffh);      /* colors 128 -  143    opaque */
200  2                call send_data(0ffffh);      /* colors 144 -  159    opaque */
201  2                call send_data(0ffffh);      /* colors 160 -  175    opaque */
202  2                call send_data(0ffffh);      /* colors 176 -  191    opaque */
203  2                call send_data(0ffffh);      /* colors 192 -  207    opaque */
204  2                call send_data(0ffffh);      /* colors 208 -  223    opaque */
205  2                call send_data(0ffffh);      /* colors 224 -  239    opaque */
206  2                call send_data(00001h);      /* colors 240 -  254    transparent */
                                                  /* color 255 opaque */
207  2        end set_color_table;

                /***************** SHOW COLOR TABLE ******************************/

208  1        show_color_table: procedure public;

209  2              declare  color   word,
                              top     word,
                              i       word,
                              temp    word;

210  2              call clear_screen;
211  2              call box(255,0,0,639,479);
212  2              call write_ln(@('colors 0 to 129'),15);
213  2              top = 470;
214  2              do i = 0 to 12;
215  3                call box( i*10 + 0, 50,  top - 30, 100, top);
216  3                call box( i*10 + 1, 100, top - 30, 150, top);
217  3                call box( i*10 + 2, 150, top - 30, 200, top);
218  3                call box( i*10 + 3, 200, top - 30, 250, top);
219  3                call box( i*10 + 4, 250, top - 30, 300, top);
220  3                call box( i*10 + 5, 300, top - 30, 350, top);
221  3                call box( i*10 + 6, 350, top - 30, 400, top);
222  3                call box( i*10 + 7, 400, top - 30, 450, top);
223  3                call box( i*10 + 8, 450, top - 30, 500, top);
224  3                call box( i*10 + 9, 500, top - 30, 550, top);
225  3                top = top - 30;
226  3                end;
227  2              do while not csts;
228  3                end;
```

```
229  2          call write_ln(@(cr,lf,'colors 130 to 239'),19);
230  2          top = 470;
231  2          do i = 13 to 23;
232  3            call box( i*10 + 0, 50,  top - 30, 100, top);
233  3            call box( i*10 + 1, 100, top - 30, 150, top);
234  3            call box( i*10 + 2, 150, top - 30, 200, top);
235  3            call box( i*10 + 3, 200, top - 30, 250, top);
236  3            call box( i*10 + 4, 250, top - 30, 300, top);
237  3            call box( i*10 + 5, 300, top - 30, 350, top);
238  3            call box( i*10 + 6, 350, top - 30, 400, top);
239  3            call box( i*10 + 7, 400, top - 30, 450, top);
240  3            call box( i*10 + 8, 450, top - 30, 500, top);
241  3            call box( i*10 + 9, 500, top - 30, 550, top);
242  3            top = top - 30;
243  3            end;
244  2          do while not csts;
245  3            end;
246  2          call box(255,0,0,639,479);
247  2          do while not csts;
248  3            end;
249  2      end show_color_table;

        /*********** COLOR TABLE FOR BEST DIGITIZATION **********************/

250  1      clt332: procedure public;

251  2              declare   (ir, ig, ib, color,red,green,blue)   word;

252  2              call send_data(25);
253  2              call send_data(0);
254  2              do ir = 0 to 7;
255  3                 do ig = 0 to 7;
256  4                    do ib = 0 to 3;
257  5                       color = (ir*20H) + (ig*4) + ib;
258  5                       red = (3 + 36*ir);
259  5                       green = (3 + 36*ig);
260  5                       blue = (85*ib);
261  5                       call send_data(13H);
262  5                       red = shl(red,8);
263  5                       red = red or color;
264  5                       call send_data(red);
265  5                       blue = shl(blue,8);
26   5                       blue = blue or green;
26   5                       call send_data(blue);
26   5                       end;
269  4                    end;
270  3                 end;
271  2      end clt332;

272  1      show_clt332: procedure public;

273  2              declare   (ir, ig, ib, color,red,green,blue)   word;

274  2              call clear_screen;
275  2              do ir = 0 to 7;
276  3                 do ig = 0 to 7;
277  4                    do ib = 0 to 3;
278  5                       color = (ir*20H) + (ig*4) + ib;
279  5                       red = (3 + 36*ir);
280  5                       green = (3 + 36*ig);
281                          blue = (85*ib);
28                           call box(color,100,100,400,300);
283  5                       call decw_out(color);
284  5                       call co(' ');
285  5                       call co(' ');
286  5                       call co(' ');
287  5                       call co(' ');
288  5                       call co(' ');
289  5                       call co('r');
290  5                       call decw_out(red);
291  5                       call co(' ');
292  5                       call co(' ');
293  5                       call co(' ');
294  5                       call co(' ');
295  5                       call co('g');
296  5                       call decw_out(green);
297  5                       call co(' ');
298  5                       call co(' ');
299  5                       call co(' ');
300  5                       call co(' ');
301  5                       call co('b');
3    5                       call decw_out(blue);
3    5                       call co(' ');
304  5                       call co(' ');
305  5                       call co(' ');
306  5                       call co(' ');
307  5                       call co(cr);
308  5                       call co(lf);
309  5                       do while not csts;
310  6                          end;
311  5                       end;
312  4                    end;
```

```
313  3                end;
314  2        end show_clt332;

              /************** DIGITIZE IMAGE ************************/

315  1        flash: procedure public;
316  2            call send_data(7);
317  2            call send_data(0);
318  2            call send_data(479);
319  2            call send_data(0);
320  2            call send_data(479);
321  2            call send_data(639);
322  2            call send_data(0);
323  2        end flash;

324  1        write_data: procedure (buff_p, buff_len);
325  2                    declare  buff_p                    pointer,
                                  (buff based buff_p) (1)   word,
                                  (buff_len, i)             word;

326  2                    if buff_len <= 0 then return;
328  2                    do i = 0 to (buff_len - 1);
329  3                      do while not shr(inword(csr), 7);
330  4                        end;
331  3                      outword(cdr) = buff(i);
332  3                      END;
333  2        end write_data;

              /* this routine sends a word of data to the parallax board */
334  1        send_data: procedure (i);
335  2                   declare  i  word;
336  2                   do while not shr(inword(csr), 7);
337  3                     end;
338  2                   outword(cdr) = i;
339  2        end send_data;

340  1        vec: procedure(c,x0,y0,x1,y1) public;
341  2             declare  (c,x0,y0,x1,y1)  word;

342  2             do while not shr(inword(csr), 7);
343  3                end;
344  2             outword(cdr) = 08h;
345  2             outword(cdr) = c;
346  2             outword(cdr) = x0;
347  2             outword(cdr) = y0;
348  2             outword(cdr) = x1;
349  2             outword(cdr) = y1;
350  2        end vec;

351  1        box: procedure(c,x0,y0,x1,y1) public;
352  2             declare (c,x0,y0,x1,y1)  word;

353  2             do while not shr(inword(csr), 7);
354  3               end;
355  2             outword(cdr) = 04h;
356  2             outword(cdr) = c;
357  2             outword(cdr) = x0;
358  2             outword(cdr) = y0;
359  2             outword(cdr) = x1;
360  2             outword(cdr) = y1;
361  2        end box;

362  1        boxo: procedure(c,x0,y0,x1,y1) public;
363  2              declare (c,x0,y0,x1,y1) word;

364  2              do while not shr(inword(csr), 7);
365  3                end;
366  2              outword(cdr) = 104h;
367  2              outword(cdr) = c;
368  2              outword(cdr) = x0;
369  2              outword(cdr) = y0;
370  2              outword(cdr) = x1;
371  2              outword(cdr) = y1;
372  2        end boxo;
373  1        boxs: procedure(xs,ys,x0,y0,x1,y1) public;
374  2             declare (xs,ys,x0,y0,x1,y1)  word;

375  2             do while not shr(inword(csr), 7);
376  3               end;
377  2             outword(cdr) = 204h;
378  2             outword(cdr) = xs;
379  2             outword(cdr) = ys;
380  2             outword(cdr) = x0;
381  2             outword(cdr) = y0;
382  2             outword(cdr) = x1;
383  2             outword(cdr) = y1;
384  2        end boxs;

385  1        boxc: procedure(xs,ys,x0,y0,x1,y1) public;
386  2              declare (xs,ys,x0,y0,x1,y1) word;

387  2              do while not shr(inword(csr), 7);
388  3                end;
```

```
389  2          outword(cdr) = 304h;
390  2          outword(cdr) = xs;
391  2          outword(cdr) = ys;
392  2          outword(cdr) = x0;
393  2          outword(cdr) = y0;
394  2          outword(cdr) = x1;
395  2          outword(cdr) = y1;
396  2     end boxc;

397  1     circ: procedure(c,r,x,y) public:

398  2          declare (c,r,x,y)  word;

399  2          do while not shr(inword(csr), 7);
400  3            end;
401  2          outword(cdr) = 02h;
402  2          outword(cdr) = c;
403  2          outword(cdr) = r;
404  2          outword(cdr) = x;
405  2          outword(cdr) = y;
406  2     end circ;

407  1     circo: procedure(c,r,x,y) public;
408  2            declare (c,r,x,y)  word;

409  2            do while not shr(inword(csr), 7);
410  3              end;
411  2            outword(cdr) = 102h;
412  2            outword(cdr) = c;
413  2            outword(cdr) = r;
414  2            outword(cdr) = x;
415  2            outword(cdr) = y;
416  2     end circo;

417  1     circs: procedure(xs,ys,r,x,y) public;
418  2            declare (xs,ys,r,x,y)  word;

419  2            do while not shr(inword(csr), 7);
420  3              end;
421  2            outword(cdr) = 202h;
422  2            outword(cdr) = xs;
423  2            outword(cdr) = ys;
424  2            outword(cdr) = r;
425  2            outword(cdr) = x;
426  2            outword(cdr) = y;
427  2     end circs;

428  1     circc: procedure(xs,ys,r,x,y) public;
429  2            declare (xs,ys,r,x,y)  word;

430  2            do while not shr(inword(csr), 7);
431  3              end
432  2            outword(cdr) = 202h;
433  2            outword(cdr) = xs;
434  2            outword(cdr) = ys;
435  2            outword(cdr) = r;
436  2            outword(cdr) = x;
437  2            outword(cdr) = y;
438  2     end circc;

439  1     tri: procedure(c,x1,y1,x2,y2,x3,y3) public;
440  2          declare (c,x1,y1,x2,y2,x3,y3)   word;
441  2          do while not shr(inword(csr), 7);
442  3            end;
443  2          outword(cdr) = 1h;
444  2          outword(cdr) = c;
445  2          outword(cdr) = 3;
446  2          outword(cdr) = x1;
447  2          outword(cdr) = y1;
448  2          outword(cdr) = x2;
449  2          outword(cdr) = y2;
450  2          outword(cdr) = x3;
451  2          outword(cdr) = y3;
452  2     end tri;

453  1     trio: procedure(c,x1,y1,x2,y2,x3,y3) public;
454  2           declare (c,x1,y1,x2,y2,x3,y3)   word;

455  2           do while not shr(inword(csr), 7);
456  3             end;
457  2           outword(cdr) = 101h;
458  2           outword(cdr) = c;
459  2           outword(cdr) = 3;
460  2           outword(cdr) = x1;
461  2           outword(cdr) = y1;
462  2           outword(cdr) = x2;
463  2           outword(cdr) = y2;
464  2           outword(cdr) = x3;
465  2           outword(cdr) = y3;
466  2     end trio;

467  1     tris: procedure(xs,ys,x1,y1,x2,y2,x3,y3) public;
468  2           declare (xs,ys,x1,y1,x2,y2,x3,y3)   word;
```

```
469  2          do while not shr(inword(csr), 7);
470  3            end;
471  2          outword(cdr) = 201h;
472  2          outword(cdr) = xs;
473  2          outword(cdr) = ys;
474  2          outword(cdr) = 3;
475  2          outword(cdr) = x1;
476  2          outword(cdr) = y1;
477  2          outword(cdr) = x2;
478  2          outword(cdr) = y2;
479  2          outword(cdr) = x3;
480  2          outword(cdr) = y3;
481  2      end tris;

482  1      tric: procedure(xs,ys,x1,y1,x2,y2,x3,y3) public;
483  2          declare (xs,ys,x1,y1,x2,y2,x3,y3)   word;

484  2          do while not shr(inword(csr), 7);
485  3            end;
486  2          outword(cdr) = 301h;
487  2          outword(cdr) = xs;
488  2          outword(cdr) = ys;
489  2          outword(cdr) = 3;
490  2          outword(cdr) = x1;
491  2          outword(cdr) = y1;
492  2          outword(cdr) = x2;
493  2          outword(cdr) = y2;
494  2          outword(cdr) = x3;
495  2          outword(cdr) = y3;
496  2      end tric;

497  1      polyo5: procedure (c,x1,y1,x2,y2,x3,y3,x4,y[illegible]5) public;
498  2          declare (c,x1,y1,x2,y2,x3,y3,x4,y4,x5,[illegible] word;

499  2          do while not shr(inword(csr), 7);
500  3            end;
501  2          outword(cdr) = 101h;
502  2          outword(cdr) = c;
503  2          outword(cdr) = 5;
504  2          outword(cdr) = x1;
505  2          outword(cdr) = y1;
506  2          outword(cdr) = x2;
507  2          outword(cdr) = y2;
508  2          outword(cdr) = x3;
509  2          outword(cdr) = y3;
510  2          outword(cdr) = x4;
511  2          outword(cdr) = y4;
512  2          outword(cdr) = x5;
513  2          outword(cdr) = y5;
514  2      end polyo5;

515  1      poly5: procedure (c,x1,y1,x2,y2,x3,y3,x4,y4,x5,y5) public;
516  2          declare (c,x1,y1,x2,y2,x3,y3,x4,y4,x5,y5)  word;

517  2          do while not shr(inword(csr), 7);
518  3            end;
519  2          outword(cdr) = 1;
520  2          outword(cdr) = c;
521  2          outword(cdr) = 5;
522  2          outword(cdr) = x1;
523  2          outword(cdr) = y1;
524  2          outword(cdr) = x2;
525  2          outword(cdr) = y2;
526  2          outword(cdr) = x3;
527  2          outword(cdr) = y3;
528  2          outword(cdr) = x4;
529  2          outword(cdr) = y4;
530  2          outword(cdr) = x5;
531  2          outword(cdr) = y5;
532  2      end poly5;

533  1      zoom: procedure(xz,yz) public;
534  2          declare (xz,yz) byte,
                       zoom    word;

535  2          do while not shr(inword(csr), 7);
536  3            end;
537  2          zoom = shl(double(xz),8);
538  2          zoom = zoom or double(yz);
539  2          outword(cdr) = 10h;
540  2          outword(cdr) = zoom;
541  2      end zoom;

542  1      pan: procedure(xl,yt) public;
543  2          declare(xl,yt) word;

544  2          do while not shr(inword(csr), 7);
545  3            end;
546  2          outword(cdr) = 11h;
547  2          outword(cdr) = xl;
548  2          outword(cdr) = yt;
549  2      end pan;
```

```
550  1     tranw: procedure(xo,yo) public;
551  2          declare(xo,yo) word;

552  2          do while not shr(inword(csr), 7);
553  3            end;
554  2          outword(cdr) = 1cH;
555  2          outword(cdr) = xo;
556  2          outword(cdr) = yo;
557  2     end tranw;

558  1     set_color: procedure(c,r,g,b) public;

559  2          declare  (c,r,g,b) word;
560  2          call send_data(13H);
561  2          r = shl(r,8) or c;
562  2          b = shl(b,8) or g;
563  2          call send_data(r);
564  2          call send_data(g);
565  2     end set_color;

566  1     screen_ln: procedure(pntr,length,row,cf,cb) public;

567  2          declare  pntr            pointer, /* pointer to asci byte string */
                      (b based pntr) (1) byte, /* asci string */
                      length           word,    /* length of string, 8 X 10 pix */
                      row              word,
                      cf               word,
                      cb               word,
                      x                word,
                      xe               word,
                      y                word;

568  2          declare  i        word,
                      j        word,
                      a        word,
                      pck      word,
                      evn_flg  byte;

569  2          if length = 0 then return;
571  2          if length then do;
573  3            i = length/2 + 1;
574  3            evn_flg = false;
575  3            end;
576  2          else do;
577  3            i = length/2;
578  3            evn_flg = true;
579  3            end;

580  2          if row > 8 then row = 0;
582  2          x = 15;
583  2          xe = 20 + (8 * length);
584  2          y = 460 - 15 * row;
585  2          do while not shr(inword(csr), 7);
586  3            end;
587  2          call box(cb,5,y-1,xe,y+13);
588  2          call send_data(5);
589  2          call send_data(cf);
590  2          call send_data(x);
591  2          call send_data(y);
592  2          call send_data(length);
593  2          a = 0;

594  2          do j = 0 to (i-1);
595  3            if evn_flg then do;
597  4              pck = b(a+1);
598  4              pck = shl(pck,8) or b(a);
599  4              call send_data(pck);
600  4              end;
601  3            else do;
602  4              if a+1 > length-1 then pck = b(a);
604  4              else do;
605  5                pck = b(a+1);
606  5                pck = shl(pck,8) or b(a);
607  5                end;
608  4              call send_data(pck);
609  4              end;
610  3            a = a + 2;
611  3            end;
612  2     end screen_ln;

613  1     clr_fcounter: procedure public;
614  2          do while not shr(inword(csr), 7);
615  3            end;
616  2          call send_data(012BH);
617  2     end clr_fcounter;

618  1     read_fcounter: procedure word public;
619  2          do while not shr(inword(csr), 7);
620  3            end;
621  2          call send_data(002BH);
622  2          return inword(cdr);
```

```
623   2      end read_fcounter;

624   1      end parallax_subs;


MODULE INFORMATION:

     CODE AREA SIZE     = 0DC8H   3528D
     CONSTANT AREA SIZE = 0022H     34D
     VARIABLE AREA SIZE = 0046H     70D
     MAXIMUM STACK SIZE = 0020H     32D
     870 LINES READ
     0 PROGRAM WARNINGS
     0 PROGRAM ERRORS

DICTIONARY SUMMARY:

     288KB MEMORY AVAILABLE
     16KB MEMORY USED   (5%)
     0KB DISK SPACE USED

END OF PL/M-286 COMPILATION

            $debug optimize(3)
  1         gun_align: do;

            $include (:LIB:literal.inc)
          * $nolist
            $include (:LIB:sys_calls.inc)
          * $nolist
            $include (:LIB:serialio.inc)
          * $nolist
            $include (:LIB:parallax.inc)
          * $nolist

            /************* DT311 I/O PORT ADDRESSING ************************************/

210   1     declare   dt311_ch_sel    lit   '5020H',  /* write channel number            */
                      dt311_dhigh     lit   '5020H',  /* read high byte (reset board)    */
                      dt311_stat      lit   '5022H';  /* read status/low data
                                                        bit 7 - d3  low data
                                                            6 - d2
                                                            5 - d1
                                                            4 - d0
                                                            3 - EXP    (expander board);
                                                            2 - START  (sample/hold);
                                                            1 - BUSY
                                                            0 - EOC/   (end of conv)     */
            /*****************************************************************************/

            /* global variable used for reading and boresighting mk19 */

211   1     declare          xval     word   public,
                             yval     word   public,
                             xrel     real   public,
                             yrel     real   public,
                             xout     word   public,
                             yout     word   public,
                             xscale   real   public,
                             yscale   real   public,
                             xoff     real   public,
                             yoff     real   public;

            /*****************************************************************************/
            /* routine to draw alignment crosshairs */

212   1     crosshairs: procedure public;
213   2         call circ(215,20,80,150);
214   2         call circ(215,20,560,430);
215   2         call vec(0,60,150,100,150);
216   2         call vec(0,80,130,80,170);
217   2         call vec(0,540,430,580,430);
218   2         call vec(0,560,410,560,450);
219   2     end crosshairs;

            /*****************************************************************************/
            /* routine to reset dtx311 board */

220   1     dtx311_reset: procedure public;
221   2         declare   stat   byte;
222   2         stat = input(dt311_dhigh);
223   2         stat = input(dt311_stat);
224   2     end dtx311_reset;

            /*****************************************************************************/
            /* THIS ROUTINE BORESIGHTS THE GUN TO THE CURRENT TV POSITION BY:

                    1. Reading a/d converter output when aiming at 80,50 and 560,430.

                    2. From these values scale factors are determined by dividing the
                       change in a/d converter values in a direction by the change in
                       pixel values in that same direction.
```

3. Offsets in a/d converter values are then determined by calculating a/d converter values for a 80,50 point using the scale factors, and subtracting these from those actually read from the a/d converter when pointing at that position.

```
*/
boresight: procedure public:
      declare   point1 dword,
                point2 dword,
                stat   word,
                x1     word,
                y1     word,
                xh     word,
                yh     word;

      call crosshairs;
      call clear_screen;
      call write_ln(@('aim at lower left circle and hit any key ',cr,lf),43);
      do while not csts;
        call rq$sleep(1,@stat);
        end;

      point1 = xy_gun;              /* read gun */
      x1 = high(point1);
      y1 = low(point1);

      call write_ln(@('gun coordinates read  '),22);
      call decw_out(x1);
      call co(',');
      call decw_out(y1);
      call co(cr);
      call co(lf);

      call write_ln(@('aim at upper right circle and hit any key',cr,lf),43);
      do while not csts;
        call rq$sleep(1,@stat);
        end;

      point2 = xy_gun;
      xh = high(point2);
      yh = low(point2);

      call write_ln(@('gun coordinates read  '),22);
      call decw_out(xh);
      call co(',');
      call decw_out(yh);

/* calculate scale factors */
      xscale = 480./float(signed(xh - x1));
      yscale = 280./float(signed(yh - y1));

/* calculate offsets by using scale factors and projecting for (100,125) coordinates */

      xoff = (xscale * float(signed(x1)) - 80.)/xscale;
      yoff = (yscale * float(signed(y1)) - 150.)/yscale;

      call write_ln(@(cr,lf,'xscale =  '),12);
      call output_fp(xscale);
      call write_ln(@(' pixels/ adc1 units',cr,lf,'yscale =  '),31);
      call output_fp(yscale);
      call write_ln(@(' pixels/ adc0 units',cr,lf,'xoff =  '),29);
      call output_fp(xoff);
      call write_ln(@(' adc1 units',cr,lf,'yoff =  '),21);
      call output_fp(yoff);
      call write_ln(@(' adc0 units',cr,lf),13);
      call write_ln(@('hit any key to continue'),23);
      do while not csts;
         call rq$sleep(1,@stat);
      end;

end_boresight;

/*****************************************************************************/
/* routine to read a/d converter and return (x,y) */

xy_gun: procedure dword public:

      declare  xyvalue  dword,
               stat     byte,
               dlow     word,
               dhigh    word,
               xvalue   word,
               yvalue   word;

      output(dt311_ch_sel) = 01;        /* select channel 1   */
      stat = 1;
      do while stat;
        stat = input(dt311_stat);
        end;
```

```
278   2          dlow = double(shr(stat,4));
279   2          dhigh = input(dt311_dhigh);
280   2          xvalue = double(dhigh);
281   2          xvalue = (shl( xvalue,4) or dlow );

282   2          output(dt311_ch_sel) = 00;       /* select channel 0        */
283   2          stat = 1;
284   2          do while stat;
285   3            stat = input(dt311_stat);
286   3            end;
287   2          dlow = double(shr(stat,4));
288   2          dhigh = input(dt311_dhigh);
289   2          yvalue = double(dhigh);
290   2          yvalue = ( shl(yvalue,4) or dlow );

291   2          xyvalue = shl(double(xvalue),16);
292   2          xyvalue = xyvalue or double(yvalue);
293   2          return xyvalue;
294   2      end xy_gun;

             /*****************************************************************************/
             /* this procedure returns in two integers the x,y location in pixels of where
                the gun is pointing with respect to the screen                            */

295   1      xy_screen: procedure dword public;

296   2            declare    xygun dword,
                             xgun  word,
                             ygun  word,
                             xrel  word,
                             yrel  word;

297   2            xygun = xy_gun;      /* get gun position */
298   2            xgun = high(xygun);
299   2            ygun = low(xygun);
300   2            xrel = unsign(fix((float(signed(xgun)) - xoff) * xscale));
301   2            yrel = unsign(fix((float(signed(ygun)) - yoff) * yscale));
302   2            xygun = shl(double(xrel),16);
303   2            xygun = xygun or double(yrel);
304   2            return xygun;
305   2      end xy_screen;

306   1      end gun_align;
```

MODULE INFORMATION:

```
     CODE AREA SIZE     = 03B8H    952D
     CONSTANT AREA SIZE = 0113H    275D
     VARIABLE AREA SIZE = 004EH     78D
     MAXIMUM STACK SIZE = 001AH     26D
     575 LINES READ
     0 PROGRAM WARNINGS
     0 PROGRAM ERRORS
```

DICTIONARY SUMMARY:

```
     288KB MEMORY AVAILABLE
     18KB MEMORY USED   (6%)
     0KB DISK SPACE USED
```

END OF PL/M-286 COMPILATION

```
             $debug optimize(3)

  1          menu: do;

             $include (:LIB:literal.inc)
         =   $nolist
             $include (:LIB:sys_calls.inc)
         =   $nolist
             $include (:LIB:serialio.inc)
         =   $nolist
             $include (:LIB:parallax.inc)
         =   $nolist
             $include (:LIB:sbx351.inc)
210   1 =   setup_sbx351_clock: procedure external;
211   2 =   end setup_sbx351_clock;

212   1 =   read_sbx351_clock: procedure word external;
213   2 =   end read_sbx351_clock;

214   1 =   read_sbx351_clk1: procedure word external;
215   2 =   end read_sbx351_clk1;
             $include (:LIB:input.inc)
         =   $nolist
             $include (gunalign.inc)

         =   /* global variable used for reading and boresighting mk19 */
226   1 =   declare          xval     word   external,
```

```
=                yval     word   external,
=                xrel     real   external,
=                yrel     real   external,
=                xout     word   external,
=                yout     word   external,
=                xscale   real   external,
=                yscale   real   external,
=                xoff     real   external,
=                yoff     real   external;

=   $nolist

    /**********external VARIABLE DECLARATIONS ************************************/

237  1   declare  rnd(48)  structure ( flag      byte,
                                       cnt       byte,
                                       exptype   word,
                                       range     word,
                                       t_start   word,
                                       x         integer,
                                       y_start   integer,
                                       v_fall    real,
                                       y_strike  integer,
                                       age       word)    external;

238  1   declare  ping_flag  byte external,
                ammoflag   byte external,
                autoreload byte external,
                hit_level  byte external,
                w5mpnts    word external,
                w15mpnts   word external,
                w60mpnts   word external,
                exp_gun    word external,
                gun_agun   word external,
                agun_bgun  word external,
                pause      byte external,
                count      word external;

    /*****************************************************************************/

239  1   get_parameters: procedure external;
240  2   end get_parameters;

241  1   save_parameters: procedure external;
242  2   end save_parameters;

243  1   set_default: procedure external;
244  2   end set_default;

    /*****************************************************************************/

245  1   ntsc_logo: procedure public;

246  2         declare     done    byte;

247  2         ammoflag = 1;
248  2         count = 0;
249  2         rnd(0).flag = 0;
250  2         call send_data(02aH);
251  2         call pan(0,479);
252  2         call zoom(3.3);
253  2         call box(100,0,300,220,480);
254  2         call time(5000);
255  2         call screen_ln(@('************************'),23,0,0,14);
256  2         call screen_ln(@('*    NTSC  M-CAT       *'),23,1,0,14);
257  2         call screen_ln(@('*    Minor Caliber     *'),23,2,0,14);
258  2         call screen_ln(@('*    Weapons Trainer   *'),23,3,0,14);
259  2         call screen_ln(@('*                      *'),23,4,0,14);
260  2         call screen_ln(@('*    Machine Gun       *'),23,5,0,14);
261  2         call screen_ln(@('*    40 mm. MK-19      *'),23,6,0,14);
262  2         call screen_ln(@('************************'),23,7,0,14);
263  2         call screen_ln(@(' push trigger to start '),23,8,0,100);
264  2         done = false;
265  2         do while not done;
266  3           if rnd(0).flag <> 0 then done = true;
268  3           if csts then done = true;
270  3           end;
271  2   end ntsc_logo;

    /******************* OPERATOR FUNCTIONS ************************************/

272  1   declare     level   integer;

    /*************************************/
273  1   display_functions: procedure;
274  2       call clear_screen;
275  2       call write_ln(@(      'OPERATOR FUNCTIONS      current        ',CR,LF,CR,LF),43);
276  2       call write_ln(@(      '1 - set skill level       '),26);
277  2       call decw_out(double(hit_level));
278  2       call write_ln(@(cr,lf,'2 - set auto reload       '),28);
279  2       if autoreload then call write_ln(@('ON'),2);
281  2       else call write_ln(@('OFF'),3);
282  2       call write_ln(@(cr,lf,'3 - set display pause     '),28);
283  2       if pause then call write_ln(@('ON'),2);
```

```
285  2          else call write_ln(@('OFF'),3);
286  2          call write_ln(@(cr,lf,'4 - set 5m  points         '),28);
287  2          call decw_out(w5mpnts);
288  2          call write_ln(@(cr,lf,'5 - set 15m points         '),28);
289  2          call decw_out(w15mpnts);
290  2          call write_ln(@(cr,lf,'6 - set 60m points         '),28);
291  2          call decw_out(w60mpnts);
292  2          call write_ln(@(cr,lf,cr,lf),4);
293  2          call write_ln(@(cr,lf,'7 - set gunner ratings   (avg rounds)/(kill)'),46);
294  2          call write_ln(@(cr,lf,'          expert              <=  '),36);
295  2          call decw_out(exp_gun);
296  2          call write_ln(@(cr,lf,'          gunner              <=  '),36);
297  2          call decw_out(gun_agun);
298  2          call write_ln(@(cr,lf,'          assist. gunner      <=  '),36);
299  2          call decw_out(agun_bgun);
300  2          call write_ln(@(cr,lf,'          beginner             >  '),36);
301  2          call decw_out(agun_bgun);
302  2          call write_ln(@(cr,lf,cr,lf),4);
303  2          call write_ln(@(cr,lf,'8 - set parameters to default'),31);
304  2          call write_ln(@(cr,lf,'9 - get parameters (setup.dat)'),32);
305  2          call write_ln(@(cr,lf,'A - save parameters (setup.dat)'),33);
306  2          call write_ln(@(cr,lf,'B - standby (screen saver)'),28);
307  2          call co(cr);
308  2          call co(lf);
309  2      end display_functions;

             /*************************************/
310  1      diff_level: procedure;

311  2      get_level:
             call clear_screen;
312  2          call write_ln(@('ENTER LEVEL OF DIFFICULTY',CR,LF,
                                '    level          active hit areas',cr,lf,
                                '     "1"              5m, 15m, 60m ',cr,lf,
                                '     "2"              5m, 15m',cr,lf,
                                '     "3"              5m',cr,lf,cr,lf,
                                '==> '),164);
313  2          level = input_integer;

314  2          if ((level <> 1) and ((level <> 2) and (level <> 3))) then goto get_level;
316  2          hit_level = low(unsign(level));
317  2      end diff_level;

             /*************************************/
318  1      auto_reload: procedure;

319  2      get_reload:
             call clear_screen;
320  2          call write_ln(@('AUTO RELOAD',cr,lf,
                                ' "1" - ON  (48 rounds each target)',cr,lf,
                                ' "0" - OFF (48 rounds / then reload)',cr,lf,cr,lf,
                                '==> '),93);
321  2          level = input_integer;
322  2          if ((level <> 1) and (level <> 0)) then goto get_reload;
324  2          if (level = 1) then autoreload = true;
326  2          else autoreload = false;
327  2      end auto_reload;

             /*************************************/
328  1      set_pause: procedure;

329  2      get_pause:
             call clear_screen;
330  2          call write_ln(@('PAUSE',cr,lf,
                                ' "1" - ON  (show statistics for each target and',cr,lf,
                                '            pause until key hit or trigger pulled)',cr,lf,
                                ' "0" - OFF',CR,LF,cr,lf,
                                '==> '),126);
331  2          level = input_integer;
332  2          if ((level <> 1) and (level <> 0)) then goto get_pause;
334  2          if (level = 1) then pause = true;
336  2          else pause = false;
337  2      end set_pause;

             /*************************************/
338  1      in5m_points: procedure;

339  2      get_5mpnts:
             call clear_screen;
340  2          call write_ln(@('ENTER POINTS FOR A ROUND WITHIN 5 METERS RADIUS',CR,LF,
                                '40 points destroy target',cr,lf,
                                '20 points damage target',cr,lf,
                                '( POINTS  1 - 40 )',CR,LF,cr,lf,
                                '==> '),126);
341  2          level = input_integer;
342  2          if ((level < 1) or (level > 40)) then goto get_5mpnts;
344  2          w5mpnts = unsign(level);
345  2      end in5m_points;

             /*************************************/
346  1      in15m_points: procedure;
```

```
347  2      get_15mpnts:
                call clear_screen;
348  2          call write_ln(@('ENTER POINTS FOR A ROUND WITHIN 15 METERS RADIUS',CR,LF,
                                '40 points destroy target',cr,lf,
                                '20 points damage target',cr,lf,
                                '( POINTS  1 - 40 )',CR,LF,cr,lf,
                                '==> '),127);
349  2          level = input_integer;
350  2          if ((level < 1) or (level > 40)) then goto get_15mpnts;
352  2          w15mpnts = unsign(level);
353  2      end in15m_points;

            /*************************************/
354  1      in60m_points: procedure;

355  2      get_60mpnts:
                call clear_screen;
356  2          call write_ln(@('ENTER POINTS FOR A ROUND WITHIN 60 METERS RADIUS',CR,LF,
                                '40 points destroy target',cr,lf,
                                '20 points damage target',cr,lf,
                                '( POINTS  1 - 40 )',CR,LF,cr,lf,
                                '==> '),127);
357  2          level = input_integer;
358  2          if ((level < 1) or (level > 40)) then goto get_60mpnts;
360  2          w60mpnts = unsign(level);
361  2      end in60m_points;

            /*************************************/
362  1      set_ratings: procedure;

363  2      set_1:
                call clear_screen;
364  2          call write_ln(@('RATING BASED ON AVERAGE NUMBER OF ROUNDS PER',CR,LF,
                                'DESTROYED TARGET IN A SCENERIO',CR,LF,CR,LF,CR,LF,
                                'ENTER MAXIMUM VALUE FOR EXPERT RATING',CR,LF,
                                '( 1 - 100 )',cr,lf,
                                '==> '),138);
365  2          level = input_integer;
366  2          if ((level < 1) or (level > 100)) then goto set_1;
368  2          exp_gun = unsign(level);

369  2      set_2:
                call clear_screen;
370  2          call write_ln(@('RATING BASED ON AVERAGE NUMBER OF ROUNDS PER',CR,LF,
                                'DESTROYED TARGET IN A SCENERIO',CR,LF,CR,LF,CR,LF,
                                'ENTER MAXIMUM VALUE FOR GUNNER RATING',CR,LF,
                                '( (expert value + 1) to 200 )',cr,lf,
                                '==> '),156);
371  2          level = input_integer;
372  2          if ((level < signed(exp_gun) + 1) or (level > 200)) then goto set_2;
374  2          gun_agun = unsign(level);

375  2      set_3:
                call clear_screen;
376  2          call write_ln(@('RATING BASED ON AVERAGE NUMBER OF ROUNDS PER',CR,LF,
                                'DESTROYED TARGET IN A SCENERIO',CR,LF,CR,LF,CR,LF,
                                'ENTER MAXIMUM VALUE FOR ASSISTANT GUNNER RATING',CR,LF,
                                '( (gunner value + 1) to 300 )',cr,lf,
                                '==> '),166);
377  2          level = input_integer;
378  2          if ((level < signed(gun_agun) + 1) or (level > 300)) then goto set_3;
380  2          agun_bgun = unsign(level);

381  2      end set_ratings;


            /*****************************************************************************/
382  1      menu_select: procedure word public;

383  2          declare   scenerio   word,
                       timer      word,
                       char       byte,
                       donel      byte,
                       done       byte;

384  2          call display_functions;
385  2          call send_data(02aH);
386  2          call pan(0,479);
387  2          call zoom(3,3);
388  2          call box(100,0,300,220,480);
389  2          call time(5000);
390  2          call screen_ln(@('PULL TRIGGER TO SELECT '),23,0,0,100);
391  2          call screen_ln(@('HIGHLIGHTED SCENERIO   '),23,1,0,100);
392  2          call screen_ln(@('1. STATIONARY TARGETS  '),23,2,0,14);
393  2          call screen_ln(@('2. MOVING (INWARD)     '),23,3,0,14);
394  2          call screen_ln(@('3. MOVING (LATERAL)    '),23,4,0,14);
395  2          call screen_ln(@('4. SKILL LEVEL 1       '),23,5,0,14);
396  2          call screen_ln(@('5. SKILL LEVEL 2       '),23,6,0,14);
397  2          call screen_ln(@('6. SKILL LEVEL 3       '),23,7,0,14);
```

```
398   2            scenerio = 0;
399   2            rnd(0).flag = 0;
400   2            count = 0;
401   2            done = false;
402   2            do while not done;
403   3              do case scenerio;
404   4                call screen_ln(@('1. STATIONARY TARGETS  '),23,2,0,14);
405   4                call screen_ln(@('2. MOVING (INWARD)     '),23,3,0,14);
406   4                call screen_ln(@('3. MOVING (LATERAL)    '),23,4,0,14);
407   4                call screen_ln(@('4. SKILL LEVEL 1       '),23,5,0,14);
408   4                call screen_ln(@('5. SKILL LEVEL 2       '),23,6,0,14);
409   4                call screen_ln(@('6. SKILL LEVEL 3       '),23,7,0,14);
410   4                end;
411   3              scenerio = scenerio + 1;
412   3              if scenerio = 6 then scenerio = 0;
414   3              do case scenerio:
415   4                call screen_ln(@('1. STATIONARY TARGETS  '),23,2,0,180);
416   4                call screen_ln(@('2. MOVING (INWARD)     '),23,3,0,180);
417   4                call screen_ln(@('3. MOVING (LATERAL)    '),23,4,0,180);
418   4                call screen_ln(@('4. SKILL LEVEL 1       '),23,5,0,180);
419   4                call screen_ln(@('5. SKILL LEVEL 2       '),23,6,0,180);
420   4                call screen_ln(@('6. SKILL LEVEL 3       '),23,7,0,180);
421   4                end:
422   3              timer = read_sbx351_clock:
423   3              do while ( read_sbx351_clock - timer ) < 90:
424   4                if rnd(0).flag <> 0 then do:
426   5                  done = true:
427   5                  timer = 0:
428   5                  end;
429   4                if csts then do:
431   5                  if stat_byte = ' ' then do:
433   6                    done = true:
434   6                    timer = 0;
435   6                    end;
436   5                  else if stat_byte = '1' then call diff_level:
438   5                  else if stat_byte = '2' then call auto_reload:
440   5                  else if stat_byte = '3' then call set_pause;
442   5                  else if stat_byte = '4' then call in5m_points:
444   5                  else if stat_byte = '5' then call in15m_points:
446   5                  else if stat_byte = '6' then call in60m_points:
448   5                  else if stat_byte = '7' then call set_ratings:
450   5                  else if stat_byte = '8' then call set_default:
452   5                  else if stat_byte = '9' then call get_parameters;
454   5                  else if stat_byte = 'A' then call save_parameters;
456   5                  else if stat_byte = 'B' then do:
458   6                    call pan(1500,479);
459   6                    call clear_screen;
460   6                    call write_ln(@('hit any key to restore screen'),29);
461   6                    do while not csts;
462   7                      end;
463   6                    call pan(0,479);
464   6                    end;

465   5                  call display_functions:
466   5                  end;
467   4                end;
468   3              end;
469   2              return scenerio;
470   2      end menu_select;

471   1      end menu;
```

```
MODULE INFORMATION:

     CODE AREA SIZE     = 0814H   2068D
     CONSTANT AREA SIZE = 09D0H   2512D
     VARIABLE AREA SIZE = 000CH     12D
     MAXIMUM STACK SIZE = 0014H     20D
     783 LINES READ
     0 PROGRAM WARNINGS
     0 PROGRAM ERRORS

DICTIONARY SUMMARY:

     288KB MEMORY AVAILABLE
     24KB MEMORY USED   (8%)
     0KB DISK SPACE USED

END OF PL/M-286 COMPILATION
     1          sbx351: do;

                $include(:lib:literal.inc)
              = $nolist
                $include(:lib:sys_calls.inc)
              = $nolist

                /* set up for sbx351 */
                /* 8253 counter 2 used to generate baud rate for serial channel (not used) */
                /* counter 1 is used to clock counter 0 which generates a real-time clock  */
```

```
 92   1      declare  temp1   word,
                       temp2   word;

 93   1      declare  no_operation  lit  'temp1 = temp2';

 94   1      declare  usart_data    lit  '080h',
                       usart_status lit  '082h',
                       cntr0_data   lit  '090h',
                       cntr1_data   lit  '092h',
                       cntr2_data   lit  '094h',
                       cntr_ctrl    lit  '096h',
                       cntr_mode    lit  '096h',
                       usart_mode   lit  '04eh',
                       usart_cmnd   lit  '037h',
                       set_count    lit  '004d';  /* determines baud rate
                                                        8 ==> 9600
                                                        4 ==> 19.2
                                                        2 ==> 38.4        */

 95   1      setup_sbx351_clock: procedure public;
 96   2                 output(cntr_ctrl) = 01110110b;
 97   2                 no_operation;
 98   2                 output(cntr1_data) = 026h;
 99   2                 no_operation;
100   2                 output(cntr1_data) = 0A0h;
101   2                 no_operation;
102   2                 output(cntr_ctrl) = 00110110b;
103   2                 no_operation;
104   2                 output(cntr0_data) = 255;
105   2                 no_operation;
106   2                 output(cntr0_data) = 255;
107   2                 no_operation;
108   2      end setup_sbx351_clock;

109   1      read_sbx351_clock: procedure word public;

110   2                 declare    hcount   byte,
                                   lcount   byte,
                                   tcount   word;

111   2                 output(cntr_ctrl) = 00000000b;        /* latch counter 0 */
112   2                 no_operation;
113   2                 lcount = input(cntr0_data);
114   2                 no_operation;
115   2                 hcount = input(cntr0_data);
116   2                 no_operation;
117   2                 tcount = shl(double(hcount),8) or double(lcount);
118   2                 return not(tcount);
119   2      end read_sbx351_clock;

120   1      read_sbx351_clk1: procedure word public;

121   2                 declare    hcount   byte,
                                   lcount   byte,
                                   tcount   word;

122   2                 output(cntr_ctrl) = 01000000b;        /* latch counter 1 */
123   2                 no_operation;
124   2                 lcount = input(cntr1_data);
125   2                 no_operation;
126   2                 hcount = input(cntr1_data);
127   2                 no_operation;
128   2                 tcount = shl(double(hcount),8) or double(lcount);
129   2                 return not(tcount);
130   2      end read_sbx351_clk1;


MODULE INFORMATION:

     CODE AREA SIZE     = 00BCH    188D
     CONSTANT AREA SIZE = 0000H      0D
     VARIABLE AREA SIZE = 000CH     12D
     MAXIMUM STACK SIZE = 0002H      2D
     268 LINES READ
     0 PROGRAM WARNINGS
     0 PROGRAM ERRORS

DICTIONARY SUMMARY:

     288KB MEMORY AVAILABLE
     10KB MEMORY USED   (3%)
     0KB DISK SPACE USED

END OF PL/M-286 COMPILATION
```

```
                $debug optimize(3)
  1             mksetup: do;

                $include(:LIB:literal.inc)
              * $nolist
                $include(:LIB:serialio.inc)
              * $nolist
                $include(:lib:sys_calls.inc)
              * $nolist

121   1         declare  autoreload   byte external,
                       pause         byte external,
                       hit_level     byte external,
                       w60mpnts      word external,
                       w15mpnts      word external,
                       w5mpnts       word external,
                       exp_gun       word external,
                       gun_agun      word external,
                       agun_bgun     word external;

122   1         declare  sfile(10)  byte,
                       error      word,
                       bytesread  word,
                       sfiletok   token;

123   1         get_parameters: procedure public;
124   2                sfiletok = dq$attach (@(9,'setup.dat'), @error);
125   2                call dq$open(sfiletok, 1, 0, @error);
126   2                bytesread = dq$read (sfiletok, @autoreload, 1, @error);
127   2                bytesread = dq$read (sfiletok, @pause, 1, @error);
128   2                bytesread = dq$read (sfiletok, @hit_level, 1, @error);
129   2                bytesread = dq$read (sfiletok, @w60mpnts, 2, @error);
130   2                bytesread = dq$read (sfiletok, @w15mpnts, 2, @error);
131   2                bytesread = dq$read (sfiletok, @w5mpnts, 2, @error);
132   2                bytesread = dq$read (sfiletok, @exp_gun, 2, @error);
133   2                bytesread = dq$read (sfiletok, @gun_agun, 2, @error);
134   2                bytesread = dq$read (sfiletok, @agun_bgun,2, @error);
135   2                call dq$close(sfiletok, @error);
136   2         end get_parameters;

137   1         save_parameters: procedure public;
138   2                sfiletok = dq$create (@(9,'setup.dat'), @error);
139   2                call dq$open(sfiletok, 2, 0, @error);
140   2                call dq$write (sfiletok, @autoreload, 1, @error);
141   2                call dq$write (sfiletok, @pause, 1, @error);
142   2                call dq$write (sfiletok, @hit_level, 1, @error);
143   2                call dq$write (sfiletok, @w60mpnts, 2, @error);
144   2                call dq$write (sfiletok, @w15mpnts, 2, @error);
145   2                call dq$write (sfiletok, @w5mpnts, 2, @error);
146   2                call dq$write (sfiletok, @exp_gun, 2, @error);
147   2                call dq$write (sfiletok, @gun_agun, 2, @error);
148   2                call dq$write (sfiletok, @agun_bgun,2, @error);
149   2                call dq$close(sfiletok, @error);
150   2         end save_parameters;

151   1         set_default: procedure public;
152   2             autoreload = true;
153   2             pause = false;
154   2             hit_level = 2;
155   2             w60mpnts = 2;
156   2             w15mpnts = 10;
157   2             w5mpnts = 20;
158   2             exp_gun = 25;
159   2             gun_agun = 45;
160   2             agun_bgun = 65;
161   2         end set_default;

162   1         end mksetup;


MODULE INFORMATION:

    CODE AREA SIZE     = 02C9H    713D
    CONSTANT AREA SIZE = 0038H     56D
    VARIABLE AREA SIZE = 0010H     16D
    MAXIMUM STACK SIZE = 0014H     20D

    310 LINES READ
    0 PROGRAM WARNINGS
    0 PROGRAM ERRORS

DICTIONARY SUMMARY:

    288KB MEMORY AVAILABLE
    10KB MEMORY USED   (3%)
    0KB DISK SPACE USED

END OF PL/M-286 COMPILATION
```

```
            $debug optimize(3)
  1         mksub: do;

            $include(:LIB:literal.inc)
          * $nolist
            $include(:LIB:serialio.inc)
          * $nolist
            $include(:LIB:parallax.inc)
          * $nolist

125   1     declare   ping_flag    byte   external;

            /*************************************************************************/
            /**************** GRAPHIC SEQUENCES FOR HIT EXPLOSIONS *********************/

126   1     hit: procedure ( r , xi, yi, c) public;

127   2          declare       r     word,
                                yi    integer,
                                xi    integer,
                                c     byte,
                                x     word,
                                y     word,
                                xs    word,
                                xoff  word;

128   2          y = unsign(yi);
129   2          x = unsign(xi);
130   2          xoff = 50 * double(c);
131   2          if r < 100 then do;                    /* exp 1 */
133   3            xs = 731 + xoff;
134   3            call boxc(xs,500,x-19,y-10,x+19,y+20);
135   3            end;
136   2          else if r < 125 then do;               /* exp 2 */
138   3            xs = 734 + xoff;
139   3            call boxc(xs,583,x-16,y-9,x+16,y+18);
140   3            end;
141   2          else if r < 150 then do;               /* exp 3 */
143   3            xs = 736 + xoff;
144   3            call boxc(xs,654,x-14,y-8,x+14,y+16);
145   3            end;
146   2          else if r < 180 then do;                /* exp 4 */
148   3            xs = 739 + xoff;
149   3            call boxc(xs,713,x-11,y-7,x+11,y+14);
150   3            end;
151   2          else if r < 200 then do;                /* exp 5 */
153   3            xs = 741 + xoff;
154   3            call boxc(xs,764,x-9,y-6,x+9,y+13);
155   3            end;
156   2          else if r < 260 then do;                /* exp 6 */
158   3            xs = 742 + xoff;
159   3            call boxc(xs,807,x-7,y-5,x+7,y+12);
160   3            end;
161   2          else if r < 400 then do;                /* exp 7 */
163   3            xs = 743 + xoff;
164   3            call boxc(xs,842,x-6,y-4,x+6,y+11);
165   3            end;
166   2          else if r < 600 then do;                /* exp 8 */
168   3            xs = 744 + xoff;
169   3            call boxc(xs,873,x-5,y-3,x+5,y+10);
170   3            end;
171   2          else do;                                /* exp 9 */
172   3            xs = 745 + xoff;
173   3            call boxc(xs,900,x-4,y-2,x+4,y+9);
174   3            end;
175   2     end hit;

            /*************************************************************************/
            /**************** GRAPHIC SEQUENCES FOR WATER GYSERS ***********************/

176   1     miss: procedure ( exptype , xi, yi, c) public;

177   2          declare       exptype    word,
                                yi         integer,
                                xi         integer,
                                c          byte,
                                x          word,
                                y          word;

178   2          x = unsign(xi);
179   2          y = unsign(yi);
180   2          if c > 19 then c = 0;
182   2          if exptype < 12 then do;
184   3            do case exptype;
185   4              do case(c);                          /* explosion sequence 1 */
186   5                call boxc(81,500,x-19,y,x+19,y+79);
187   5                call boxc(131,500,x-19,y,x+19,y+79);
188   5                call boxc(184,583,x-16,y,x+16,y+67);
189   5                call boxc(181,500,x-19,y,x+19,y+79);
190   5                call boxc(231,500,x-19,y,x+19,y+79);
191   5                call boxc(281,500,x-19,y,x+19,y+79);
192   5                call boxc(331,500,x-19,y,x+19,y+79);
193   5                call boxc(381,500,x-19,y,x+19,y+79);
```

```
194  5          call boxc(284,583,x-16,y,x+16,y+67);
195  5          call boxc(334,583,x-16,y,x+16,y+67);
196  5          call boxc(431,500,x-19,y,x+19,y+79);
197  5          call boxc(434,583,x-16,y,x+16,y+67);
198  5          call boxc(481,500,x-19,y,x+19,y+79);
199  5          call boxc(484,583,x-16,y,x+16,y+67);
200  5          call boxc(534,583,x-16,y,x+16,y+67);
201  5          call boxc(531,500,x-19,y,x+19,y+79);
202  5          call boxc(536,654,x-14,y,x+14,y+55);
203  5          call boxc(539,713,x-11,y,x+11,y+47);
204  5          call boxc(541,764,x-9,y,x+9,y+39);
205  5          call boxc(542,807,x-8,y,x+8,y+31);
206  5          end;
207  4        do case(c);                          /* explosion sequence 2 */
208  5          call boxc(84,583,x-16,y,x+16,y+67);
209  5          call boxc(134,583,x-16,y,x+16,y+67);
210  5          call boxc(186,654,x-14,y,x+14,y+55);
211  5          call boxc(184,583,x-16,y,x+16,y+67);
212  5          call boxc(234,583,x-16,y,x+16,y+67);
213  5          call boxc(284,583,x-16,y,x+16,y+67);
214  5          call boxc(334,583,x-16,y,x+16,y+67);
215  5          call boxc(336,654,x-14,y,x+14,y+55);
216  5          call boxc(384,583,x-16,y,x+16,y+67);
217  5          call boxc(434,583,x-16,y,x+16,y+67);
218  5          call boxc(436,654,x-14,y,x+14,y+55);
219  5          call boxc(484,583,x-16,y,x+16,y+67);
220  5          call boxc(486,654,x-14,y,x+14,y+55);
221  5          call boxc(534,583,x-16,y,x+16,y+67);
222  5          call boxc(536,654,x-14,y,x+14,y+55);
223  5          call boxc(539,713,x-11,y,x+11,y+47);
224  5          call boxc(541,764,x-9,y,x+9,y+39);
225  5          call boxc(542,807,x-8,y,x+8,y+31);
226  5          call boxc(543,842,x-7,y,x+7,y+27);
227  5          call boxc(544,873,x-6,y,x+6,y+23);
228  5          end;
229  4        do case(c);                          /* explosion sequence 3 */
230  5          call boxc(86,654,x-14,y,x+14,y+55);
231  5          call boxc(136,654,x-14,y,x+14,y+55);
232  5          call boxc(189,713,x-11,y,x+11,y+47);
233  5          call boxc(186,654,x-14,y,x+14,y+55);
234  5          call boxc(236,654,x-14,y,x+14,y+55);
235  5          call boxc(286,654,x-14,y,x+14,y+55);
236  5          call boxc(336,654,x-14,y,x+14,y+55);
237  5          call boxc(289,713,x-11,y,x+11,y+47);
238  5          call boxc(339,713,x-11,y,x+11,y+47);
239  5          call boxc(386,654,x-14,y,x+14,y+55);
240  5          call boxc(436,654,x-14,y,x+14,y+55);
241  5          call boxc(486,654,x-14,y,x+14,y+55);
242  5          call boxc(489,713,x-11,y,x+11,y+47);
243  5          call boxc(536,654,x-14,y,x+14,y+55);
244  5          call boxc(539,713,x-11,y,x+11,y+47);
245  5          call boxc(541,764,x-9,y,x+9,y+39);
246  5          call boxc(542,807,x-8,y,x+8,y+31);
247  5          call boxc(543,842,x-7,y,x+7,y+27);
248  5          call boxc(544,873,x-6,y,x+6,y+23);
249  5          call boxc(545,900,x-5,y,x+5,y+19);
250  5          end;
251  4        do case(c);                          /* explosion sequence 4 */
252  5          call boxc(89,713,x-11,y,x+11,y+47);
253  5          call boxc(139,713,x-11,y,x+11,y+47);
254  5          call boxc(191,764,x-9,y,x+9,y+39);
255  5          call boxc(189,713,x-11,y,x+11,y+47);
256  5          call boxc(239,713,x-11,y,x+11,y+47);
257  5          call boxc(291,764,x-9,y,x+9,y+39);
258  5          call boxc(289,713,x-11,y,x+11,y+47);
259  5          call boxc(339,713,x-11,y,x+11,y+47);
260  5          call boxc(389,713,x-11,y,x+11,y+47);
261  5          call boxc(439,713,x-11,y,x+11,y+47);
262  5          call boxc(489,713,x-11,y,x+11,y+47);
263  5          call boxc(536,654,x-14,y,x+14,y+55);
264  5          call boxc(539,713,x-11,y,x+11,y+47);
265  5          call boxc(541,764,x-9,y,x+9,y+39);
266  5          call boxc(542,807,x-8,y,x+8,y+31);
267  5          call boxc(543,842,x-7,y,x+7,y+27);
268  5          call boxc(544,873,x-6,y,x+6,y+23);
269  5          call boxc(545,900,x-5,y,x+5,y+19);
270  5          call boxc(546,923,x-4,y,x+4,y+15);
271  5          call boxc(547,942,x-3,y,x+3,y+12);
272  5          end;
273  4        do case(c);                          /* explosion sequence 5 */
274  5          call boxc(91,764,x-9,y,x+9,y+39);
275  5          call boxc(141,764,x-9,y,x+9,y+39);
276  5          call boxc(192,807,x-8,y,x+8,y+31);
277  5          call boxc(191,764,x-9,y,x+9,y+39);
278  5          call boxc(241,764,x-9,y,x+9,y+39);
279  5          call boxc(291,764,x-9,y,x+9,y+39);
280  5          call boxc(292,807,x-8,y,x+8,y+31);
281  5          call boxc(341,764,x-9,y,x+9,y+39);
282  5          call boxc(342,807,x-8,y,x+8,y+31);
283  5          call boxc(391,764,x-9,y,x+9,y+39);
284  5          call boxc(392,807,x-8,y,x+8,y+31);
285  5          call boxc(441,764,x-9,y,x+9,y+39);
286  5          call boxc(442,807,x-8,y,x+8,y+31);
287  5          call boxc(491,764,x-9,y,x+9,y+39);
```

```
288  5          call boxc(541,764,x-9,y,x+9,y+39);
289  5          call boxc(542,807,x-8,y,x+8,y+31);
290  5          call boxc(543,842,x-7,y,x+7,y+27);
291  5          call boxc(544,873,x-6,y,x+6,y+23);
292  5          call boxc(545,900,x-5,y,x+5,y+19);
293  5          call boxc(546,923,x-4,y,x+4,y+15);
294  5          end;
295  4        do case(c);                                  /* explosion sequence 6 */
296  5          call boxc(92,807,x-8,y,x+8,y+31);
297  5          call boxc(142,807,x-8,y,x+8,y+31);
298  5          call boxc(193,842,x-7,y,x+7,y+27);
299  5          call boxc(192,807,x-8,y,x+8,y+31);
300  5          call boxc(242,807,x-8,y,x+8,y+31);
301  5          call boxc(292,807,x-8,y,x+8,y+31);
302  5          call boxc(293,842,x-7,y,x+7,y+27);
303  5          call boxc(342,807,x-8,y,x+8,y+31);
304  5          call boxc(343,842,x-7,y,x+7,y+27);
305  5          call boxc(392,807,x-8,y,x+8,y+31);
306  5          call boxc(393,842,x-7,y,x+7,y+27);
307  5          call boxc(442,807,x-8,y,x+8,y+31);
308  5          call boxc(443,842,x-7,y,x+7,y+27);
309  5          call boxc(492,807,x-8,y,x+8,y+31);
310  5          call boxc(542,807,x-8,y,x+8,y+31);
311  5          call boxc(543,842,x-7,y,x+7,y+27);
312  5          call boxc(544,873,x-6,y,x+6,y+23);
313  5          call boxc(545,900,x-5,y,x+5,y+19);
314  5          call boxc(546,923,x-4,y,x+4,y+15);
315  5          call boxc(547,942,x-3,y,x+3,y+12);
316  5          end;
317  4        do case(c);                                  /* explosion sequence 7 */
318  5          call boxc(93,842,x-7,y,x+7,y+27);
319  5          call boxc(144,873,x-6,y,x+6,y+23);
320  5          call boxc(143,842,x-7,y,x+7,y+27);
321  5          call boxc(194,873,x-6,y,x+6,y+23);
322  5          call boxc(193,842,x-7,y,x+7,y+27);
323  5          call boxc(243,842,x-7,y,x+7,y+27);
324  5          call boxc(293,842,x-7,y,x+7,y+27);
325  5          call boxc(294,873,x-6,y,x+6,y+23);
326  5          call boxc(343,842,x-7,y,x+7,y+27);
327  5          call boxc(393,842,x-7,y,x+7,y+27);
328  5          call boxc(344,873,x-6,y,x+6,y+23);
329  5          call boxc(394,873,x-6,y,x+6,y+23);
330  5          call boxc(443,842,x-7,y,x+7,y+27);
331  5          call boxc(493,842,x-7,y,x+7,y+27);
332  5          call boxc(543,842,x-7,y,x+7,y+27);
333  5          call boxc(544,873,x-6,y,x+6,y+23);
334  5          call boxc(545,900,x-5,y,x+5,y+19);
335  5          call boxc(546,923,x-4,y,x+4,y+15);
336  5          call boxc(547,942,x-3,y,x+3,y+12);
337  5          call boxc(547,942,x-3,y,x+3,y+12);
338  5          end;
339  4        do case(c);                                  /* explosion sequence 8 */
340  5          call boxc(94,873,x-6,y,x+6,y+23);
341  5          call boxc(145,900,x-5,y,x+5,y+19);
342  5          call boxc(144,873,x-6,y,x+6,y+23);
343  5          call boxc(195,900,x-5,y,x+5,y+19);
344  5          call boxc(194,873,x-6,y,x+6,y+23);
345  5          call boxc(244,873,x-6,y,x+6,y+23);
346  5          call boxc(295,900,x-5,y,x+5,y+19);
347  5          call boxc(294,873,x-6,y,x+6,y+23);
348  5          call boxc(344,873,x-6,y,x+6,y+23);
349  5          call boxc(345,900,x-5,y,x+5,y+19);
350  5          call boxc(394,873,x-6,y,x+6,y+23);
351  5          call boxc(395,900,x-5,y,x+5,y+19);
352  5          call boxc(444,873,x-6,y,x+6,y+23);
353  5          call boxc(445,900,x-5,y,x+5,y+19);
354  5          call boxc(494,873,x-6,y,x+6,y+23);
355  5          call boxc(544,873,x-6,y,x+6,y+23);
356  5          call boxc(545,900,x-5,y,x+5,y+19);
357  5          call boxc(546,923,x-4,y,x+4,y+15);
358  5          call boxc(547,942,x-3,y,x+3,y+12);
359  5          call boxc(547,942,x-3,y,x+3,y+12);
360  5          end;
361  4        do case(c);                                  /* explosion sequence 9 */
362  5          call boxc(95,900,x-5,y,x+5,y+19);
363  5          call boxc(145,900,x-5,y,x+5,y+19);
364  5          call boxc(195,900,x-5,y,x+5,y+19);
365  5          call boxc(245,900,x-5,y,x+5,y+19);
366  5          call boxc(245,900,x-5,y,x+5,y+19);
367  5          call boxc(295,900,x-5,y,x+5,y+19);
368  5          call boxc(295,900,x-5,y,x+5,y+19);
369  5          call boxc(345,900,x-5,y,x+5,y+19);
370  5          call boxc(345,900,x-5,y,x+5,y+19);
371  5          call boxc(395,900,x-5,y,x+5,y+19);
372  5          call boxc(395,900,x-5,y,x+5,y+19);
373  5          call boxc(445,900,x-5,y,x+5,y+19);
374  5          call boxc(445,900,x-5,y,x+5,y+19);
375  5          call boxc(445,900,x-5,y,x+5,y+19);
376  5          call boxc(495,900,x-5,y,x+5,y+19);
377  5          call boxc(495,900,x-5,y,x+5,y+19);
378  5          call boxc(495,900,x-5,y,x+5,y+19);
379  5          call boxc(545,900,x-5,y,x+5,y+19);
380  5          call boxc(545,900,x-5,y,x+5,y+19);
381  5          call boxc(545,900,x-5,y,x+5,y+19);
382  5          end;
```

```
383  4          do case(c):                                  /* explosion sequence 10 */
384  5            call boxc(96,923,x-4,y,x+4,y+15);
385  5            call boxc(146,923,x-4,y,x+4,y+15);
386  5            call boxc(196,923,x-4,y,x+4,y+15);
387  5            call boxc(246,923,x-4,y,x+4,y+15);
388  5            call boxc(246,923,x-4,y,x+4,y+15);
389  5            call boxc(296,923,x-4,y,x+4,y+15);
390  5            call boxc(296,923,x-4,y,x+4,y+15);
391  5            call boxc(346,923,x-4,y,x+4,y+15);
392  5            call boxc(346,923,x-4,y,x+4,y+15);
393  5            call boxc(396,923,x-4,y,x+4,y+15);
394  5            call boxc(396,923,x-4,y,x+4,y+15);
395  5            call boxc(446,923,x-4,y,x+4,y+15);
396  5            call boxc(446,923,x-4,y,x+4,y+15);
397  5            call boxc(446,923,x-4,y,x+4,y+15);
398  5            call boxc(496,923,x-4,y,x+4,y+15);
399  5            call boxc(496,923,x-4,y,x+4,y+15);
400  5            call boxc(496,923,x-4,y,x+4,y+15);
401  5            call boxc(546,923,x-4,y,x+4,y+15);
402  5            call boxc(546,923,x-4,y,x+4,y+15);
403  5            call boxc(546,923,x-4,y,x+4,y+15);
404  5            end;
405  4          do case(c);                                  /* explosion sequence 11 */
406  5            call boxc(97,942,x-3,y,x+3,y+12);
407  5            call boxc(147,942,x-3,y,x+3,y+12);
408  5            call boxc(197,942,x-3,y,x+3,y+12);
409  5            call boxc(247,942,x-3,y,x+3,y+12);
410  5            call boxc(247,942,x-3,y,x+3,y+12);
411  5            call boxc(297,942,x-3,y,x+3,y+12);
412  5            call boxc(297,942,x-3,y,x+3,y+12);
413  5            call boxc(347,942,x-3,y,x+3,y+12);
414  5            call boxc(347,942,x-3,y,x+3,y+12);
415  5            call boxc(397,942,x-3,y,x+3,y+12);
416  5            call boxc(397,942,x-3,y,x+3,y+12);
417  5            call boxc(447,942,x-3,y,x+3,y+12);
418  5            call boxc(447,942,x-3,y,x+3,y+12);
419  5            call boxc(447,942,x-3,y,x+3,y+12);
420  5            call boxc(497,942,x-3,y,x+3,y+12);
421  5            call boxc(497,942,x-3,y,x+3,y+12);
422  5            call boxc(497,942,x-3,y,x+3,y+12);
423  5            call boxc(547,942,x-3,y,x+3,y+12);
424  5            call boxc(547,942,x-3,y,x+3,y+12);
425  5            call boxc(547,942,x-3,y,x+3,y+12);
426  5            end;
427  4          do case(c);                                  /* explosion sequence 12 */
428  5            call boxc(98,958,x-2,y,x+2,y+9);
429  5            call boxc(148,958,x-2,y,x+2,y+9);
430  5            call boxc(198,958,x-2,y,x+2,y+9);
431  5            call boxc(248,958,x-2,y,x+2,y+9);
432  5            call boxc(248,958,x-2,y,x+2,y+9);
433  5            call boxc(298,958,x-2,y,x+2,y+9);
434  5            call boxc(298,958,x-2,y,x+2,y+9);
435  5            call boxc(348,958,x-2,y,x+2,y+9);
436  5            call boxc(348,958,x-2,y,x+2,y+9);
437  5            call boxc(398,958,x-2,y,x+2,y+9);
438  5            call boxc(398,958,x-2,y,x+2,y+9);
439  5            call boxc(448,958,x-2,y,x+2,y+9);
440  5            call boxc(448,958,x-2,y,x+2,y+9);
441  5            call boxc(448,958,x-2,y,x+2,y+9);
442  5            call boxc(498,958,x-2,y,x+2,y+9);
443  5            call boxc(498,958,x-2,y,x+2,y+9);
444  5            call boxc(498,958,x-2,y,x+2,y+9);
445  5            call boxc(548,958,x-2,y,x+2,y+9);
446  5            call boxc(548,958,x-2,y,x+2,y+9);
447  5            call boxc(548,958,x-2,y,x+2,y+9);
448  5            end;
449  4          end;
450  3        end;
451  2      end miss;

       /*****************************************************************************/
       /***************** GRAPHIC SEQUENCES FOR ROUNDS IN FLIGHT ********************/

452  1      round: procedure (yi, xi, age) public:

453  2            declare   yi      integer,
                           xi      integer,
                           age     word,
                           x       word,
                           y       word;

454  2            x = unsign(xi);
455  2            y = unsign(yi);
456  2            do case age;
457  3              call box(0,x-1,y-1,x+1,y+1);      /* 0 */
458  3              call circ(1,1,x,y);                /* 1 */
459  3              call circ(3,1,x,y);                /* 2 */
460  3              call circ(5,1,x,y);                /* 3 */
461  3              call vec(1,x,y,x,y);              /* 4 */
462  3              call vec(2,x,y,x,y);              /* 5 */
463  3              call vec(3,x,y,x,y);              /* 6 */
464  3              call vec(4,x,y,x,y);              /* 7 */
465  3              call vec(5,x,y,x,y);              /* 8 */
466  3              call vec(5,x,y,x,y);              /* 9 */
```

```
467   3                if ping_flag then call vec(3,x,y,x,y);  /* 10 */
469   3                if ping_flag then call vec(4,x,y,x,y);  /* 11 */
471   3                if ping_flag then call vec(5,x,y,x,y);  /* 12 */
473   3                if ping_flag then call vec(6,x,y,x,y);  /* 13 */
475   3                if ping_flag then call vec(7,x,y,x,y);  /* 14 */
477   3                if ping_flag then call vec(7,x,y,x,y);  /* 15 */
479   3                end;
480   2        end round;

481   1        end mksub;


MODULE INFORMATION:

     CODE AREA SIZE     = 25B8H   9656D
     CONSTANT AREA SIZE = 0004H      4D
     VARIABLE AREA SIZE = 0012H     18D
     MAXIMUM STACK SIZE = 001CH     28D
     589 LINES READ
     0 PROGRAM WARNINGS
     0 PROGRAM ERRORS

DICTIONARY SUMMARY:

     288KB MEMORY AVAILABLE
     12KB MEMORY USED   (4%)
     0KB DISK SPACE USED

END OF PL/M-286 COMPILATION

              $debug optimize(3)

  1           blitmem: do;

              $include (:LIB:literal.inc)
          *   $nolist
              $include (:LIB:sys_calls.inc)
          *   $nolist
              $include (:LIB:serialio.inc)
          *   $nolist
              $include (:LIB:parallax.inc)
          *   $nolist

              /************************* EXPLOSION SEQUENCES ****************************/

210   1         declare  error     word,
                       status    word;

211   1         declare  expheight(13)  word  data (79,67,55,47,39,31,27,23,19,15,12,9,6),
                       expwidth(13)   word  data (19,16,14,11,9,8,7,6,5,4,3,2,1),
                       xcenter        word,
                       ybase          word,
                       ytop           word,
                       i              word,
                       j              word;

212   1         declare  expfile         token,
                       expblock(4000)  byte,
                       exph_pixels     word,
                       expw_pixels     word,
                       expa_bytes      word,
                       expa_words      word,
                       bytesread       word;

              /* DRAW TRANSPARENT BLOCKS FOR EXPLOSIONS */
213   1       explosion_blocks: procedure public:
214   2           call send_data(25);
215   2           call send_data(5);
216   2           ybase = 500;
217   2           do i = 0 to 12;
218   3             ytop = ybase + expheight(i);
219   3             do xcenter = 100 to 550 by 50;
220   4               call box(247,xcenter - expwidth(i),ybase,xcenter + expwidth(i),ytop);
221   4               end;
222   3             ybase = ytop + 4;
223   3             end;
224   2           call send_data(25);
225   2           call send_data(4);
226   2       end explosion_blocks;

227   1       restore_explosions: procedure public:

228   2           expfile = dq$attach (@(10,'wgyser.pix'), @error);
229   2           call dq$open(expfile, 1, 0, @error);
230   2           ybase = 500;
231   2           do i = 0 to 12;
232   3             ytop = ybase + expheight(i);
233   3             exph_pixels = expheight(i) + 1;
234   3             expw_pixels = (expwidth(i) * 2) + 1;
235   3             expa_bytes = exph_pixels * expw_pixels;
236   3             if expa_bytes then expa_bytes = expa_bytes + 1;
238   3             expa_words = expa_bytes / 2;
239   3             do xcenter = 100 to 550 by 50;
```

```
240   4              bytesread = dq$read (expfile, @expblock, expa_bytes, @error);
241   4              do j = 0 to expa_bytes - 1;
242   5                if expblock(j) = 255 then expblock(j) = 247;    /* transparent */
244   5                end;
245   4              call send_data(20H);
246   4              call send_data( xcenter - expwidth(i) );
247   4              call send_data( ybase );
248   4              call send_data( xcenter + expwidth(i) );
249   4              call send_data( ytop );
250   4              call blockoutword(cdr,@expblock,expa_words);
251   4              end;
252   3            ybase = ytop + 4;
253   3            end;
254   2          call dq$close(expfile, @error);
255   2      end restore_explosions;

             /* DRAW TRANSPARENT BLOCKS FOR hitS */
256   1      hit_blocks: procedure public;
257   2          call send_data(25);
258   2          call send_data(5);
259   2          ybase = 500;
260   2          do i = 0 to 8;
261   3            ytop = ybase + expheight(i);
262   3            do xcenter = 750 to 1150 by 50;
263   4              call box(247,xcenter - expwidth(i),ybase,xcenter + expwidth(i),ytop);
264   4              end;
265   3            ybase = ytop + 4;
266   3            end;
267   2          call send_data(25);
268   2          call send_data(4);
269   2      end hit_blocks;

270   1      restore_hits: procedure public;

271   2          expfile = dq$attach (@(8,'hits.pix'), @status);
272   2          call dq$open(expfile, 1, 0, @status);
273   2          ybase = 500;
274   2          do i = 0 to 8;
275   3            ytop = ybase + expheight(i);
276   3            exph_pixels = expheight(i) + 1;
277   3            expw_pixels = (expwidth(i) * 2) + 1;
278   3            expa_bytes = exph_pixels * expw_pixels;
279   3            if expa_bytes then expa_bytes = expa_bytes + 1;
281   3            expa_words = expa_bytes / 2;
282   3            do xcenter = 750 to 1150 by 50;
283   4              bytesread = dq$read (expfile, @expblock, expa_bytes, @status);
284   4              call send_data(20H);
285   4              call send_data( xcenter - expwidth(i) );
286   4              call send_data( ybase );
287   4              call send_data( xcenter + expwidth(i) );
288   4              call send_data( ytop );
289   4              call blockoutword(cdr,@expblock,expa_words);
290   4              end;
291   3            ybase = ytop + 4;
292   3            end;
293   2          call dq$close(expfile, @status);
294   2      end restore_hits;

295   1      end blitmem;


MODULE INFORMATION:

     CODE AREA SIZE     = 03ABH    939D
     CONSTANT AREA SIZE = 0048H     72D
     VARIABLE AREA SIZE = 0FBCH   4028D
     MAXIMUM STACK SIZE = 0014H     20D
     494 LINES READ
     0 PROGRAM WARNINGS
     0 PROGRAM ERRORS

DICTIONARY SUMMARY:

     288KB MEMORY AVAILABLE
     16KB MEMORY USED   (5%)
     0KB DISK SPACE USED

END OF PL/M-286 COMPILATION

             $debug optimize(3)

  1          serialio: do:

             $include (literal.inc)
           * $nolist
             $include (sys_calls.inc)
           * $nolist

             /************* terminal i/o routines ******************************/

 92   1      declare  error       word,
                      bytes_read  word;
```

```
 93  1     declare   term_buff (256) byte public,
                      term_pntr       word public,
                      stat_byte       byte public,
                      cin             token public,
                      cout            token public,
                      term            token public,
                      stat            token public,
                      port0           token public,
                      port1           token public;

 94  1     setup: procedure public;
 95  2            cin = dq$attach ( @(4,':CI:'), @error);
 96  2            call dq$open (cin, 1, 0, @error);
 97  2            call dq$special (1, @cin, @error);
 98  2            stat = dq$attach ( @(4,':CI:'), @error);
 99  2            call dq$open (stat, 1, 0, @error);
100  2            call dq$special (3, @stat, @error);
101  2            cout = dq$create ( @(4,':CO:'), @error);
102  2            call dq$open (cout, 2, 0, @error);
103  2     end setup;

104  1     ci: procedure byte public;
105  2         declare  ch  byte;
106  2         bytes_read = dq$read (cin, @ch, 1, @error);
107  2         return ch;
108  2     end ci;

109  1     co: procedure(item) public;
110  2         declare item byte;
111  2         call dq$write (cout, @item, 1, @error);
112  2     end co;

113  1     csts: procedure byte public;
114  2           bytes_read = dq$read (stat, @stat_byte, 1, @error);
115  2           if bytes_read = 0 then return false;
117  2           else return true;
118  2     end csts;

119  1     write_ln: procedure (buff_p, buff_len) public;
120  2               declare   buff_p                    pointer,
                               (buff based buff_p) (1)  byte,
                               (buff_len, i)            word;

121  2               if buff_len <= 0 then return;
123  2               do i = 0 to (buff_len - 1);
124  3                  call co(buff(i));
125  3                  end;
126  2     end write_ln;

127  1     output_fp: procedure(x) public;
128  2                declare    x       real,
                                xE3     real,
                                xwhole  integer,
                                xfract  integer,
                                xi      integer,
                                xw      word;

129  2                xwhole = fix(x);
130  2                if iabs(xwhole) < 100 then do;
132  3                  if xwhole < 0 then call co('-');
134  3                  call decw_out(unsign(xwhole));
135  3                  x = x - float(xwhole);
136  3                  xfract = fix( 1000.0 * x );
137  3                  call co('.');
138  3                  call decw_out(unsign(xfract));
139  3                  end;
140  2                else do;
141  3                  if xwhole < 0 then call co('-');
143  3                  xw = unsign(xwhole);
144  3                  call decw_out(xw);
145  3                  end;
146  2     end output_fp;

           /* THIS ROUTINE OUTPUTS A WORD IN DECIMAL TO THE SCREEN WITH NO LEADING 0'S */
147  1     decw_out: procedure (item) public;
148  2               declare  item    word,
                                b (5)   byte,
                                i       integer,
                                j       integer;

149  2               j = 0;
150  2               if item > 9 then j = j + 1;
152  2               if item > 99 then j = j + 1;
154  2               if item > 999 then j = j + 1;
156  2               if item > 9999 then j = j + 1;
158  2               do i = j to 0 by -1;
159  3                  b(i) = (item mod 10) + 30h;
160  3                  item = item / 10;
161  3                  end;
162  2               call write_ln(@b, (unsign(j) + 1));
163  2     end decw_out;
```

```
164   1      open_port0: procedure public;
165   2             call rq$logical$attach$device( @(4,':P0:'), @(6,'t546_0'), 1, @error);
166   2             port0 = dq$attach (@(4,':P0:'), @error);
167   2             call dq$open (port0, 3, 0, @error);
168   2             call dq$special (1, @port0, @error);
169   2      end open_port0;

170   1      close_port0: procedure public;
171   2             call rq$logical$detach$device( @(4,':P0:'), @error);
172   2      end close_port0;

173   1      open_port1: procedure public;
174   2             call rq$logical$attach$device( @(4,':P1:'), @(6,'t546_1'), 1, @error);
175   2             if error <> 0 then call co('X');
177   2             port1 = dq$attach (@(4,':P1:'), @error);
178   2             if error <> 0 then call co('X');
180   2             call dq$open (port1, 3, 0, @error);
181   2             if error <> 0 then call co('X');
183   2             call dq$special (1, @port1, @error);
184   2             if error <> 0 then call co('X');
186   2      end open_port1;

187   1      close_port1: procedure public;
188   2             call rq$logical$detach$device( @(4,':P1:'), @error);
189   2      end close_port1;

190   1      clear_screen: procedure public;
191   2                    call write_ln(@(1aH), 1);
192   2                    call time(200);
193   2      end clear_screen;

194   1      end serialio;
```

```
MODULE INFORMATION:

     CODE AREA SIZE     = 0379H    889D
     CONSTANT AREA SIZE = 0040H     64D
     VARIABLE AREA SIZE = 012BH    299D
     MAXIMUM STACK SIZE = 002EH     46D
     329 LINES READ
     0 PROGRAM WARNINGS
     0 PROGRAM ERRORS

DICTIONARY SUMMARY:

     288KB MEMORY AVAILABLE
     10KB MEMORY USED   (3%)
     0KB DISK SPACE USED

END OF PL/M-286 COMPILATION
```

```
              $debug optimize(3)

  1           get_input: do;

              $include (:lib:literal.inc)
          =   $nolist
              $include (:lib:sys_calls.inc)
          =   $nolist
              $include (:lib:serialio.inc)
          =   $nolist

121   1       DECLARE   FLOAT_OUT     LIT  'mqcBIN_DECLOW';

122   1       DECLARE   BIN_DECLOW_BLOCK STRUCTURE (
                        BIN_PTR       POINTER,
                        BIN_TYPE      BYTE,
                        DEC_LENGTH    BYTE,
                        DEC_PTR       POINTER,
                        DEC_EXPONENT  INTEGER,
                        DEC_SIGN      BYTE );


123   1       INPT: PROCEDURE PUBLIC;
124   2             DECLARE CH BYTE;

125   2             CH = 0;
126   2             TERM_PNTR = 0;
127   2             DO WHILE CH <> CR;
128   3                CH = CI;
129   3                IF CH = RUB THEN DO;
131   4                   IF TERM_PNTR > 0 THEN DO;
133   5                      CALL WRITE_LN(@(BS,SPACE,BS),3);
134   5                      TERM_PNTR = TERM_PNTR - 1;
135   5                      END;
136   4                   ELSE CALL CO(BELL);
137   4                   END;
138   3                ELSE IF CH = CR THEN DO;
140   4                   CALL WRITE_LN(@(CR,LF),2);
141   4                   IF TERM_PNTR > 0 THEN DO;
143   5                      TERM_BUFF(TERM_PNTR) = ' ';
144   5                      TERM_BUFF(TERM_PNTR + 1) = CR;
145   5                      END;
```

```
146   4                 else term_buff(0) = cr;
147   4                 END;
148   3              ELSE DO;
149   4                 TERM_BUFF(TERM_PNTR) = CH;
150   4                 CALL CO(CH);
151   4                 TERM_PNTR = TERM_PNTR + 1;
152   4                 END;
153   3              END;

154   2           END INPT;


155   1      INPUT_FP: PROCEDURE REAL PUBLIC;
156   2                DECLARE  I_BUFF (256)  BYTE,
                               F_BUFF (256)  BYTE,
                               E_BUFF (256)  BYTE,
                               FLAG          BYTE,
                               SIGN_FLAG     BYTE,
                               E_SIGN_FLAG   BYTE,
                               CNT           INTEGER,
                               ICNT          INTEGER,
                               FCNT          INTEGER,
                               ECNT          INTEGER,
                               PNTR          WORD,
                               HEX_VAL       REAL,
                               EXP_VAL       REAL,
                               MULT          REAL,
                               TEMP          REAL;

157   2                FLAG, SIGN_FLAG, E_SIGN_FLAG = FALSE;
158   2                CNT, ICNT, FCNT, ECNT = 0;
159   2                PNTR = 0;
160   2                HEX_VAL, EXP_VAL = 0.0;

161   2                CALL INPT;
162   2                IF TERM_BUFF(PNTR) = '-' THEN DO;
164   3                   SIGN_FLAG = TRUE;
165   3                   PNTR = PNTR + 1;
166   3                   END;
167   2                ELSE IF TERM_BUFF(PNTR) = '+' THEN PNTR = PNTR + 1;

169   2                DO WHILE NOT FLAG;

170   3                   IF (TERM_BUFF(PNTR) >= 30H) AND (TERM_BUFF(PNTR) <= 39H) THEN DO;
172   4                      I_BUFF(ICNT) = TERM_BUFF(PNTR);
173   4                      PNTR = PNTR + 1;
174   4                      ICNT = ICNT + 1;
175   4                      END;
176   3                   ELSE IF (TERM_BUFF(PNTR) = '.') OR (TERM_BUFF(PNTR) = ' ') OR
                                 (TERM_BUFF(PNTR) = 'E') OR (TERM_BUFF(PNTR) = CR)
177   3                      THEN FLAG = TRUE;
178   3                   ELSE PNTR = PNTR + 1;
179   3                   END;

180   2                DO WHILE TERM_BUFF(PNTR) = SPACE;
181   3                   PNTR = PNTR + 1;
182   3                   END;

183   2                IF TERM_BUFF(PNTR) = '.' THEN DO;
185   3                   PNTR = PNTR + 1;
186   3                   FLAG = FALSE;

187   3                   DO WHILE NOT FLAG;
188   4                      IF (TERM_BUFF(PNTR) >= 30H) AND (TERM_BUFF(PNTR) <= 39H)
189   4                         THEN DO;

190   5                         F_BUFF(FCNT) = TERM_BUFF(PNTR);
191   5                         PNTR = PNTR + 1;
192   5                         FCNT = FCNT + 1;
193   5                         END;
194   4                      ELSE IF (TERM_BUFF(PNTR) = ' ') OR (TERM_BUFF(PNTR) = 'E') OR
195   4                              (TERM_BUFF(PNTR) = CR) THEN FLAG = TRUE;
196   4                      ELSE PNTR = PNTR + 1;
197   4                      END;

198   3                   DO WHILE TERM_BUFF(PNTR) = SPACE;
199   4                      PNTR = PNTR + 1;
200   4                      END;
201   3                   END;

202   2                IF TERM_BUFF(PNTR) = 'E' THEN DO;
204   3                   PNTR = PNTR + 1;
205   3                   FLAG = FALSE;

206   3                   DO WHILE TERM_BUFF(PNTR) = SPACE;
207   4                      PNTR = PNTR + 1;
208   4                      END;

209   3                   IF TERM_BUFF(PNTR) = '-' THEN DO;
211   4                      E_SIGN_FLAG = TRUE;
212   4                      PNTR = PNTR + 1;
213   4                      END;
214   3                   ELSE IF TERM_BUFF(PNTR) = '+' THEN PNTR = PNTR + 1;
```

```
216  3                 DO WHILE NOT FLAG;
217  4                    IF (TERM_BUFF(PNTR) >= 30H) AND (TERM_BUFF(PNTR) <= 39H)
218  4                       THEN DO;

219  5                       E_BUFF(ECNT) = TERM_BUFF(PNTR);
220  5                       PNTR = PNTR + 1;
221  5                       ECNT = ECNT + 1;
222  5                       END;
223  4                    ELSE IF (TERM_BUFF(PNTR) = ' ') OR (TERM_BUFF(PNTR) = CR) THEN
224  4                       FLAG = TRUE;

225  4                    ELSE PNTR = PNTR + 1;

226  4                    END;
227  3                 END;

228  2              MULT = 1.0;

229  2              IF ICNT > 0 THEN DO CNT = (ICNT - 1) TO 0 BY -1;

231  3                 TEMP = FLOAT(SIGNED(DOUBLE(I_BUFF(CNT) - 30H)));
232  3                 HEX_VAL = HEX_VAL + MULT * TEMP;
233  3                 MULT = MULT * 10.0;
234  3                 END;

235  2              MULT = 0.1;

236  2              IF FCNT > 0 THEN DO CNT = 0 TO (FCNT - 1);
238  3                 TEMP = FLOAT(SIGNED(DOUBLE(F_BUFF(CNT) - 30H)));
239  3                 HEX_VAL = HEX_VAL + MULT * TEMP;
240  3                 MULT = MULT / 10.0;
241  3                 END;

242  2              MULT = 1.0;

243  2              IF ECNT > 0 THEN DO CNT = (ECNT - 1) TO 0 BY -1;
245  3                 TEMP = FLOAT(SIGNED(DOUBLE(E_BUFF(CNT) - 30H)));
246  3                 EXP_VAL = EXP_VAL + MULT * TEMP;
247  3                 MULT = MULT * 10.0;
248  3                 END;

249  2              IF SIGN_FLAG THEN HEX_VAL = -HEX_VAL;
251  2              MULT = Y2X(10.0, EXP_VAL);
252  2              IF E_SIGN_FLAG THEN MULT = 1.0 / MULT;
254  2              HEX_VAL = HEX_VAL * MULT;

255  2              RETURN HEX_VAL;

256  2              END INPUT_FP;


257  1     INPUT_integer: PROCEDURE integer PUBLIC;
258  2                    DECLARE  I_BUFF (256)  BYTE,
                                  FLAG          BYTE,
                                  CNT           INTEGER,
                                  ICNT          INTEGER,
                                  PNTR          WORD,
                                  HEX_VAL       REAL,
                                  MULT          REAL,
                                  TEMP          REAL;

259  2                    FLAG = FALSE;
260  2                    CNT, ICNT = 0;
261  2                    PNTR = 0;
262  2                    HEX_VAL = 0.0;

263  2                    CALL INPT;

264  2                    DO WHILE NOT FLAG;

265  3                       IF (TERM_BUFF(PNTR) >= 30H) AND (TERM_BUFF(PNTR) <= 39H) THEN DO;
267  4                          I_BUFF(ICNT) = TERM_BUFF(PNTR);
268  4                          PNTR = PNTR + 1;
269  4                          ICNT = ICNT + 1;
270  4                          END;
271  3                       ELSE IF (TERM_BUFF(PNTR) = CR) THEN FLAG = TRUE;
273  3                       ELSE PNTR = PNTR + 1;
274  3                       END;

275  2                    MULT = 1.0;

276  2                    IF ICNT > 0 THEN DO CNT = (ICNT - 1) TO 0 BY -1;

278  3                       TEMP = FLOAT(SIGNED(DOUBLE(I_BUFF(CNT) - 30H)));
279  3                       HEX_VAL = HEX_VAL + MULT * TEMP;
280  3                       MULT = MULT * 10.0;
281  3                       END;

282  2                    RETURN fix(HEX_VAL);

283  2                    END INPUT_integer;
```

```
284   1      input_word: procedure word public;
285   2                  declare i word;

286   2                  i = unsign(input_integer);
287   2                  return i;

288   2                  end input_word;


289   1      input_byte: procedure byte public;
290   2                  declare i byte;

291   2                  i = low(unsign(input_integer));
292   2                  return i;

293   2      end input_byte;

294   1      end get_input;
```

```
MODULE INFORMATION:

     CODE AREA SIZE     = 04E7H   1255D
     CONSTANT AREA SIZE = 001DH     29D
     VARIABLE AREA SIZE = 0441H   1089D
     MAXIMUM STACK SIZE = 001EH     30D
     490 LINES READ
     0 PROGRAM WARNINGS
     0 PROGRAM ERRORS

DICTIONARY SUMMARY:

     288KB MEMORY AVAILABLE
     12KB MEMORY USED   (4%)
     0KB DISK SPACE USED

END OF PL/M-286 COMPILATION
```

What is claimed is:

1. A minor caliber weapons trainer comprising: a screen for displaying target and shot images; projector means for projecting a pre-recorded target image onto the screen; shot simulator means for providing said shot image, having means for projecting shot in-flight and impact images on the screen, and a simulated minor caliber weapon having elevation sensing means for providing elevation data of said minor caliber weapon, and actuable trigger means for providing a signal to generate trajectory data upon actuation of said trigger means; and computer mean coupled to said shot simulator means and said projector means for identifying a preselected range and location within the target image, computing the trajectory data and impact location for said shot image in accordance with a ballistic equation and said elevation data in response to said signal from said trigger means, and comparing said preselected range and location with said trajectory data and impact location to identify hits.

2. The trainer of claim 1 wherein said target image is video recorded data in frame format with each frame individually digitized with said preselected range and location; and wherein said shot image is a computer generated image.

3. The trainer of claim 1 wherein said impact image comprises preselected hit and miss explosion images selectable from a predetermined set of images that vary in size.

4. The trainer of claim 1 wherein said inflight and impact images are superimposed on said target image, and wherein said shot simulator means further includes means for blanking the portion of the impact image that corresponds to a predetermined target at said preselected range and location when the comparison by said computer means determines that the target image is in covering relationship to the impact image.

5. The trainer of claim 1 further comprising a sound generator having first and second channels, wherein the first channel generates a digitized gunshot sound affect and enables the second channel to generate a digitized hit sound and a digitized miss sound that are corresponding to the comparison by said computer means.

6. The trainer of claim 5 wherein said second channel includes means for providing the hit sound and miss sound in a preselected period of time after projection of said impact image and at a preselected volume, to simulate the lag in the speed of sound compared to the speed of light and the decay in volume of a sound over distance, wherein the preselected period of time and volume are selected from a set of stored delay and volume levels.

7. The trainer of claim 1 wherein said simulated minor caliber weapon further has handles and means for simulating recoil in the handles upon actuation of the trigger means.

* * * * *